US008441155B2

(12) United States Patent
Simard et al.

(10) Patent No.: US 8,441,155 B2
(45) Date of Patent: May 14, 2013

(54) ELECTRIC TIMER FOR CONTROLLING POWER TO A FAN

(75) Inventors: Pierre Simard, St.-Bruno (CN); Patrick Langevin, St-Basile-Le-Grand (CA); Benoit Meilleur, Lasalle (CA); Dominic Boisvert, St-Blaise-sur-Richelieu (CA)

(73) Assignee: Honeywell International Inc., Morristown, NJ (US)

( * ) Notice: Subject to any disclaimer, the term of this patent is extended or adjusted under 35 U.S.C. 154(b) by 692 days.

(21) Appl. No.: 12/608,785

(22) Filed: Oct. 29, 2009

(65) Prior Publication Data

US 2010/0140070 A1 Jun. 10, 2010

Related U.S. Application Data

(63) Continuation-in-part of application No. 12/182,069, filed on Jul. 29, 2008.

(51) Int. Cl.

| | |
|---|---|
| ***H01H 9/54*** | (2006.01) |
| ***H01H 33/59*** | (2006.01) |
| ***H01H 47/00*** | (2006.01) |
| ***H01H 85/46*** | (2006.01) |
| ***H01H 3/26*** | (2006.01) |
| ***H01H 3/28*** | (2006.01) |

(52) U.S. Cl.
USPC ..... 307/140

(58) Field of Classification Search ..... 307/140, 307/141; 200/33 R
See application file for complete search history.

(56) References Cited

U.S. PATENT DOCUMENTS

| | | | | |
|---|---|---|---|---|
| D310,338 | S | 9/1990 | Cureton | |
| 5,160,863 | A | 11/1992 | Hui | |
| 5,218,235 | A | 6/1993 | Patterson et al. | |
| 5,272,427 | A | 12/1993 | Nold et al. | |
| 5,572,104 | A | 11/1996 | Nold et al. | |
| 5,589,741 | A | 12/1996 | Terman et al. | |
| 5,627,527 | A * | 5/1997 | Mehta | 340/3.1 |
| 5,736,795 | A | 4/1998 | Zuehlke et al. | |
| D409,505 | S | 5/1999 | Janda et al. | |
| 5,903,139 | A | 5/1999 | Kompelien | |
| 6,043,611 | A | 3/2000 | Gradzki | |
| 6,121,889 | A | 9/2000 | Janda et al. | |

(Continued)

FOREIGN PATENT DOCUMENTS

WO 2006022838 3/2006

OTHER PUBLICATIONS

Decora Electronic timer switches L101 Catalog, prior to Jul. 29, 2008, p. D20, Leviton.

(Continued)

*Primary Examiner* — Carlos Amaya
(74) *Attorney, Agent, or Firm* — Seager Tufte & Wickhem LLC.

(57) ABSTRACT

A fan controller that is capable of switching power to a fan between an "on" state and an "off" state in accordance with one or more programmable schedule. In some cases, fan controller may be programmed to display one or more screens for setting one or more parameters of the fan controller by interacting with a first button and/or a second button. In some cases, when the controller is in an operating mode, depressing a first button, second button, and/or a third button may temporarily override the programmable schedule and, in some cases, override the programmable schedule for a programmable period of time.

22 Claims, 52 Drawing Sheets

U.S. PATENT DOCUMENTS

| | | | |
|---|---|---|---|
| 6,288,458 | B1 | 9/2001 | Berndt |
| 6,318,639 | B1 | 11/2001 | Toth |
| D455,359 | S | 4/2002 | Stekelenburg |
| 6,490,174 | B1 | 12/2002 | Kimpelien |
| D500,686 | S | 1/2005 | Stekelenburg |
| D500,687 | S | 1/2005 | Morrison et al. |
| D534,440 | S | 1/2007 | Stekelenburg |
| D575,646 | S | 8/2008 | Ni et al. |
| 8,239,066 | B2 | 8/2012 | Jennings et al. |
| 2002/0186070 | A1 | 12/2002 | Wall et al. |
| 2004/0251848 | A1 | 12/2004 | Kim |
| 2007/0114848 | A1 | 5/2007 | Mulhouse et al. |
| 2007/0115135 | A1 | 5/2007 | Mulhouse et al. |
| 2007/0296280 | A1 | 12/2007 | Sorg et al. |

OTHER PUBLICATIONS

ET616 In-Wall Electronic Timer prior to Jul. 29, 2008, p. 96, Intermatic.

ET724 Electronic I-Wall Timer, prior to Jul. 29, 2008, p. 98, Intermatic.

Intermatic Retail switches 2008-TS89 10091, prior to Jul. 29, 2008, -179, Intermatic.

Suntracker 100 Series Information and Instructions, prior to Jul. 29, 2008, 6 pages, Sangamo Limited, Industrial Estate, Port Glasgow, Renfrewshire, UL, P/N 143370 Issue H.

Series E1400 Series Decorator Electronic Auto-Off Timer, prior to Jul. 29, 2008, p. 59, Internatic.

Series E1500 Decorator Digital 7-Day Tine Switch, prior to Jul. 29, 2008, p. 60, Intermatic.

Series E1600 7-day Astro Time Switch, prior to Jul. 29, 2008, p. 61, Intermatic.

Easyset Programming the Intermatic EJ500C Timerk, on or prior to Feb. 24, 2006, 2 pp, No. 158EJ12685, Intermatic Incorporated, Spring Grove, IL.

ETW 190 Wall Switch Timer Features, or or prior to Feb. 22, 2006, 1p Aube.

T1032-3W Installation and User Guide, Nov. 30, 2006, 2pp, 400-032-001-B, Aube.

T1033 Installation and User Guide, Nov. 30, 2006, 2pp, 400-033-001-C, Aube.

T1034-3W Installation and User Guide, Mar. 13, 2007, 2pp, 400-034-001-D, Aube, and T1034-3W/T1035 Addendum, Mar. 12, 2007, 2pp, 400-034-003-B, Aube.

T1035 Installation and User Guide, Mar. 12, 2007, 2pp, 400-035-001-C, Aube, and T1034-3W/1035 Addendum, Mar. 13, 2007, 2pp, 400-034-003-B, Aube.

T1040 Installation and User Guide, Jan. 15, 2007, 2pp, 400-040-001-A, Aube.

T1044 Installat6ion and User Guide, Jan. 9, 2007, 4pp, 400-044-001-B, Aube.

T1052A-3W Installation and User Instructions, prior to Jul. 29, 2008, 2pp, 720-052002, Aube.

T1054A-06-3W Installation and User Instructions, prior to Jul. 29, 2008, 3pp, 920-054-001-1-0, Aube.

EJ500 Installation and User INstructions, prior to Jul. 29, 2008, 2pp, 158-00413, Intermatic Incorporated, Spring Grove, IL.

EJ500 Installation and Operating Instructions, prior to Jul. 29, 2008, 4pp, 158EJ11853, Intermatic Incorporated, Spring Grove, IL.

LST100 Installation and Operating Instructions, prior to Jul. 29, 2008, 2pp, Doc No. 7000-0007, Rev. B, Swylite Corporation, Winter Park, FL.

Expanded E1600 p. 1 drawing, prior to Jul. 29, 2008, 1p, 158EI13058.pdf.

EJ500 Installation and User Instructions, prior to Jul. 29, 2008, 4pp, 158-00413, Intermatic Incorporated, Spring Grove, IL.

E1600 Series Installation and User Instructions, prior to Jul. 29, 2008, 4pp 158EI13058, Intermatic Incorporated, Spring Grove, IL.

E120 Installation and Operating Instructions, prior to Jul. 29, 2008, 2pp, 158SS11359, Intermatic Incorporated, Spring Grove, IL.

Decora 24-Hour Programmable Timer Switch, Installation Instructions, Feb. 14, 2002, 2pp, DI-000-6124H-20A-A0, Leviton.

* cited by examiner

ELECTRIC TIMER FOR CONTROLLING POWER TO A FAN

RELATED APPLICATIONS

This application is a continuation-in-part of U.S. application Ser. No. 12/182,069, filed Jul. 29, 2008, entitled "ELECTRIC TIMER FOR CONTROLLING POWER TO A LOAD", which is hereby incorporated by reference.

FIELD

The present invention generally relates to electric timers, and more particularly, to wall mountable electric timers for switching power on and off to a load.

BACKGROUND

Electric timers can be used in building or other structures to control power to a load, such as to turn power on and off to a load in accordance with a schedule or some other time parameter(s) and/or event(s). In some cases, such electric timers are programmable. There is an ongoing need for improved electric timers.

SUMMARY

The present invention generally relates to electric timers, and more particularly, to electric timers that are capable of switching power on and off to a load. In one illustrative embodiment, an electric timer is provided for switching power to a fan between an "on" state and an "off" state. The illustrative electric timer may include a housing, at least one memory, a controller, and a user interface. The memory may store a programmable schedule, as well as one or more parameters for the electric timer. The controller may be coupled to the memory, and may control the switching of power to the fan between an "on" state and an "off" state in accordance with the programmable schedule. The user interface may be situated on the front of the housing, and may be coupled to the controller. The user interface may include a display, a first button, and a second button. In some embodiments, the controller may be programmable such that a user can program the schedule, and in some cases one or more parameters, by physically interacting with the first button and the second button. In some embodiments, the user interface may also include a third button or more buttons, as desired.

In some embodiments, the controller may be programmed to display one or more parameter setting screens for setting the one or more parameters by interacting with the first button and/or second button when the controller is initially powered up. In some cases, the controller may display a home screen of the electric timer if the controller does not detect the depression of the first button or the second button within a period of time after the one or more parameter setting screens are displayed. In some cases, for subsequent power-ups, the controller may be programmed to display the one or more parameter setting screens if the one or more parameters are not yet set, or, if the one or more parameters are set, the controller may be programmed to not display the one or more parameter setting screens upon subsequent power ups. In some cases, the one or more parameters may include a floor space parameter, a number of bedrooms parameter, and/or a fan capacity parameter.

In some embodiments, the controller may have an operating mode and a setup mode. When in the operating mode, depressing the first button may cause the controller to switch power to the fan between the "on" state and the "off" state. In some cases, when the controller is in the operating mode, depressing the second button or the third button may initiate a countdown mode that may cause the controller to switch power to the fan to the "on" state for a programmable or set period of time. In some cases, once the countdown mode is initiated, depressing the second button or the third button may adjust the programmable period of time of the countdown mode.

In some cases, the controller may switch power to the fan between an "on" state and an "off" state in accordance with a programmable schedule. In some cases, a first programmable schedule may include a cycled "on" state and "off" state. A second programmable schedule may include a daily switch "on" time and a daily switch "off" time. In some cases, a third or more programmable schedule may include cycling the fan between the "on" state and the "off" state at a rate that is dependent upon a number of bedrooms parameter, a floor size parameter, and/or a fan capacity parameter, if desired.

This summary is provided to facilitate an understanding of some of the innovative features unique to the present invention and is not intended to be a full description. A full appreciation of the invention can be gained by taking the entire specification, claims, drawings, and abstract as a whole.

BRIEF DESCRIPTION

The invention may be more completely understood in consideration of the following detailed description of various illustrative embodiments of the invention in connection with the accompanying drawings, in which.

DETAILED DESCRIPTION

Figure 1:
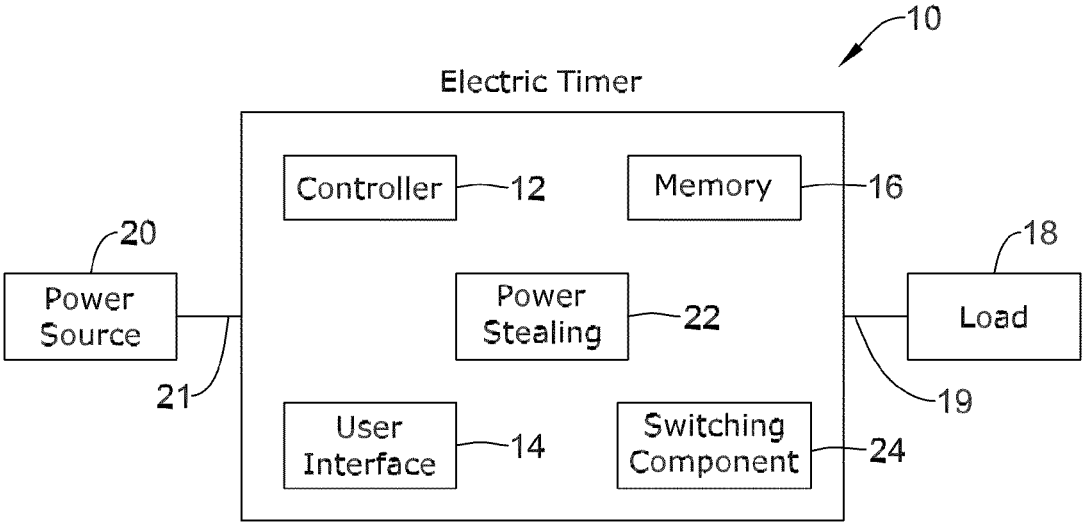
FIG. 1 is a block diagram of an illustrative electric timer for use in a building or other structure.

The following description should be read with reference to the drawings wherein like reference numerals indicate like elements throughout the several views. The detailed description and drawings show several embodiments which are meant to be illustrative of the claimed invention.

FIG. 1 is a block diagram of an illustrative electric timer 10 for use in a building or other structure. In the illustrative embodiment, the electric timer 10 may include an input port 21 connected to a power source 20 and an output port 19 connected to a load 18. The electric timer 10 may be configured to selectively provide power from the power source 20 to the load 18. In some cases, the electric timer 10 may be configured to have an "on" state, where power is supplied from the power source 20 to the load 18, and an "off" state, where power is prevented from being supplied to the load 18. In some cases, the electric timer 10 may switch between the "on" state and the "off" state in accordance with a programmable schedule. In some cases, the electric timer 10 may have a number of "on" states, each with a different power output (e.g. 25% power, 50% power, 75% power, 100% power). When so provided, the electric timer 10 may switch between the various "on" states (and the "off" state) in accordance with a programmable schedule.

In the illustrative embodiment, the electric timer 10 may include a controller 12, a user interface 14, a memory 16, and a switching component 24. The switching component 24 may switch power on and off to the load 18 according to control signals provided by the controller 12. In some illustrative embodiments, the switching component 24 may include an "on" state and an "off" state. The "on" state may pass current from the power source 20 to the load 18. The "off" state may prevent current from passing from the power source 20 to the load 18. In some embodiments, the switching component 24 may be or include a relay, a transistor, a Triac, and/or any other suitable switch device, as desired. In some cases, it is contemplated that the switching component 24 may include a number of "on" states, each with a different power output (e.g. 25% power, 50% power, 75% power, 100% power).

In the illustrative embodiment, the controller 12 may be configured to control the switch state of the switching component 24 of the electric timer 10. In some embodiments, the control of the switching component 24 may be performed in accordance with a programmable schedule, a random schedule, a predetermined factory programmed schedule and/or a manual input from a user.

Controller 12 may also be configured to control and/or set one or more operating parameters of the electronic switch 10, such as, for example, one or more programmable switching schedules, time, date, backlight configuration, daylight savings time, location (i.e. latitude, longitude), a location correction factor, units (i.e. U.S. standard, metric), a number of bedrooms in the installation, a floor size, a fan capacity, and/or any other suitable operating or other parameter, as desired. In some cases, the one or more switching schedules may be based, at least in part, on sunset and/or sunrise time parameters, as will be discussed in further detail below. In some instances, controller 12 may include a processor and an internal memory, if desired. The processor may be a microcontroller or a microprocessor, but this is not required.

In the illustrative embodiment, electric timer 10 may include at least one memory 16 connected to, or integral with, the controller 12 for storing information, such as, for example, the aforementioned one or more programmable switching schedules, time and date, backlight configuration, daylight savings time, location, a location correction factor, units (i.e. U.S. standard, metric), number of bedrooms, floor size, fan capacity, and/or other information, as desired. Memory 16 may also be configured to store any other controller settings or parameters, as desired. In the illustrative embodiment, controller 12 may store information within memory 16 and may subsequently retrieve the stored information. Memory 16 may include any suitable type of memory, such as, for example, random-access memory (RAM), read-only member (ROM), electrically erasable programmable read-only memory (EEPROM), flash memory, or any other suitable memory, as desired.

User interface 14 may be any suitable interface that is configured to display and/or solicit information as well as permit a user to enter data and/or other settings or parameters, as desired. In some cases, user interface 14 may allow a user or technician to program and/or modify one or more operational parameters or functions of electric timer 10, such as, for example, the programmable switching schedules, time, date, backlight configuration, daylight savings time, location, a location correction factor, units, number of bedrooms, floor size, fan capacity, and/or other information, as desired.

In some embodiments, the user interface 14 may include a display and one or more buttons. In some cases, the display may be a fixed segment display. However, it is contemplated that the display may be any suitable display including, for example, a touch screen display, a liquid crystal display (LCD) panel, a dot matrix display, or any other suitable display, as desired. In one illustrative embodiment, the one or more button may include a first button, a second button, and a third button. The user interface 14 may be configured such that a user can program the programmable schedule and the one or more controller 12 settings by interacting with the user interface 14. In some cases, this may be accomplished by only interacting with the first button and the second button. In other cases, the controller 12 may be programmed by interacting with the first button, the second button, and the third button, if desired. More or less buttons may be provided, if desired. Also, it is contemplated that the buttons may be separate and spaced from the display and/or touch regions defined as "buttons" on a touch screen display. In some cases, the buttons may be soft buttons, which may include a button situated adjacent the display with a label or other function indicator displayed on the display adjacent the button.

In some embodiments, the controller 12 may be connected to the user interface 14 to receive and/or display one or more operational parameters to and/or from a user. In some cases, the controller 12 may be configured to program the operational parameters, such as, for example, the one or more programmable schedules, time, date, backlight configuration, daylight savings time, location, a location correction factor, units, number of bedrooms, floor size, fan capacity, and/or other parameters or settings as desired, by accepting user inputs from the first button, the second button, and/or the third button.

In the illustrative embodiment, the power source 20 may be a power supply of a building or other structure. For example, the power source 20 may be a line voltage supply of a building. In some cases, the line voltage may be 120 volts 60 Hz AC power. In this case, the power supply 20 may include two or more wires, one wire being a line voltage or "hot" and a second wire being common or neutral. However, it is contemplated that in some cases, the power supply may include one wire being a line voltage or "hot" without a second wire, if desired. Alternatively, the power source 20 may supply another voltage, such as a 24 volts 60 Hz AC power, DC power, or any other suitable voltage and/or current. In the illustrative embodiment, the electric timer 10 may include an input port 21 connected to the power source 20 and an output port 19 connected to the load 18. In some cases, the input port 21 may include a first terminal and a second terminal. The first terminal may be connected to the line voltage and the second terminal may be connected to common. However, this is merely illustrative and it is contemplated that any suitable power source 20 and/or input and output terminals of the electric timer 10 may be used, as desired.

In some embodiments, electric timer 10 may be programmed to switch power on and off to the load 18. Example loads may include, but are not limited to, lighting devices, motors, electrical appliances, fans such as bathroom fans, and/or any other suitable load, as desired. Example lighting devices may include fluorescent lights, compact fluorescent lights (CFL), electronic ballasts, sodium lamps, tungsten lights, incandescent lights, halogen lights, as well as any other suitable lighting devices. Example motors may include pumps, actuators, actuatable valves and/or dampers, and fans. In one embodiment, and as noted above, fans may include bathroom fans, kitchen fans, or any other fan as desired. In some cases, it is beneficial if the fan provides some level of ventilation to a building by, for example, blowing air from inside of a building to outside of the building, or visa-versa.

More generally, it is contemplated that the load 18 may be any suitable electrical device where it may be desirable to switch power on and off.

In some embodiments, the electric timer 10 may include a power stealing block 22. Power stealing block 22 may be configured to "steal" power from the power source 20 and/or load 18 in order to power at least part of the electric timer 10. In some cases, the power stealing block 22 may be connected to the input port 21 and/or the output port 19. The power stealing block 22 may "steal" power from the input port 21 and/or the output port 19 during at least part of the time a voltage is applied to and/or between the input port 21 and/or the output port 19. In some cases, the power stealing block 22 may include a charge storing device, such as a capacitor or rechargeable battery, for storing at least some of the power stolen by the power stealing block 22. In some cases, if power is lost, the electric timer 10 may be configured to reduce power consumption. For example, the electric timer 10 may cause the display of the user interface 14 to be blank. In some cases, the electric timer 10 may shut off except for an internal clock, which may be implemented by controller 12 or elsewhere.

In some embodiments, the electric timer 10 may include an operating mode and a setup mode. When in the operating mode, the electric timer 10 may switch power to the load between the "on" state (or between the various "on" states) and the "off" state, sometimes in accordance with a programmable schedule, a random schedule, and/or a manual input from a user. In some cases, the manual input from the user may correspond to pressing one of the buttons of the user interface 14.

In some embodiments, the electric timer 10 may be configured to display one or more operating parameters on the display of the user interface 14. For example, the controller 12 may be configured to display a first operating parameter when a first button of the user interface 14 is pressed and a second operating parameter when a second button is pressed. In addition, and in some cases, the electric timer 10 may be configured to display the status of the load 18 when in the operating mode.

An illustrative setup mode may allow a user to modify one or more parameters of the electric timer 10. In some cases, the setup mode may be entered by depressing a first button. In some cases, setup mode may be entered by depressing a button for an extended period of time. In some cases, the extended period of time may be one second, two seconds, three seconds, four seconds, five seconds, ten seconds, or any other period of time, as desired. When in setup mode, depressing the first, second, and/or third buttons may toggle through a plurality of screens to adjust parameters of the electric timer 10.

Figure 2:
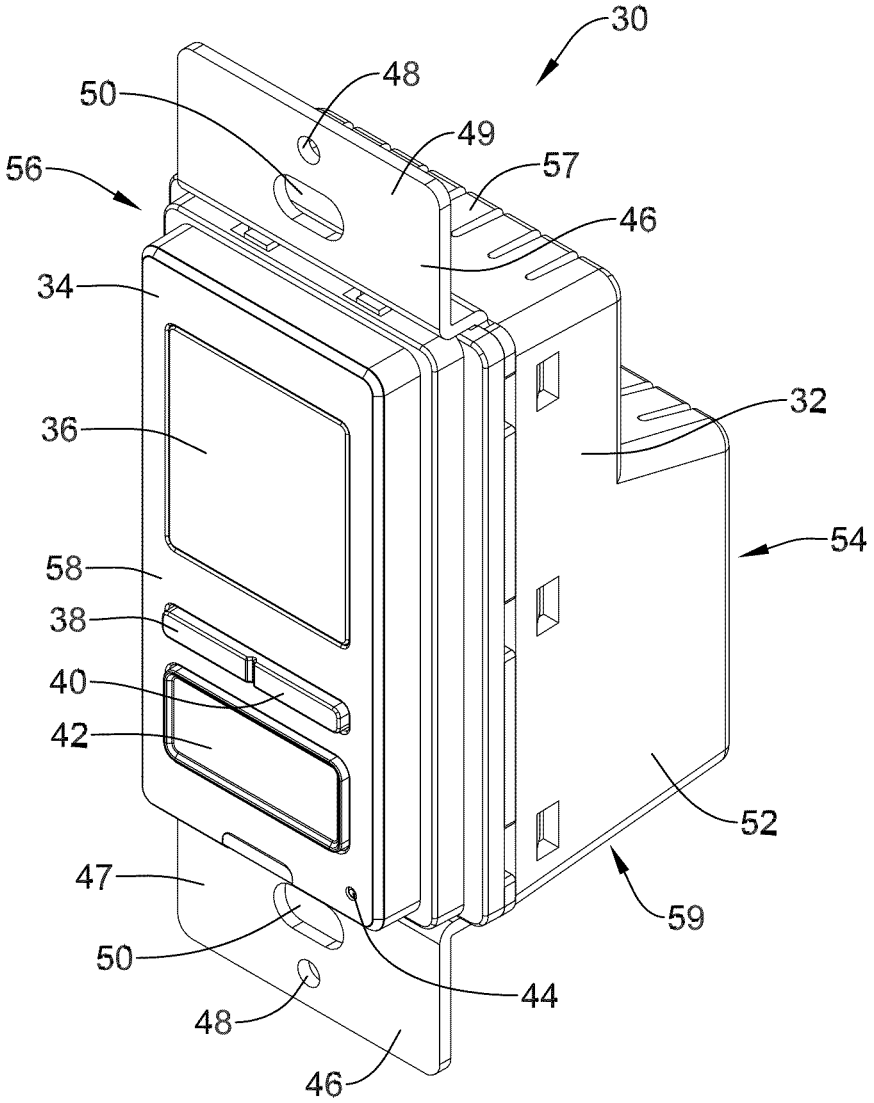
FIG. 2 is a perspective view of an illustrative electric timer.

FIG. 2 is a perspective view of an illustrative electric timer 30. In some instances, electric timer 30 may represent a manifestation of electric timer 10 of FIG. 1, but this is not required. In the illustrative embodiment of FIG. 2, the electric timer 30 may include a housing having a face plate 34 and a body 32. The illustrative housing may include a front side 58, a back side 54, and side walls 52, 56, 57, and 59 extending between the front side 58 and the back side 54. In the orientation shown, side wall 54 may be a right side wall, side wall 56 may be a left side wall, side wall 57 may be a top side wall, and side wall 59 may be a bottom side wall. It is contemplated that the housing may be formed from any suitable material, such as a polymeric, metallic, and/or any other suitable material, as desired.

In some cases, such as, for example, when utilized in a building or other structure, the electric timer 30 may be configured to be mounted at least partially within a wall of the building or structure. In some installations, the electric timer 30 may be mounted in a junction box (not shown), with the back side 54 situated within and/or towards the junction box and the front side 58 facing away from the junction box. However, it is contemplated that any suitable mounting configuration and/or orientation may be used, as desired.

The illustrative electric timer 30 may include a mounting plate 46. The mounting plate 46 may assist in mounting the electric timer 30 to a wall or junction box of a building or structure. As illustrated, mounting plate 46 may include a top flange portion 49 extending from the top side 57 of the housing and a bottom flange portion 47 extending from the bottom side 59 of the housing. Bottom flange portions 47 and top flange portion 49 may each include openings, such as opening 48 and opening 50. Opening 50 may be configured to receive a screw to help secure the mounting plate 46 to a wall or a junction box in a wall of a building or structure. Opening 48 may be configured to receive a screw to mount a cover (not shown), such as a decorative wall plates. Some suitable decorative wall plates are commercially available from Leviton Manufacturing Company, located in Little Neck, N.Y., and which are sold under the trademark Decora™. In some cases, the cover may have an opening that extends around and exposes the face plate 34, but covers the remaining portion of the electric timer 30 when mounted. In this case, opening 48 may be a threaded opening to assist in holding the screw therein.

The illustrative electric timer 30 includes a display 36, a first button 38, a second button 40, and a third button 42, and an indicator 44 defining a user interface of the electric timer 30. As shown, the user interface is situated on the front side 58 of the housing, with the display 36, button 38, button 40, and button 42 all disposed within a portion of the face plate 34 of the housing. In some cases, the display 36 of the user interface may be either inset or recessed within the face plate 34 of the housing as shown. The buttons 38, 40, and/or 42 may extend or protrude out from the face plate 34 as shown. It is contemplated, however, that the display and buttons 38, 40, and 42 may be flush with the face plate 34 or have any other suitable configuration, if desired.

The front side 58 of the housing may have a surface area. As illustrated, the display 36 of the user interface may occupy an amount or percent of the surface area of the front side 58 of the housing. In some cases, the display 36 may occupy at least 25 percent of the surface area of the front side 58 of the electric timer 30. In other cases, the display 36 may occupy at least 35% of the surface area of the front side 58, at least 45% of the surface area of the front side 58, at least 55% of the surface area of the front side 58, at least 65% of the surface area of the front side 58, at least 75% of the surface area of the front side 58 or more.

In the illustrative embodiment, display 36 may be fixed-segment display, as illustrated. However, it is contemplated that display 36 may be a touch screen display, a liquid crystal display (LCD) panel, a dot matrix display, a cathode ray tube (CRT), or any other suitable display, as desired. A dot matrix display is typically a LCD display that permits images such as letters, numbers, graphics, and the like to be displayed anywhere on the LCD, rather than being confined to predetermined fixed segments or locations, such as is the case with a fixed segment LCD.

The indicator 44 may indicate the status ("on" or "off") of the load. As illustrated, the indicator 44 may be a light, such as, for example, a light emitting diode (LED), Laser or any other suitable light source, provided in the bottom corner of the front side 58 of the face plate 34. In some cases, the indicator 44 may include a colored light, such as, for example, blue, red, green, yellow, or any other color, as desired. In some embodiments, when the load 18 is on, the light of indicator 44 may be on and, when the load 18 is off, the light of indicator 44 may be off. In some cases, the indicator 44 may be configured to flash according to the status of the load. For example, the indicator 44 may flash at an interval if the load 18 is on. In other examples, it is contemplated that the flashing of the indicator 44 may indicate the status of the load 18. If the indicator is flashing, the load may be on and if the indicator 44 is on but not flashing, the load may be off, or visa versa. These are only examples, and when present, it is contemplated that any suitable indicator 44 positioned at any suitable location may be used to indicate the status of the load 18, as desired.

In some embodiments, pressing button 38 may display an operating parameter of the electric timer 10 on display 36. Also, in some cases, pressing button 40 may display another operation parameter of the electric timer 10 on display 36. In one example, pressing one of button 38 or button 40 may display the sunset parameter and pressing the other of button 38 or button 40 may display the sunrise parameter. In other example, pressing one of button 38 or button 40 may display a menu for a countdown mode to temporarily override the programmable schedule and switch the load to the "on" state for a period of time referred to as a countdown time. When the menu for the countdown mode is displayed, pressing of button 38 and 40 may adjust the countdown time. In some cases, when the countdown mode is activated, pressing button 42 may exit the countdown mode. In some embodiments, when the electric timer 30 is operating in accordance with the programmable schedule, briefly pressing button 42 may override the programmable schedule and switch the load between the "on" state and "off" state. In some embodiments, the factory programming of the electric switch 10 may be restored by a user by pressing a combination of buttons. In one example, the electric switch 10 may be configured to reset the factory settings by pressing button 38 and button 42 for a period of time, such as, three seconds, four seconds, five seconds, ten seconds, or any other period of time, as desired.

The electric timer 30 may be configured to provide substantial display and/or programming functionality. FIGS. 3 through 7E provide examples of screens that may be displayed by an electric timer 30 of FIG. 2 during operation. FIGS. 8A through 13F provide other examples of screens that may be displayed by an electric timer 30 of FIG. 2 during operation. In some cases, the screens may include a home screen that can be displayed by electric timer 30 as a default screen, when no other data entry is underway, and/or when selected by the user. A home screen may, if desired, display one or more parameters relating to operational conditions such as mode of operation, time, day, program status, load status, and/or any other suitable parameter or setting, as desired.

In some cases, the user may be provided access to one or more sub-menus or other menus of the electric timer 30 by depressing one or more of buttons 38, 40, and 42. For example, if one or more of buttons 38, 40, and 42 is depressed for an extended period of time, the user may enter a setup menu to setup and/or modify one or more parameters and/or settings of the electric timer 30, such as the time, date, backlight, daylight savings time setting, location (i.e. latitude, longitude, and/or correction factor), programmable schedules, modes of operations, a number of bedrooms in the installation, a floor size, a fan capacity and/or any other suitable parameter or setting, as desired. In some cases, if one or more buttons 38, 40, and 42 is depressed for the extended period of time while in the setup or other sub-menu, the electric switch 30 may return to the home screen and exit the setup mode. In some cases, an additional set of menus for setting and/or programming one or more parameters of the electric timer 30 may be displayed when the electric timer 30 is powered up. In some cases, subsequent power-ups of the electric timer 30 may continue to display the additional set of menus until all the parameters in the additional set of menus is set. The electric timer 30 may also be programmed to display these additional set of menus by pressing a combination of buttons 38, 40, or 42 when the setup mode is entered.

Figure 3:
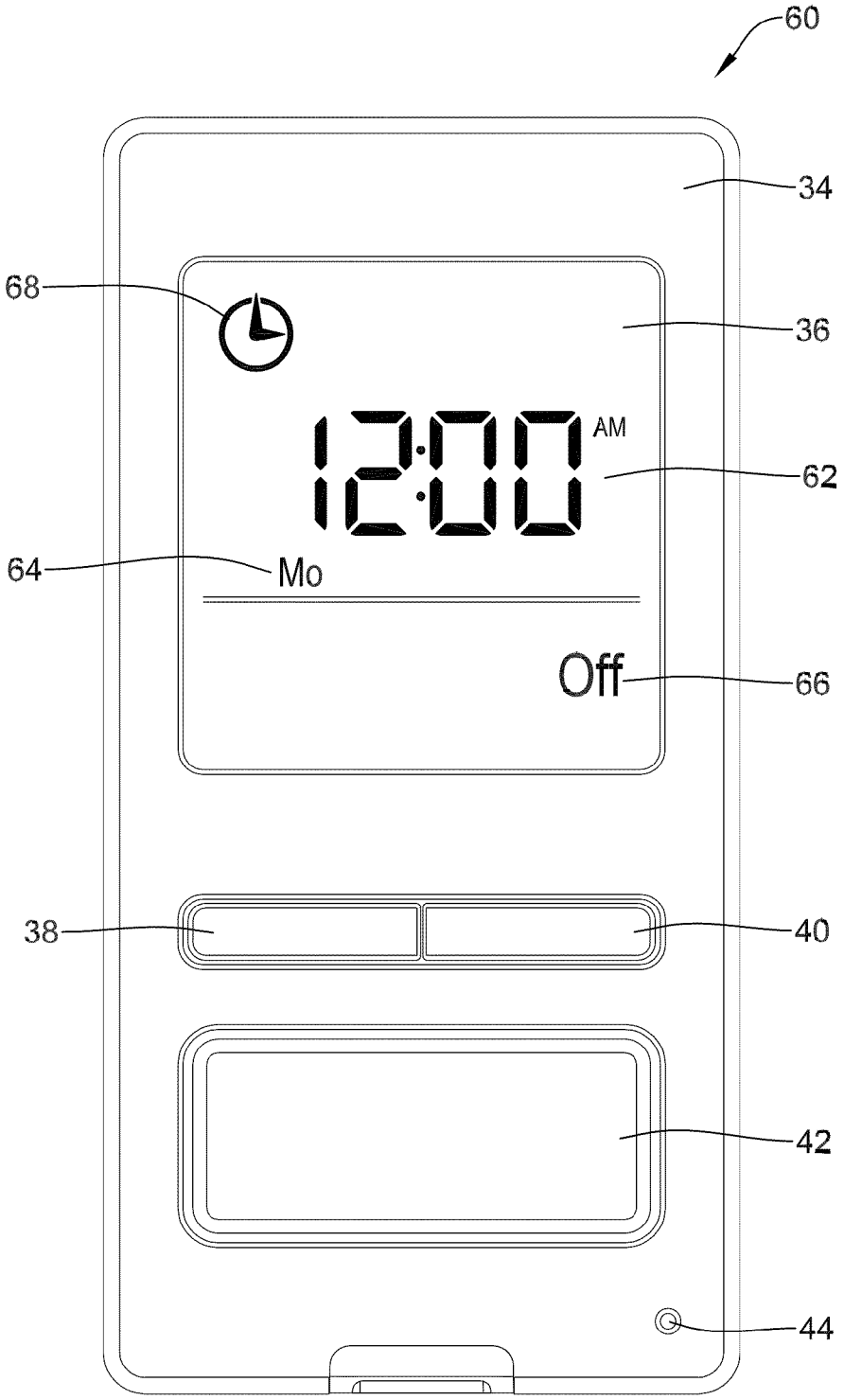
FIGS. 3-7E are pictorial views showing some illustrative screens that can be displayed on the display of the electric timer of FIG. 2.

FIG. 3 shows a pictorial view of an illustrative home screen 60 that may be displayed on display 36. In the illustrative embodiment, home screen 60 may be displayed when the electric timer 30 is in the operating mode. In some cases, home screen 60 may be configured to display information on the display 36 about the operational status of the electric timer 30 and/or load 18. For example, the information may include the current mode of operation of the electric timer 30, the current time 62, the current day of the week 64, the current program, the status of the load 18, and/or other operational information, as desired. In the illustrative embodiment, the home screen 60 displays icon 68 indicating that the mode of operation is automatic, the current time 62 is "12:00" A.M., the current day of the week 64 is Monday, and the status of the load is off, as indicated by "Off" icon 66.

In the illustrative embodiment, a user may press various buttons 38, 40, and 42 of the user interface to access and/or modify various operational settings of the electric timer 30. For example, briefly pressing button 38 may display the sunset time or sunrise time, and briefly pressing button 40 may display the other of the sunset time or sunrise time during normal operation of the electric timer 30. Pressing button 40 for an extended period of time may change the operational mode of the electric timer 30 to, for example, manual or random mode. Briefly pressing button 42 may temporarily override the current programmed schedule of the electric timer 30, and manually switch the load between on or off. Pressing button 42 for an extended period of time may access a setup mode of the electric timer 30. The setup mode may allow a user to modify and/or set one or more parameters or settings of the electric timer 30. For example, the extended period of time may be one seconds, two seconds, three seconds, four seconds, five seconds, ten seconds, or any amount of time as desired. Further, it is contemplated that the extended period of time for pressing button 40 and button 42 may be the same time or a different time, as desired.

FIGS. 4-7 show pictorial views of illustrative screens that may be displayed on display 36 when the electric timer 30 is in setup mode. The setup mode may allow a user to modify one or more parameters or settings of the electric timer 30. In some cases, a visual confirmation may be provided to the user when a setting is accepted by the electric timer 30. In some cases, the visual confirmation may be a blink or series of blinks of the corresponding icon on the display or other portion of the display, as desired.

Figure 4A:
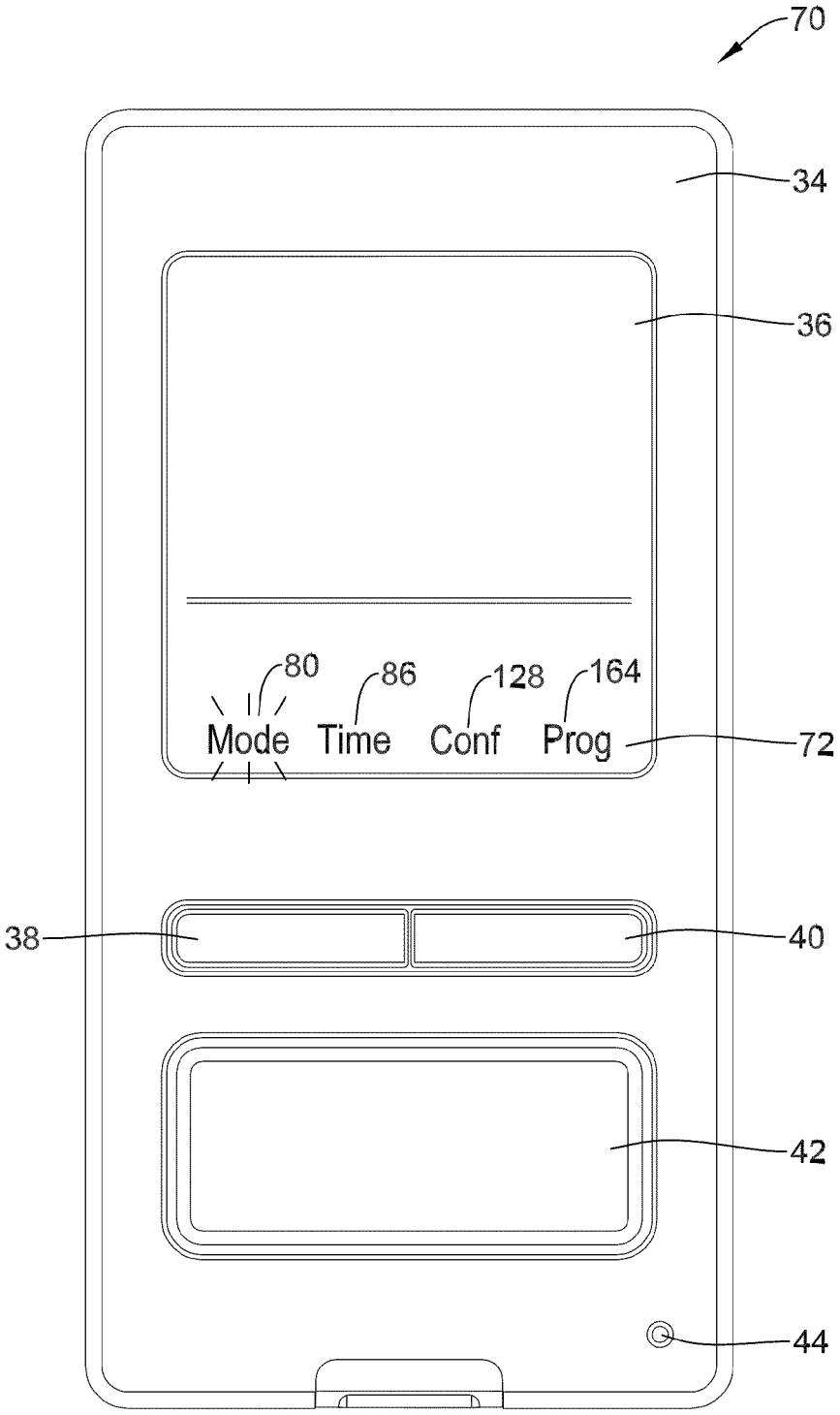

FIG. 4A shows a pictorial view of a screen 70 that may be displayed on the display 36 of the electric timer 30 after the setup mode is entered, but this is not required. In the illustrative embodiment, screen 70 may be a setup menu screen, and may allow a user to access one or more sub-menus. For example, the one or more sub-menus may include a mode menu, a time menu, a configuration menu, and a program menu. These are only illustrative, and it is contemplated that any suitable sub-menus may be displayed, when desired. As shown, screen 70 includes a list of icons 72 that may be selected to access a corresponding sub-menu. For example, the list of icons 72 may include a "Mode" icon 80 for accessing a mode menu, a "Time" icon 86 for accessing a time menu, a "Conf" icon 128 for accessing a configuration menu, and a "Prog" icon 164 for accessing a program menu.

A user may toggle or scroll through the list of icons 72 by pressing button 38 and/or button 40. In one example, button 40 may be configured to move to the next icon and button 38 may be configured to move to the previous icon. When a desired icon 80, 86, 138, or 164 is selected, the user may press button 42 to accept the selection and move to the corresponding sub-menu. The selected icon 80, 86, 128, or 164 may be indicated as being selected by highlighting, flashing, color, or some other indication, as desired. As illustrated, "Mode" icon 80 has been selected as indicated by the lines above and below the "Mode" 80 text, which in the Figure shown, indicates that the Mode text is flashing. Since the "Mode" icon 80 has been selected, pressing button 42 will accept this selection and display the mode menu screen 74 of FIG. 4B.

Figure 4B:
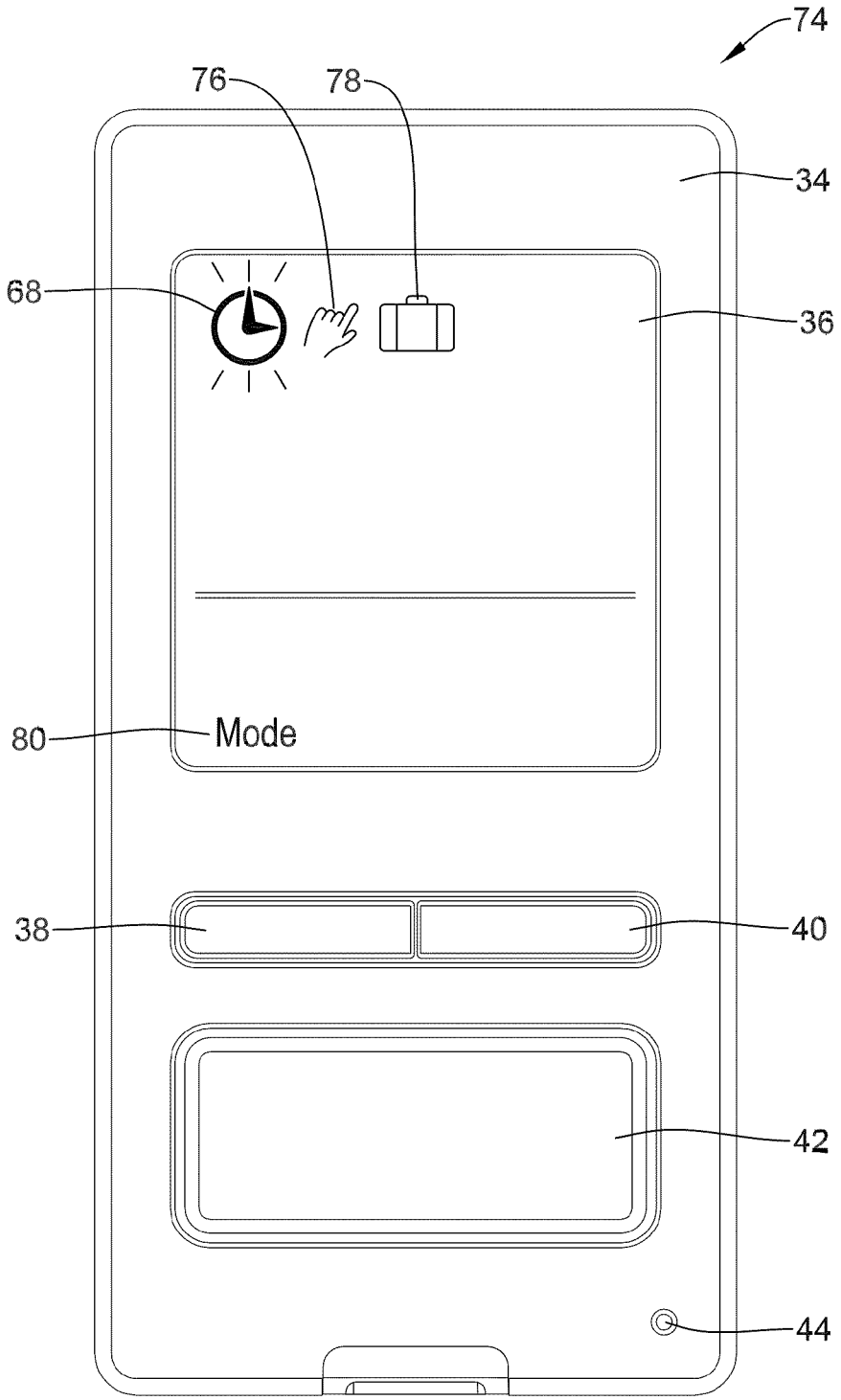

In FIG. 4B, the mode menu screen 74 may allow a user to select between an automatic mode, a manual mode, and a random mode. However, it is contemplated that other suitable modes of the electric timer 30 may also be provided, as desired. As illustrated, icon 68 corresponds to the automatic mode, icon 76 corresponds to manual mode, and icon 78 corresponds to random mode. The "Mode" icon 80 may be displayed on display 36 indicating that screen 74 is part of the mode menu screen 74.

Manual mode may operate the electric timer 30 as a manual switch. For example, the load may be turned on and off by manually pressing a button of the user interface, such as, for example, button 42. Automatic mode may operate the electric timer 30 in accordance with a programmable schedule. Random mode may operation the electric timer 30 in accordance with a randomly generated schedule. The randomly generated schedule may turn the load on and off at random, or non-specified, times. In some cases, the electric timer 30 may randomly generate turn "on" times and turn "off" times for the random schedule. In some embodiments, some constraints may be placed on the randomly generated "on" and "off" times, such as only generating turn "on" times and turn "off" times during the periods from sunset to midnight and from 5:00 AM until sunrise. The random mode may be used to give the impression that a building is occupied during a user absence.

In some embodiments, if during operation, the electric timer 30 is operating in automatic mode or in random mode, a temporary override may be allowed. The temporary override may be initiated by, for example, pressing button 42. The temporary override may allow the user to manually switch the electric timer 30 between the "on" state and the "off" state. For example, if the electric timer 30 is in the "on" state when the temporary override is initiated, the electric timer 30 may be switched to the "off" state. Similarly, if the electric timer 30 is in the "off" state when the temporary override is initiated, the electric timer 30 may switch to the "on" state. In either case, the status of the load displayed on display 36 may begin to flash to indicate the temporary override condition. In some cases, the temporary override may continue until the user presses button 42 again or until the next "on" state or "off" state of the current schedule.

In FIG. 4B, a desired operating mode may be selected by pressing button 38 and/or button 40 to scroll across icons 68, 76, and 78. An icon 68, 76, or 78 is indicated as selected by highlighting, flashing, or other indication, as desired. When the desired icon 68, 76, or 78 is selected, the user may press button 42 to accept the setting. After the setting is accepted, the electric timer 30 may return to display screen 70 of FIG. 4A.

Figure 5A:
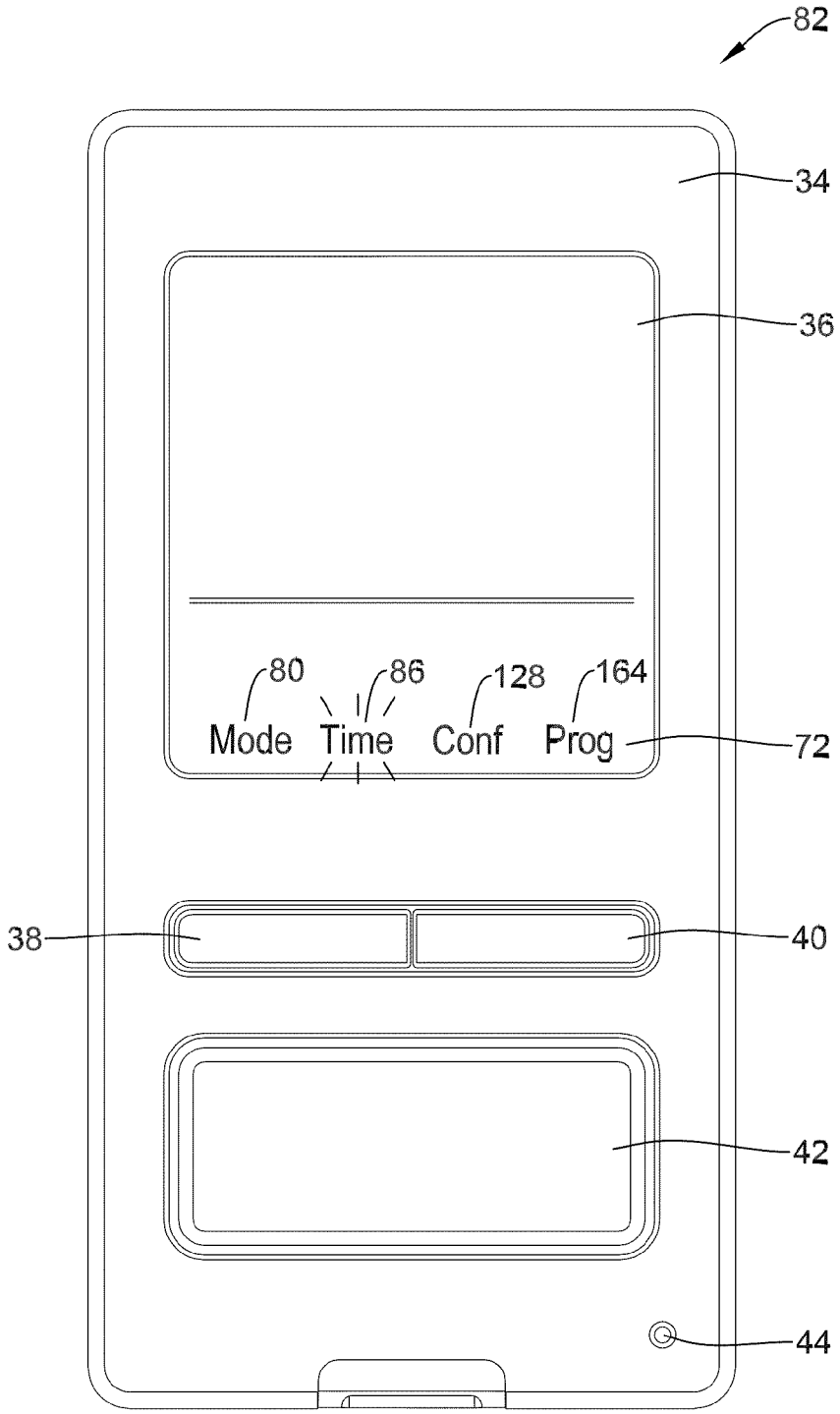

FIG. 5A shows a pictorial view of an illustrative screen 82 of the setup menu, similar to screen 70 of FIG. 4A, but with the "Time" icon 86 selected. As discussed previously, a desired icon 80, 86, 128, or 164 may be selected by pressing button 38 and/or button 40 to scroll across the list of icons 72. In the illustrative embodiment, a user may press button 42 to accept the setting and display the corresponding sub-menu of the icon. Icon 86 is selected in FIG. 5A, and when accepted by pressing button 42, a time menu may be displayed on display 36. An illustrative time menu may include each of the sub-menu screens 84, 90, 94, 98, 104, and 110 of FIGS. 5B-5G, respectively, "Time" icon 86 may be displayed on each of these sub-menus indicating that the electric timer 30 is currently executing the time menu option.

Figure 5B:
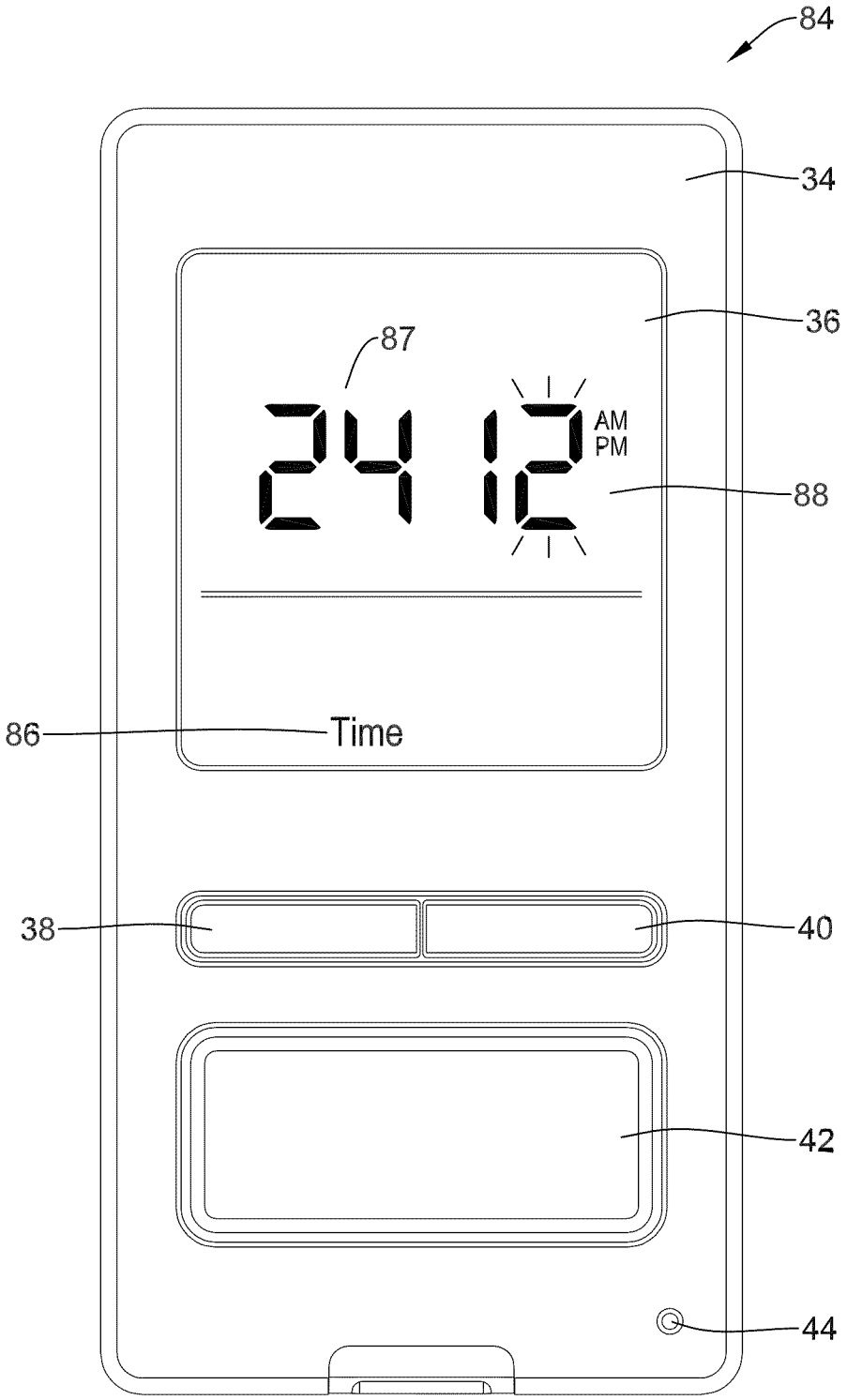
Figure 5C:
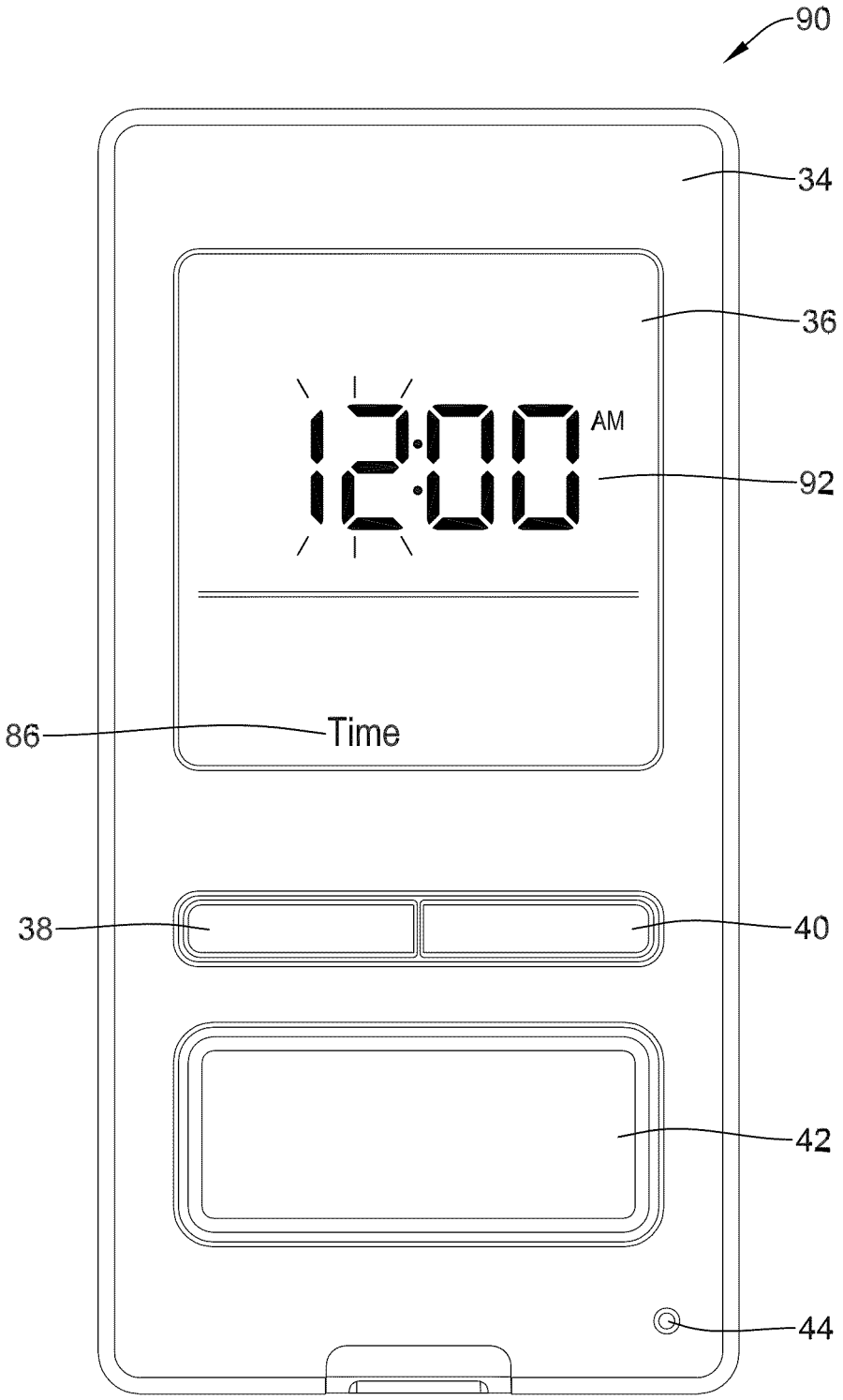
Figure 5D:
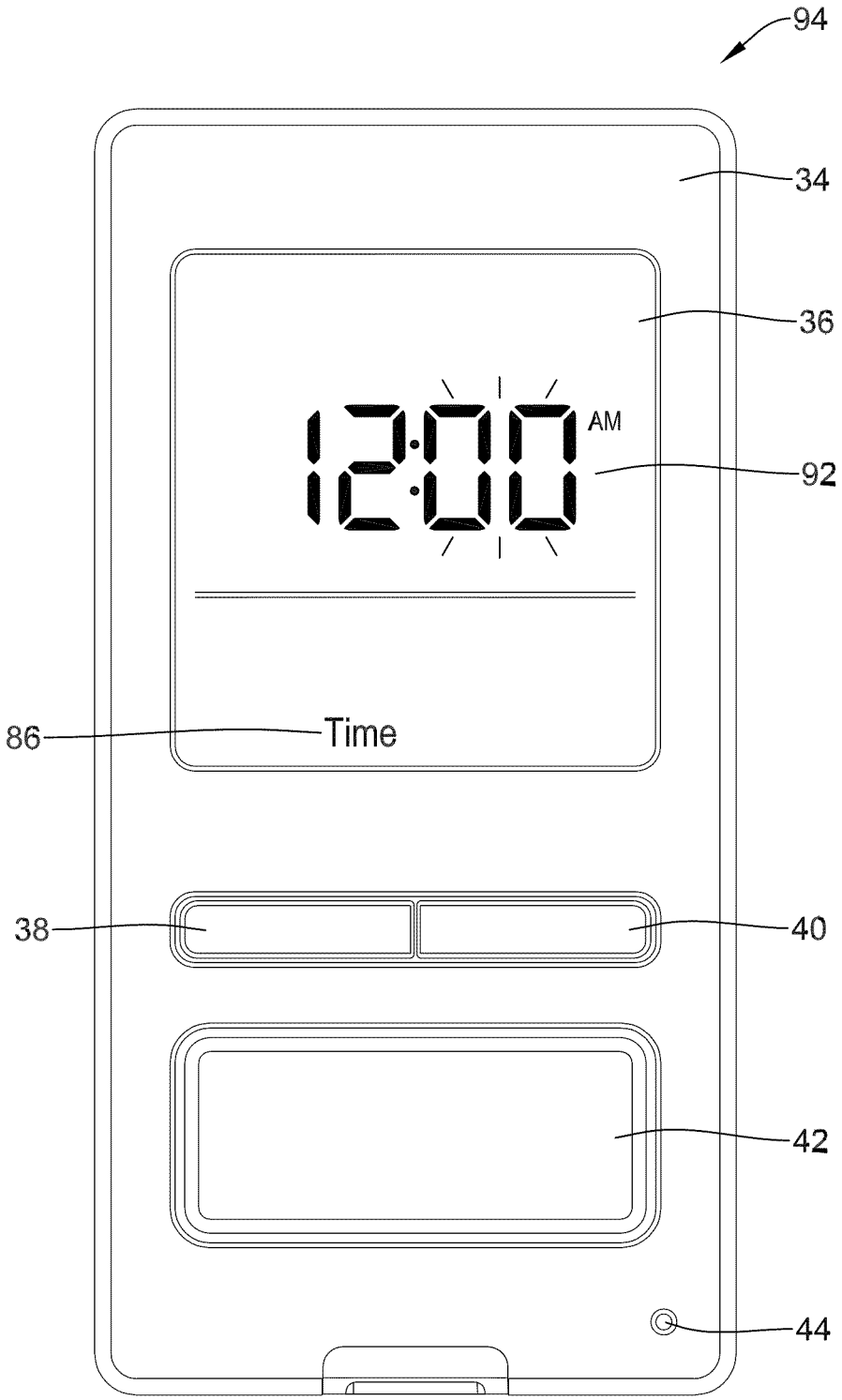

FIG. 5B-5D show pictorial views of illustrative screens 84, 90, and 94 for formatting and setting the time of the electric timer 30. More specifically, FIG. 5B shows a pictorial view of an illustrative screen 84 that may be displayed on display 36 for setting the format of the time display. Screen 84 may be configured to allow a user to set the format of the time to be displayed on display 36. As illustrated, screen 84 may display a "24" icon 87 and a "12" icon 88 on the display 36. The "24" icon 87 may correspond to a 24 hour time format, and the "12" icon 88 may correspond to a 12 hour time format. The user may be able to select the desire time format icon 87 or icon 88 by pressing button 38 and/or button 40. As illustrated, the "12" icon 88 corresponding to the 12 hour time format is indicated as selected by highlighting, blinking, or other indication, as desired. To accept the selected time format, a user may press button 42.

Once accepted, the electric timer 30 may display the illustrative screen 90 shown in FIG. 5C. As illustrated in FIG. 5C, a current time indicator 92 may be displayed on at least a portion of display 36. In the illustrative screen 90, the hour field of the time indicator 92 may be highlighted, blinking, or otherwise indicated. The user may adjust the hour field using button 38 (e.g. adjust forward in time) and/or button 40 (e.g. adjust backward in time). In some cases, the user may increase the hour field of time indicator 92 by pressing button 40, and the user may decrease the hour field of the time indicator 92 by pressing button 38. However, it is contemplated that the hour field may be set using any suitable button or combination of buttons, as desired. Once the desired hour field of the time indicator 92 is displayed, the user may press button 42 to accept the setting. Once accepted, the electric timer 30 may display the illustrative screen 94 shown in FIG. 5D.

In FIG. 5D, the minute field of the time indicator 92 may be highlighted, blinking, or otherwise indicated. The user may adjust the minute field using button 38 and/or button 40. In some cases, the user may increase the minute field of time indicator 92 by pressing button 40, and the user may decrease the minute field of the time indicator 92 by pressing button 38. However, it is contemplated that the minute field may be set using any suitable button or combination of buttons, as desired. Once the desired minute field of the time indicator 92 is displayed, the user may press button 42 to accept the setting. Once accepted, the electric timer 30 may display the illustrative screen 98 shown in FIG. 5E.

Figure 5E:
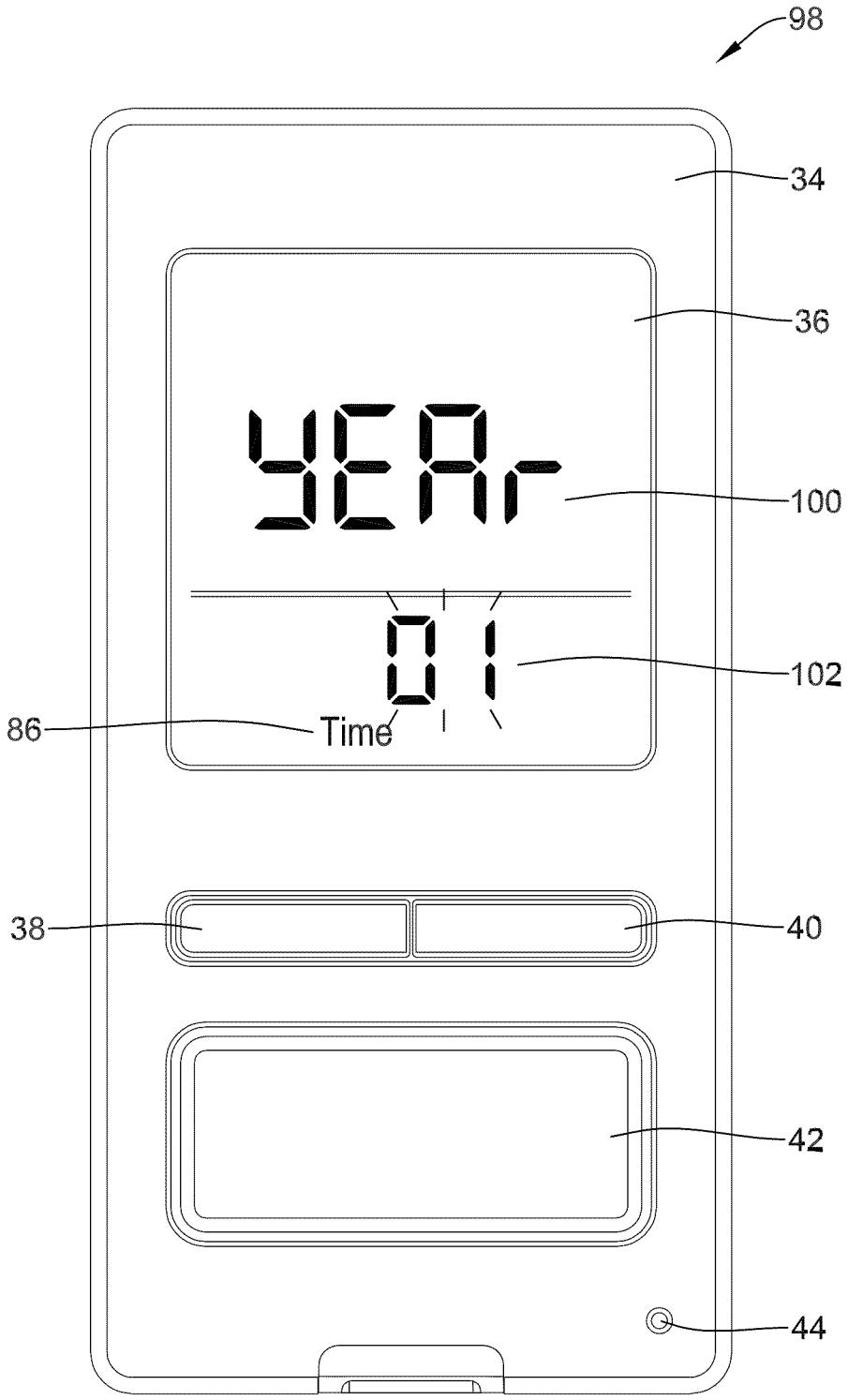
Figure 5F:
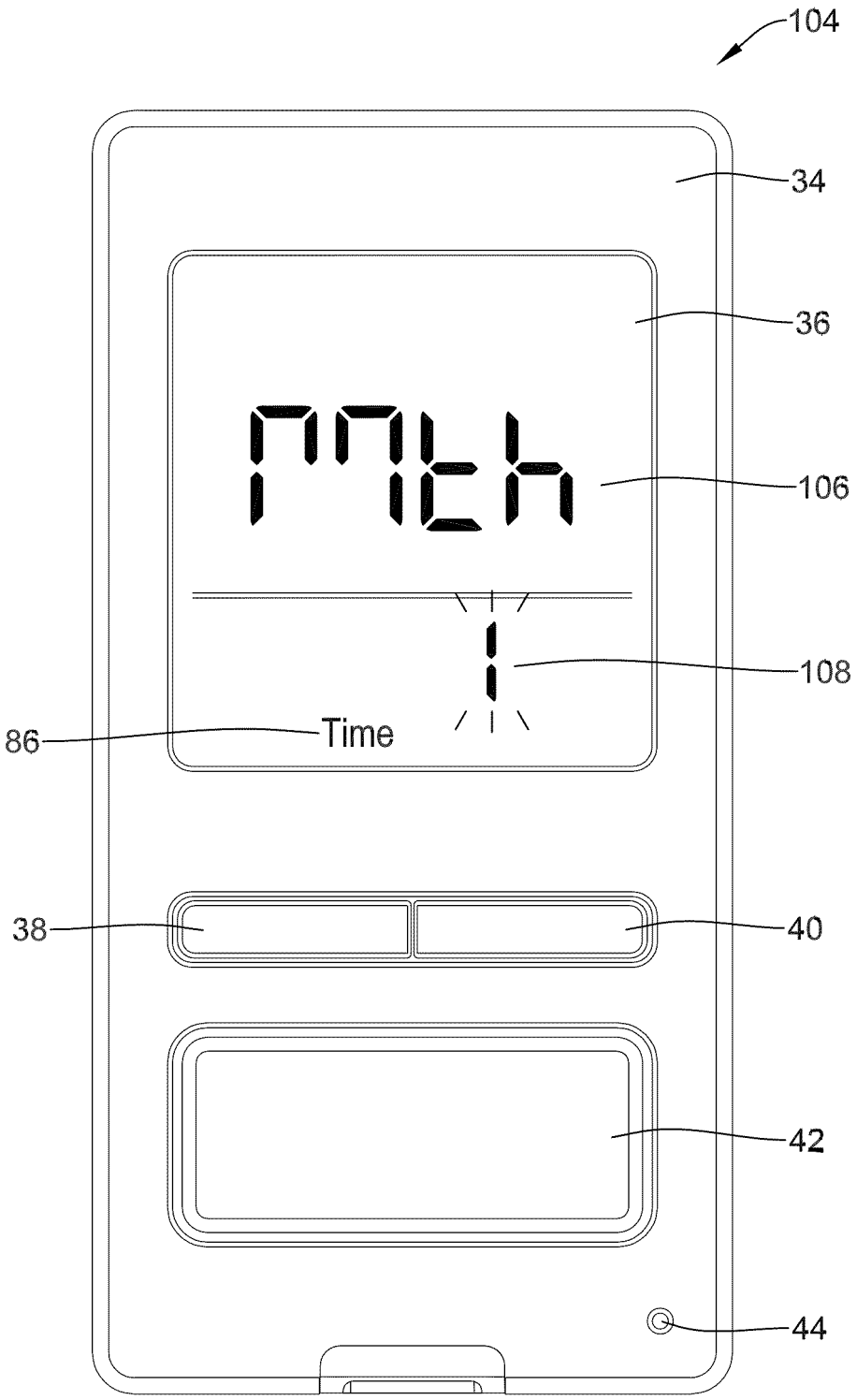
Figure 5G:
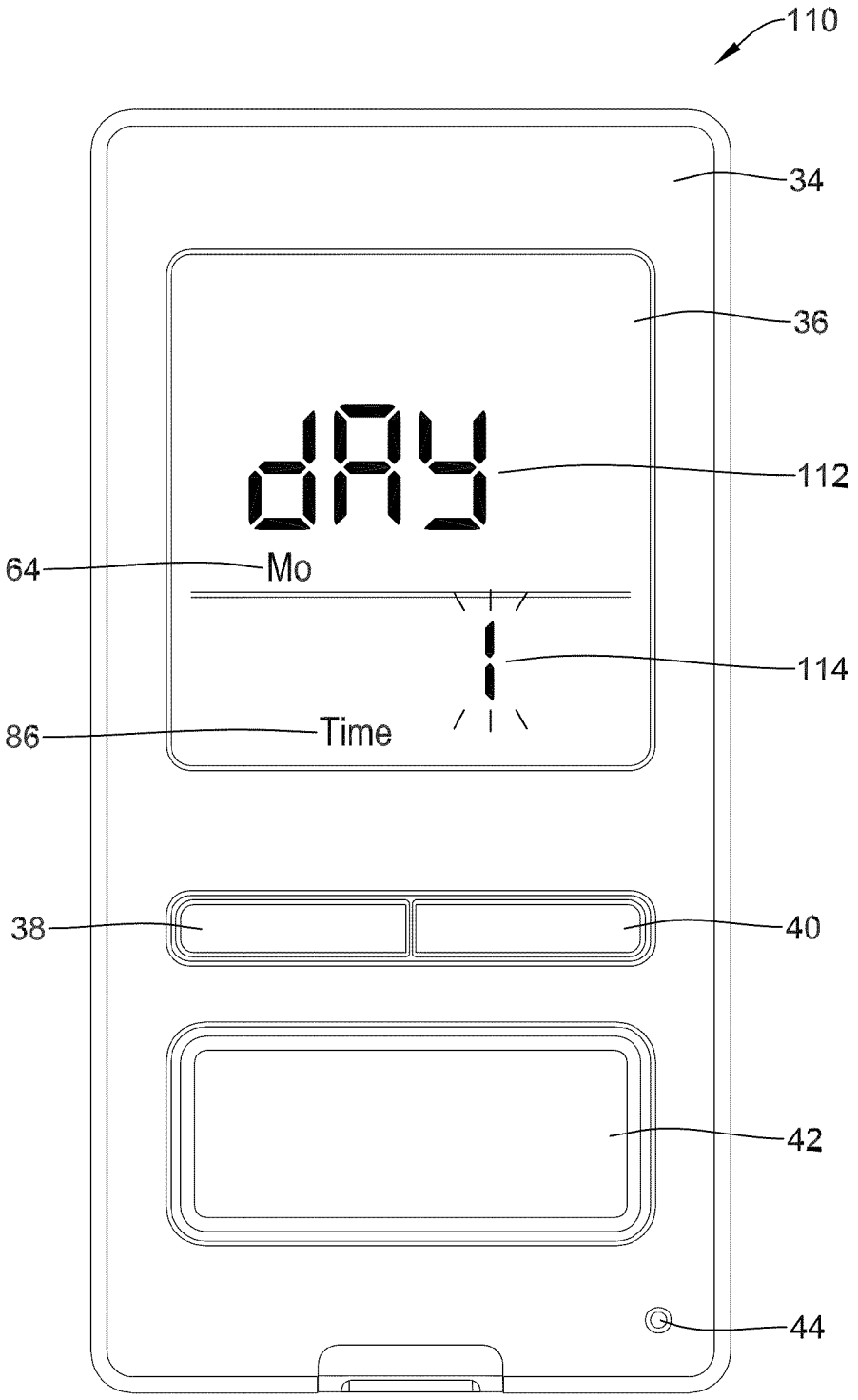

FIG. 5E-G show pictorial views of illustrative screens 98, 104, and 110 that may be used to set the current date of the electric timer 30. More specifically, FIG. 5E shows a pictorial view of an illustrative screen 98 for setting the current year. As illustrated, screen 98 may display "year" 100 on the display 36 to indicate that the current year is to be set. Screen 98 may also include an icon 102 for displaying the year. As illustrated, icon 102 displays "01" and may be highlighted, flash, or otherwise indicated. In the illustrative embodiment, the year may be displayed as a two digit year. For example, "01" of icon 102 may correspond to year 2001. However, it is contemplated that a three digit or four digit year icon may be provided as desired. To set the current year, the user may press button 38 and/or button 40 until icon 102 displays the two digit number corresponding to the current year. When the desired year is displayed in icon 102, the user may press button 42 to accept the year.

Once accepted, and in the illustrative embodiment, the electric timer 30 may display the illustrative screen 104 shown in FIG. 5F for setting the current month. As illustrated, screen 104 may display "Mth" 106 on the display 36 to indicate that the current month of the year is to be set. Screen 104 may also include an icon 108 for displaying the current month. In the illustrative embodiment, icon 108 may be set as any number from 1 to 12, each number corresponding to a month of the year. As illustrated, icon 108 displays "1" (e.g. January) and may be highlighted, flash, or otherwise indicated. To set the current month, the user may press button 38 and/or button 40 until icon 108 displays the number corresponding to the current month of the year. If the user presses button 38 and/or button 40 to increase the number of icon 108 corresponding to the month when "12" is displayed, then icon 108 may roll over and display "1" again. Similarly, if the user presses button 38 and/or button 40 to decrease the number of icon 108 corresponding to the month when "1" is displayed, then icon 108 may roll over and display "12". When the desired month is displayed in icon 108, the user may press button 42 to accept the setting.

Once accepted, and in the illustrative embodiment, the electric timer 30 may display the illustrative screen 110 shown in FIG. 5G for setting the current day of the month. As illustrated, screen 110 may display "day" 112 indicating that the current day of the month is to be set. Screen 110 may also include an icon 114 for displaying the current day of the month. In the illustrative embodiment, icon 114 may be set as any number from 1 to 31, depending on the month that was set in screen 104 of FIG. 5F. As illustrated, icon 114 displays "1" and may be highlighted, flash, or otherwise indicated. To set the current day, the user may press button 38 and/or button 40 until icon 114 displays the current day of the month. In some cases, if the user presses button 38 and/or button 40 to increase the day past the last day of the month, then icon 114 may roll over and display "1" for the first day of the month. Similarly, if the user presses button 38 and/or button 40 to decrease the day of the month when icon 114 shows the first day of the month, icon 114 may display the last day of the month. When the desired day is displayed in icon 114, the user may press button 42 to accept the setting.

In some embodiments, as illustrated on screen 110, the electric timer 30 may include icon 64 indicating a day of the week icon 64 corresponding to the selected date of the month. For illustrative purposes, icon 64 may appear as "Mo" indicating that the day of the week (e.g. Monday) corresponding to the day of the month shown by icon 114. In some cases, the controller of the electric timer 30 may determine the day of the week to be displayed according to the date input by the user. In some cases, the controller may include an algorithm, a look-up table, or other mechanism for determining the day of the week, as desired. In some cases, the day of the week icon 64 may be displayed before the date is set (i.e. before button 42 is pressed) and may change when the user changes the selected day of the month.

Figure 6A:
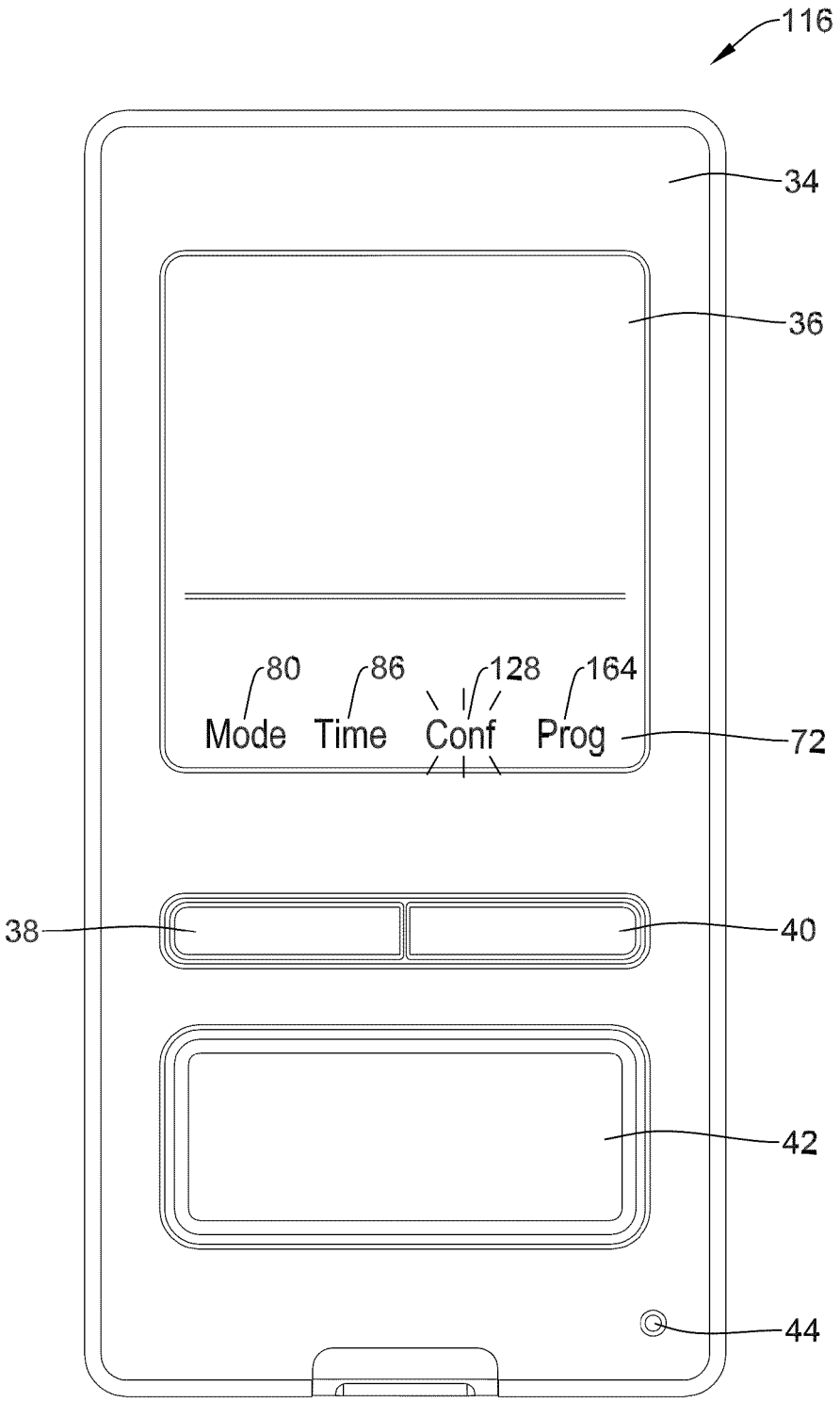

FIG. 6A shows a pictorial view of an illustrative screen 116 of the setup menu, similar to screen 70 of FIG. 4A and screen 82 of FIG. 5A. As illustrated, the "Conf" icon 128 corresponding to the configuration menu may be selected on screen 116. As discussed previously, a desired icon 80, 86, 128, or 164 may be selected by pressing button 38 and/or button 40 to scroll through the list of icons 72. A user may press button 42 to accept the setting and display the corresponding sub-menu. In the illustrative case, when icon 128 is selected and accepted, a configuration menu may be displayed on display 36. Illustrative configuration sub-menu screens 118, 130, 134, 140, and 146 are shown are shown in FIG. 6B-6F, and each includes the "Conf" icon 128 to show the user where in the menu structure the user is currently operating.

Example configuration options may include backlight options, automatic daylight savings time changeover, longitude coordinates, latitude coordinates, a correction factor for the longitude and latitude, as well as any other configuration options, as desired. In the illustrative embodiment, when the user presses button 42 from screen 116 of FIG. 6A, the display 36 may display screen 118 of FIG. 6B for adjusting the backlight. If button 42 is pressed again, then screen 130 of FIG. 6C may be displayed for adjusting the automatic daylight savings time changeover. If button 42 is pressed again, screen 134 shown in FIG. 6D may be displayed on display 36 for adjusting and/or setting the longitude. If button 42 is pressed again, screen 140, shown in FIG. 6E, may be displayed on display 36 for adjusting and/or setting the latitude. If button 42 is pressed again, screen 146, shown in FIG. 6F, may be displayed on display 36 for setting the correction factor. If button 42 is pressed again, screen 116 of FIG. 6A may be displayed again.

Figure 6B:
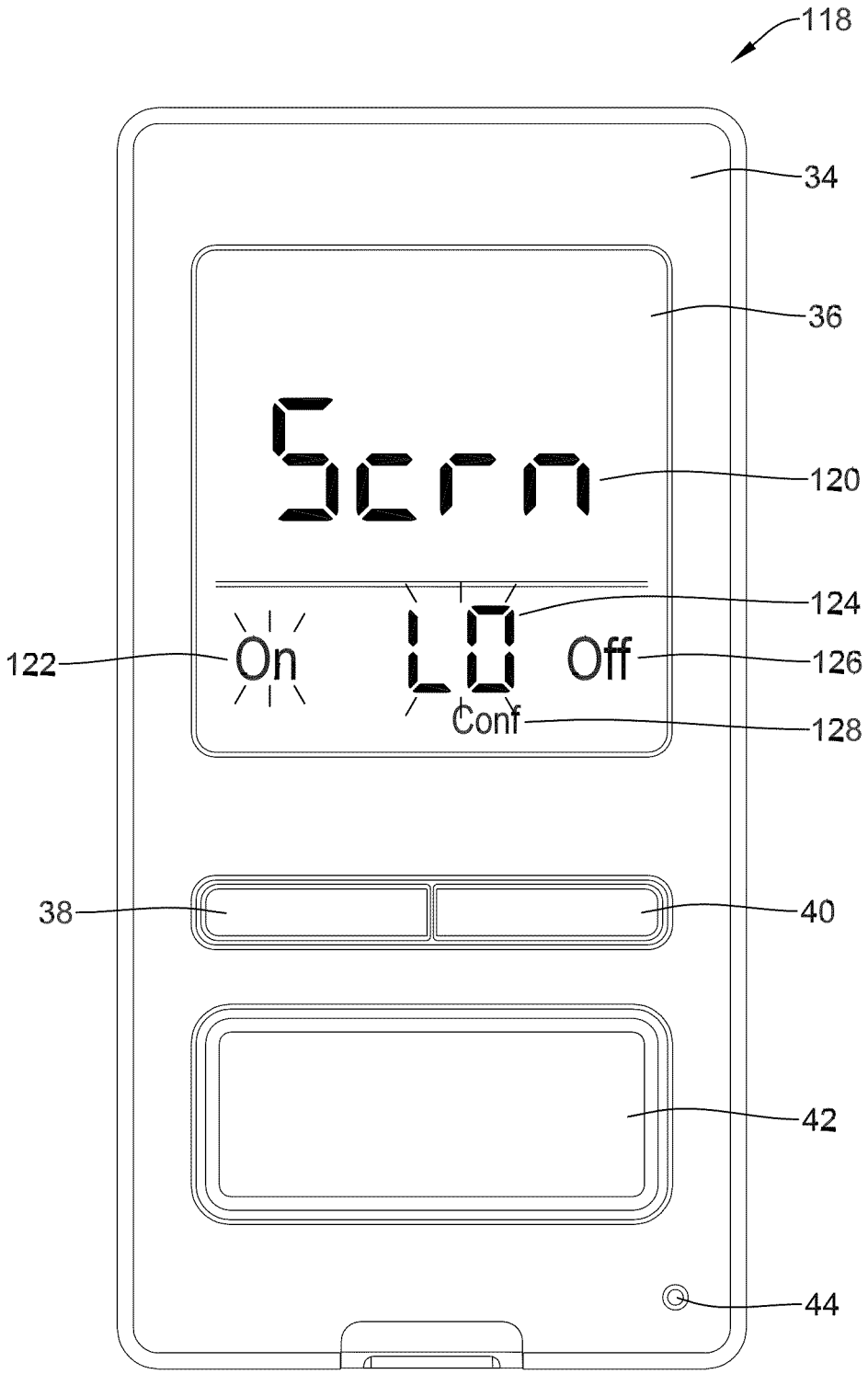

More specifically, FIG. 6B shows a pictorial view of an illustrative screen 118 for setting and/or adjusting the backlight operation of the display 36. In some embodiments, electric timer 30 may include a backlight to illuminate at least a portion of display 36. In some cases, the backlight may be configured to illuminate display 36 when the user presses one of buttons 38, 40, or 42. In one example, the backlight may be configured to illuminate the display 36 for a period of time, such as, for example, one second, two seconds, three seconds, four seconds, five seconds, eight seconds, ten seconds, or any other suitable period of time, as desired. In this case, the period of time may be restarted each time the user touches one of buttons 38, 40, and 42.

Additionally, the illustrative electric timer 30 may include one or more backlight operation settings, such as, for example, the brightness, the length of time to illuminate the display 36 after a touch, and/or any other suitable backlight setting, as desired. Example brightness settings may include a high intensity setting, a low intensity setting, and an off setting. Furthermore, it is contemplated that a number of other intensity settings may be used, as desired. In some cases, the backlight may be a white backlight, a blue backlight, an orange backlight, a gray backlight, a red backlight, a yellow backlight, or any other color backlight, as desired.

As illustrated, display 36 may include "Scrn" icon 120 indicating that the electric timer 30 is ready to have the backlight setting(s) set or adjusted. Screen 118 may include an "On" icon 122 indicating that the backlight is on, an "Off" icon 126 indicating that the backlight is off, and an intensity icon 124 indicating the intensity setting of the backlight. As illustrated, the intensity setting may be set to low, as indicated by the "LO" icon 124 displayed. If a high intensity is set, icon 124 may show "HI". In some cases, the current setting may be indicated by flashing, being highlighted, or otherwise indicated. As illustrated, the backlight setting is set to "on" with low intensity.

The user may adjust the backlight operation of the display 36 by pressing button 38 and/or button 40. In some cases, pressing buttons 38 and/or 40 may cycle through the number of backlight settings. For example, pressing button 40 may change the setting to on with high intensity, then, if pressed again, the setting may change to off, and so forth. Pressing button 38 may cycle through the settings in reverse order. However, it is contemplated that the settings may be cycled through in any order or by any button, as desired. To accept the setting, the user may simply press button 42.

Figure 6C:
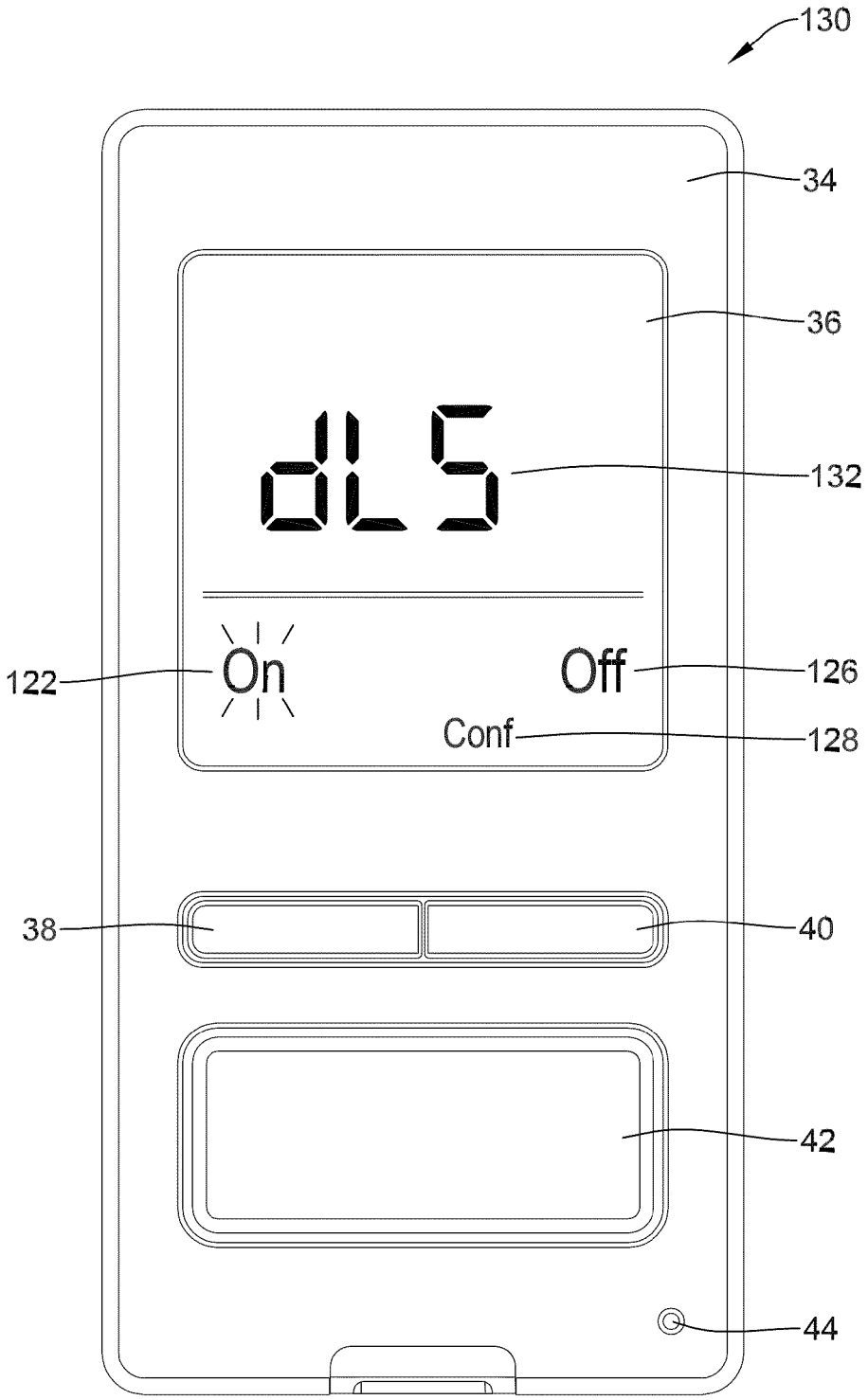

Once accepted, and in the illustrative embodiment, the electric timer 30 may display the illustrative screen 130 shown in FIG. 6C for setting and/or adjusting the automatic daylight savings time changeover (DLS) setting of the electric timer 30. In some embodiments, the DLS setting may automatically change the time of the electric timer 30 according to daylight savings time. For example, on the appropriate date in the spring, the DLS setting may cause the controller 12 to adjust the time (i.e. move one hour ahead) for daylight savings time for the summer and, on the appropriate date in the fall, the DLS setting may cause the controller 12 to adjust the time (i.e. move one hour back) for normal time for the winter. In one example, the DLS setting may cause the controller 12 to change the time to daylight savings time at 2:00 A.M. on the second Sunday in March, and change the time back to normal time at 2:00 A.M. on the first Sunday of November.

As illustrated, screen 130 may include a "dLS" icon 132 on display 36 indicating that the electric timer 30 is ready to program the DLS setting of the electric timer. Screen 130 may also include an "On" icon 122 and an "Off" icon 126 to indicate if the DLS setting is "on" (e.g. active) or "off" (e.g. inactive). As illustrated, the "On" icon 122 may be highlighted, flash, or otherwise indicated when selected. A user may toggle between the "On" icon 122 and the "Off" icon 126 by pressing button 38 and/or button 40. To accept the setting, the user may simply press button 42. In some cases, the "dLS" icon 132 may be replaced with a "dST" icon, if desired. Furthermore, it is contemplated that any of the icons disclosed herein may be replaced with other suitable icons, as desired.

Figure 6D:
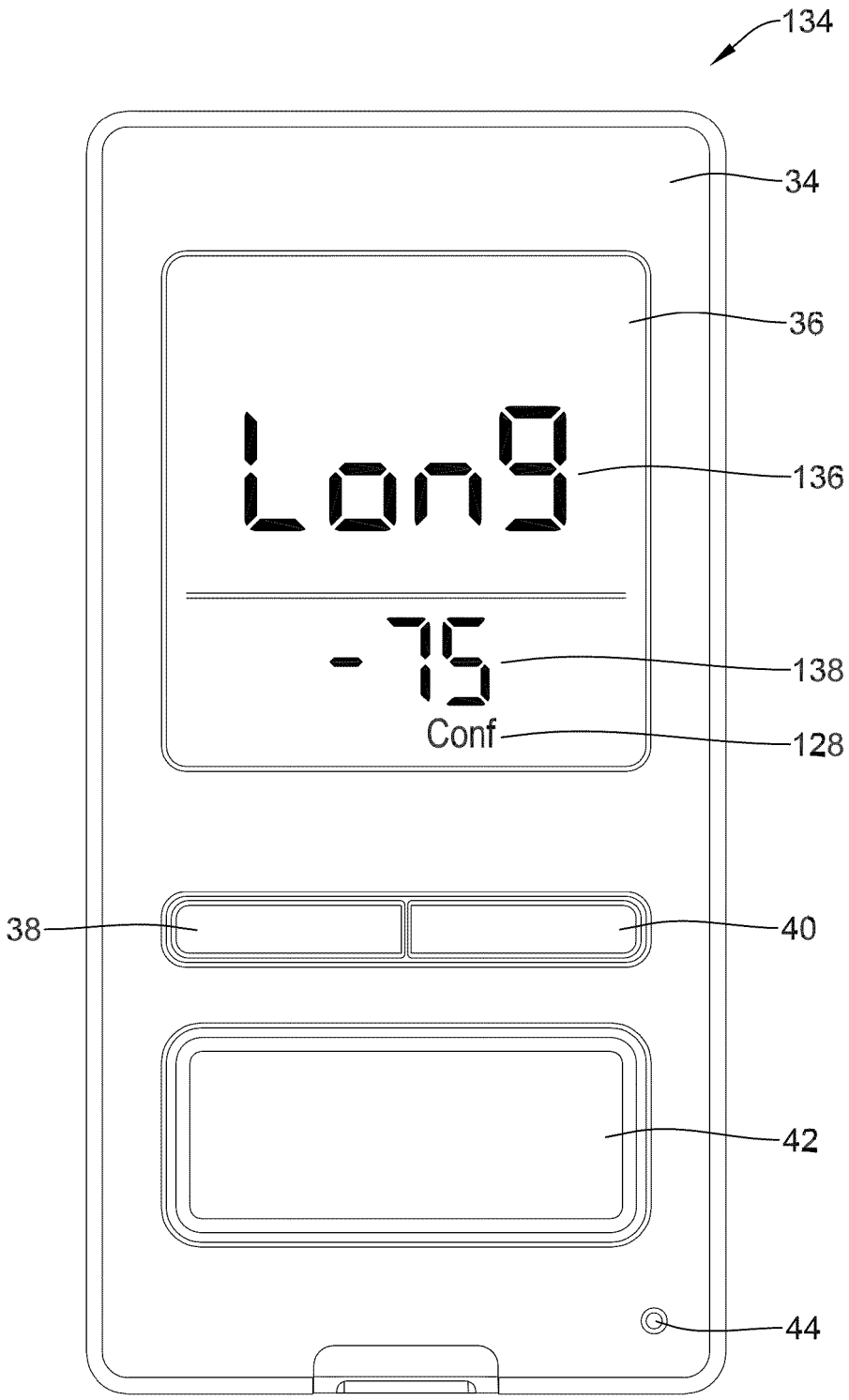
Figure 6E:
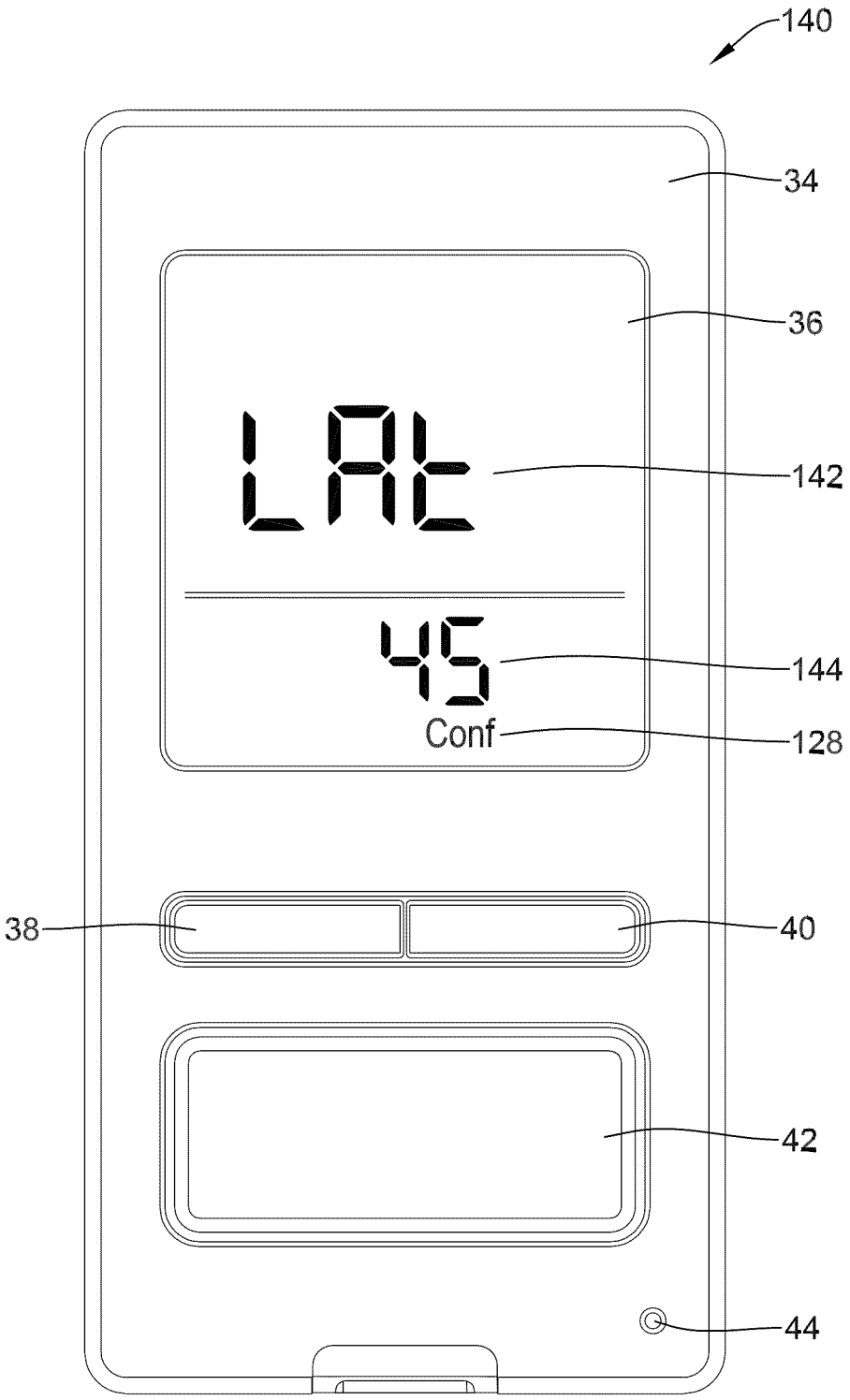

FIGS. 6D-6E show pictorial views of illustrative screens 134 and 140 for setting and/or adjusting the longitudinal and latitudinal coordinates of the electric timer 30. In some embodiments, the longitudinal and latitudinal coordinates may be used to switch the electric timer 30 between the "On" state and the "Off" state, and thus switch power on and off to the load, according to the geographic location of the electric timer. In some cases, the electric timer 30 may switch the load on and off according to the sunset and sunrise times on the current date and time and at the geographic location of the electric timer. For example, if the load is a light, the electric timer 30 may switch the light on at sunset and may switch the lights off at sunrise, where the sunset and sunrise times may be based on the current date, time and geographic location of the electric timer. The controller 12 of the electric timer 30 may be configured to determine the appropriate sunset and sunrise times for the geographic location specified by the longitude and latitude coordinates.

FIG. 6D shows a pictorial view of screen 134 for setting and/or adjusting the longitudinal coordinate of the electric timer 30. As illustrated, screen 134 may include a "Long" icon 136 indicating that the longitudinal coordinate is to be set by the user. Icon 138 may display the current setting of the longitudinal coordinate and may be adjusted by user. In some cases, a negative longitude may indicate that it is West longitude and a positive longitude may indicate that it is East longitude. As illustrated, the longitude is set at "−75" indicated that the longitude is 75 degrees West longitude. The user may adjust the longitudinal coordinate displayed in icon 138 by pressing button 38 and/or button 40 to increase and/or decrease the coordinate. When a desired longitudinal coordinate is displayed on display 36, the user may press button 42 to accept that longitudinal coordinate.

FIG. 6E shows a pictorial view of screen 140 for setting and/or adjusting the latitudinal coordinate of the electric timer 30. As illustrated, screen 140 may include a "LAt" icon 142 indicating that the latitudinal coordinate is to be set by the user. Icon 144 may display the current setting of the latitudinal coordinate and may be adjusted by the user. In some cases, a negative latitude may indicate that it is South latitude and a positive longitude may indicate that it is North latitude. As illustrated, the latitude is set at "45" indicated that the latitude is 45 degrees North latitude. The user may adjust the latitudinal coordinate displayed in icon 138 by pressing button 38 and/or button 40 to increase and/or decrease the coordinate. When a desired latitudinal coordinate is displayed on display 36, the user may press button 42 to accept that latitudinal coordinate.

Figure 6F:
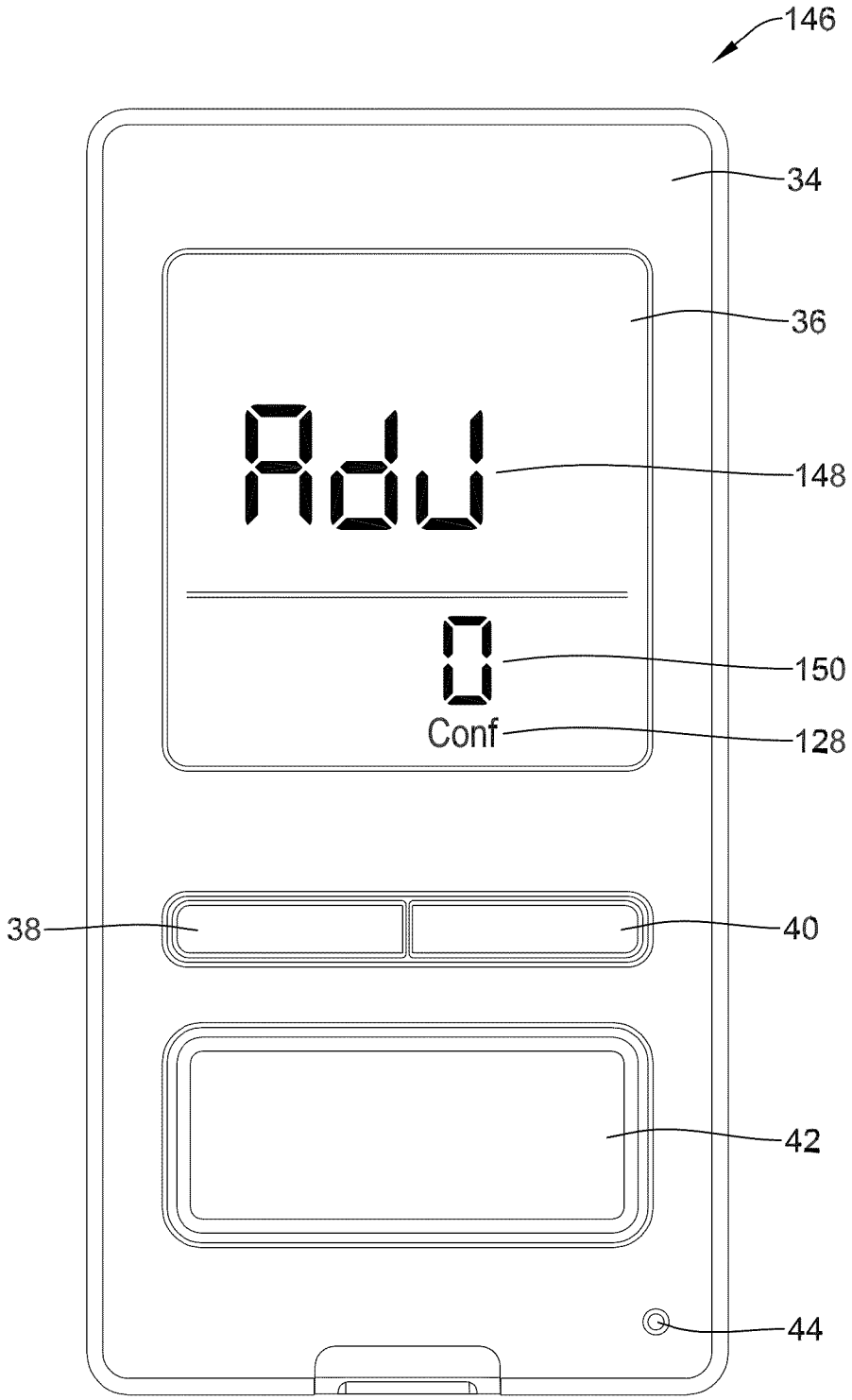

FIG. 6F shows a pictorial view of an illustrative screen 146 for setting and/or adjusting a correction factor. In some embodiments, the electric timer 30 may include the correction factor to help achieve a more accurate and/or an offset for the sunset and/or sunrise times. For example, if the user would like the load to be turned on 0.5 hours before sunset, a suitable correction factor may be provided. As illustrated, screen 146 may include an "Adj" icon 148 displayed on display 36 indicating that the correction factor may be set and/or adjusted by a user. Screen 146 may include a correction factor setting icon 150 showing the current setting of the correction factor. As indicated, the setting is set to "0". In some cases, the correction factor may be set as zero, minus one hour, plus one hour, or any other suitable value, as desired. In the illustrative embodiment, the user may adjust the correction factor by pressing button 38 and/or button 40. When a desired correction factor is displayed in icon 150, the user may press button 42 to accept the setting.

Figure 7A:
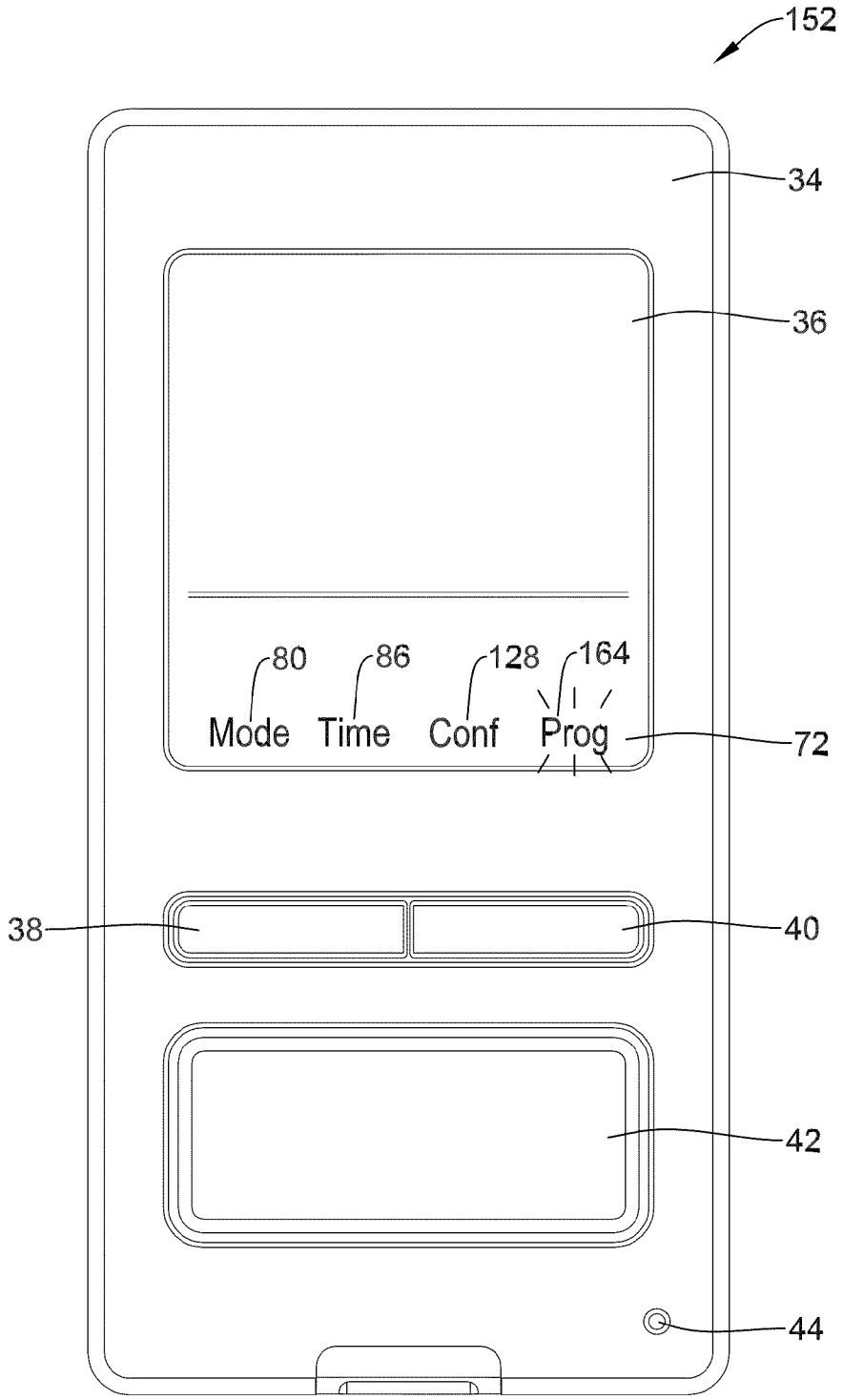

FIG. 7A shows a pictorial view of an illustrative screen 152 of the setup menu, similar to screen 70 of FIG. 4A, screen 82 of FIG. 5A, and screen 116 of FIG. 6A. As illustrated, the "Prog" icon 164 corresponding to the program menu may be selected on screen 152. As discussed previously, a desired icon 80, 86, 128, or 164 may be selected by pressing button 38 and/or button 40 to scroll through the list of icons 72. A user may press button 42 to accept the setting and display the corresponding sub-menu. In the illustrative embodiment, when icon 164 is selected and accepted, a program menu may be displayed on display 36. Example program sub-menus may include screens 154, 166, 168, and 170 of FIGS. 7B-7E, respectively. In each of the sub-menu screens 154, 166, 168, and 170, "Prog" icon 164 may be displayed indicating that the electric timer 30 is in the "Prog" menu.

In the illustrative embodiment of FIG. 7A, the "Prog" icon 164 is selected. When the user presses button 42 from screen 152, the display 36 may display screen 154 of FIG. 7B for selecting a program number. If button 42 is pressed again, then screen 166 of FIG. 7C may be displayed for selecting the program days. If button 42 is pressed again, and no days are selected, screen 154 may be displayed again. If days are selected, then screen 168 shown in FIG. 7D may be displayed on display 36 for setting the program start time. If button 42 is pressed again, screen 170, shown in FIG. 7E, may be displayed on display 36 for further setting of the program start time. If button 42 is pressed again, screen 152, shown in FIG. 7A, or screen 154, shown in FIG. 7B, may be displayed again.

In some embodiments, the program menu may allow a user to program a number of schedules that may be used to switch the electric timer 30 between the "on" state and the "off" state. In some cases, the program menu may allow a user to select a program number, set the days of the program, and set the start time and/or stop time of the program, as well as any other program settings, as desired. In some cases, the program may be configured to switch the "on" state and/or the "off" state of the electric switch 30 according to solar time (i.e. sunset, sunrise, etc.).

Figure 7B:
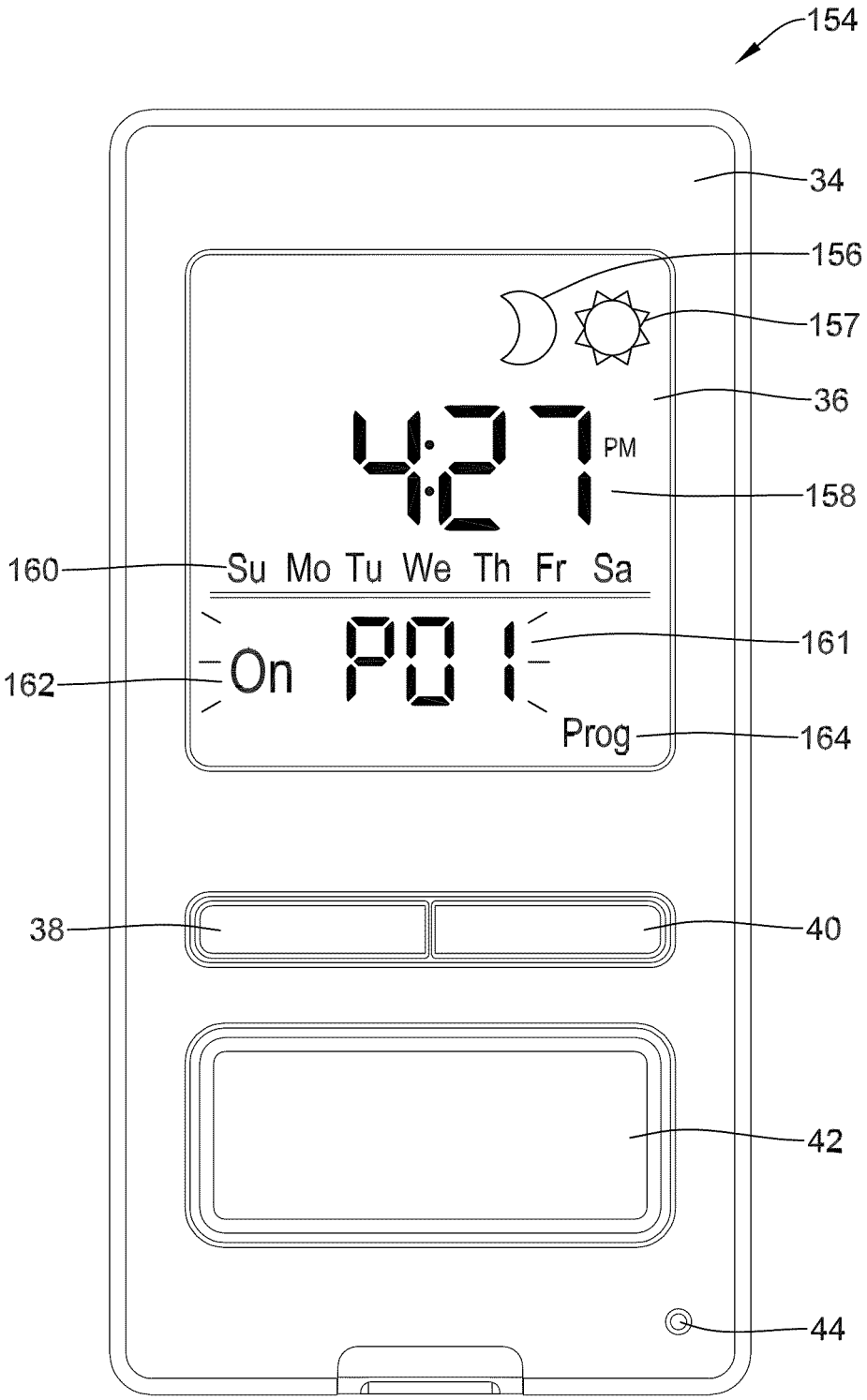

As indicated above, FIG. 7B shows a pictorial view of an illustrative screen 154 for selecting a program number. In some cases, the program may include a plurality of programs. For example, the program may include a number of "on" programs and a number of "off" programs. The "on" programs may set when the electric timer 30 turns the load on, and the "off" programs may set when the electric timer 30 turns the load off. In some cases, there may be one, two, three, four, five, six, seven, ten, or any number of "on" programs and "off" programs, as desired.

As illustrated, screen 154 may include the time 158. Screen 154 may also include a number of icons 160 corresponding to the days of the week. Screen 154 may also include a program icon 161 indicating the program to be set. As illustrated, the program icon shows "P01", which may correspond to program 1. In addition, "on" icon 162 may be provided to show that the program is for turning the load "on". Although not expressly shown, if a program is for turning a load "off", an "Off" icon, similar to "on" icon 162, may be displayed. In some cases, icon 156 may be displayed to indicate that the displayed program is to be activated at sunset, rather than a specific set time. In some cases, an icon similar to icon 157 may be displayed to indicate that the program is to be activated at sunrise.

In operation, a user may press button 38 and/or button 40 to toggle through the list of available programs. When a desired program is displayed at icon 161, the user may press button 42 to select the program. In some embodiments, the one or more programs may be password protected. In this case, the electric switch 30 may include an additional screen (not shown) for prompting a user to enter a password. Once the password is entered, the user may be able to modify the one or more programs.

Figure 7C:
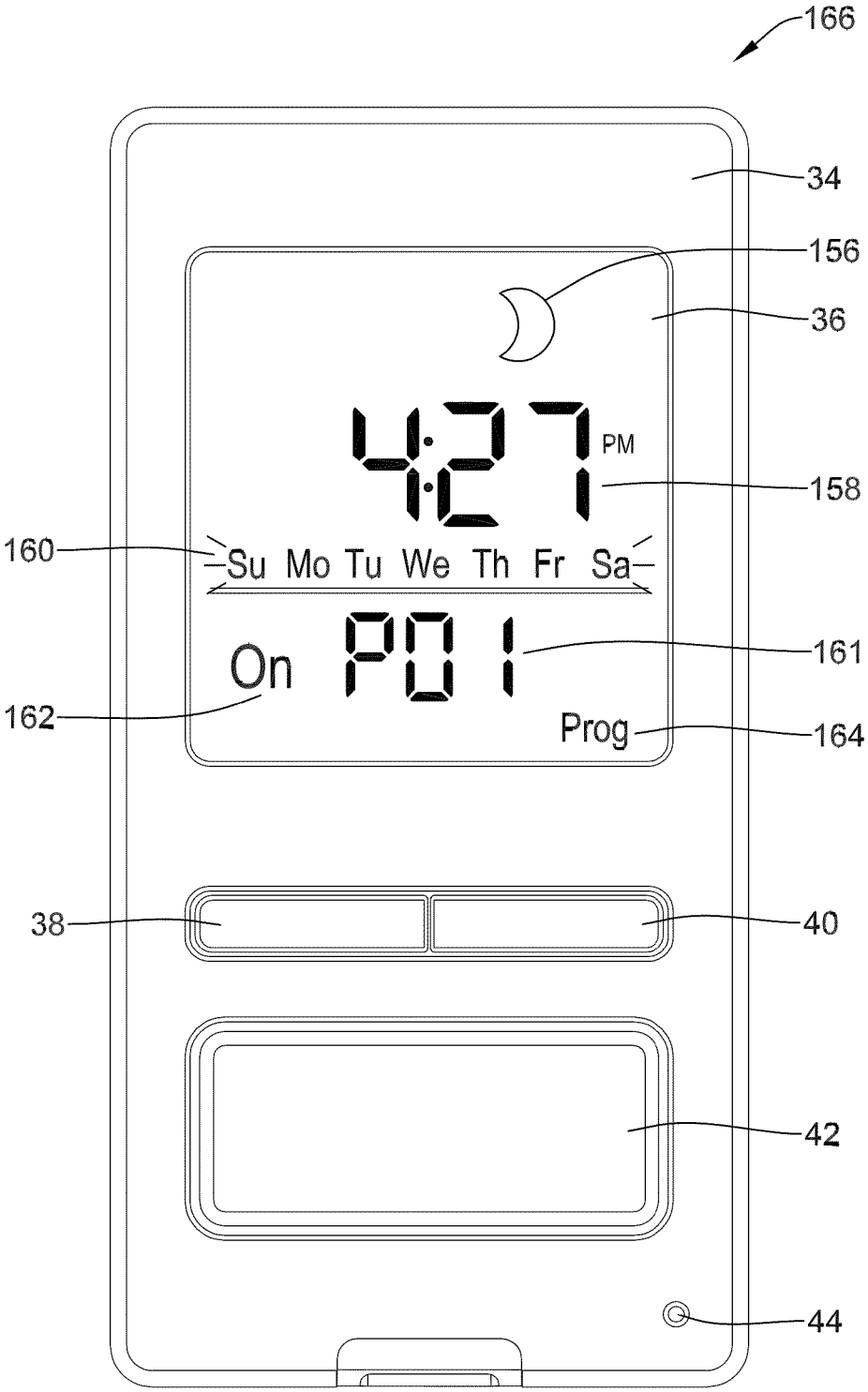

FIG. 7C shows a pictorial view of an illustrative screen 166 for selecting days for the selected program. As illustrated, screen 166 may display a list of icons 160 corresponding to the days of the week. In some cases, the list of icons 160 may be highlighted, flash, or otherwise indicated. In some cases, a user may select desired days using button 38 and/or button 40 that are to be used for the selected program. For example, a user may select all the days of the week, all weekdays, the weekend (i.e. Saturday and Sunday), individual days (i.e. Sunday, Monday, Tuesday, Wednesday, Thursday, Friday, or Saturday), or any combination of individual days of the week, as desired. In some cases, the combination of individual days of the week may include consecutive days or non-consecutive days, as desired.

In some embodiments, a user may scroll through a list for selecting the days. In some cases, the list may include a first entry for all the days of the week, a second entry for all of the weekdays, a third entry for the weekend days, a fourth entry for Sunday, a fifth entry for Monday, a sixth entry for Tuesday, a seventh entry Wednesday, an eighth entry for Thursday, a ninth entry for Friday, and a tenth entry for Saturday. When so provided, the user may scroll through the list using button 38 and/or button 40 to select the desired day(s).

In other embodiments, a user may be able to move through the list of days 160 and individually select days. For example, one of button 38 or button 40 may move through the list and the other one of button 38 or button 40 may select the day. In either case, when the desired day(s) are selected, a user may press button 42 to accept the setting.

Figure 7D:
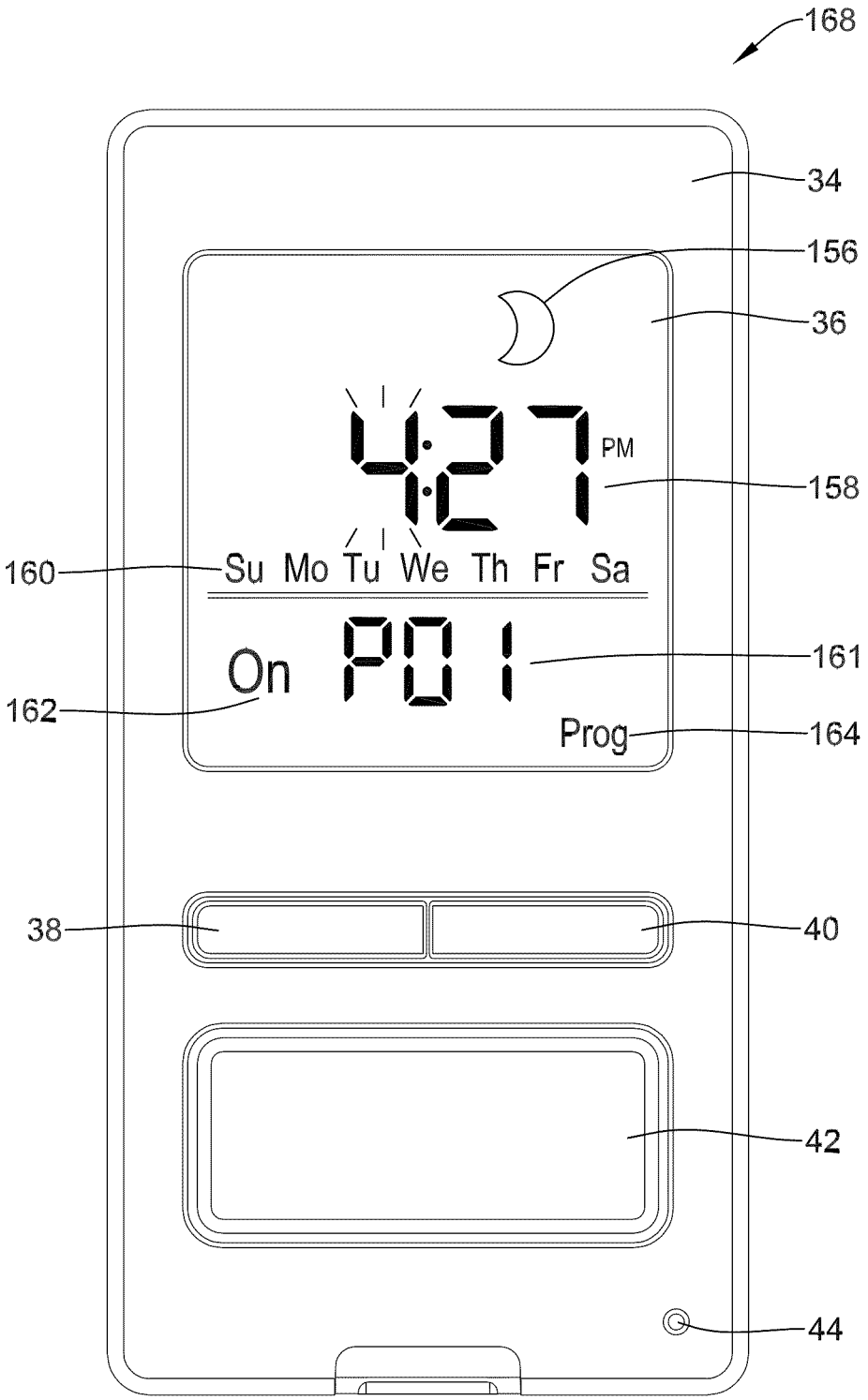

FIG. 7D shows a pictorial view of an illustrative screen 168 for setting the program start time. The program start time may determine when the controller 12 turns the load "on" when the program includes an "on" icon 162, or when the controller 12 turns the load "off" when the program includes an "off" icon 162. As illustrated in FIG. 7D, the hour field of the time display 158 may be highlighted, blink, or otherwise indicated. A user may press button 38 and/or button 40 to increase and/or decrease the hour field of the time display 158 until the desired hour is displayed. In some cases, A.M. and P.M. may be associated with the hour field of the time display 158.

In some embodiments, the electric timer 30 may be programmed to turn on according to sunset and/or sunrise time. In this case, a user may scroll through the hour field until a "sunrise" and/or "sunset" parameter is displayed (not explicitly show). When the desired setting is displayed in the hour field of time display 158, the user may press button 42 to accept the settings.

Figure 7E:
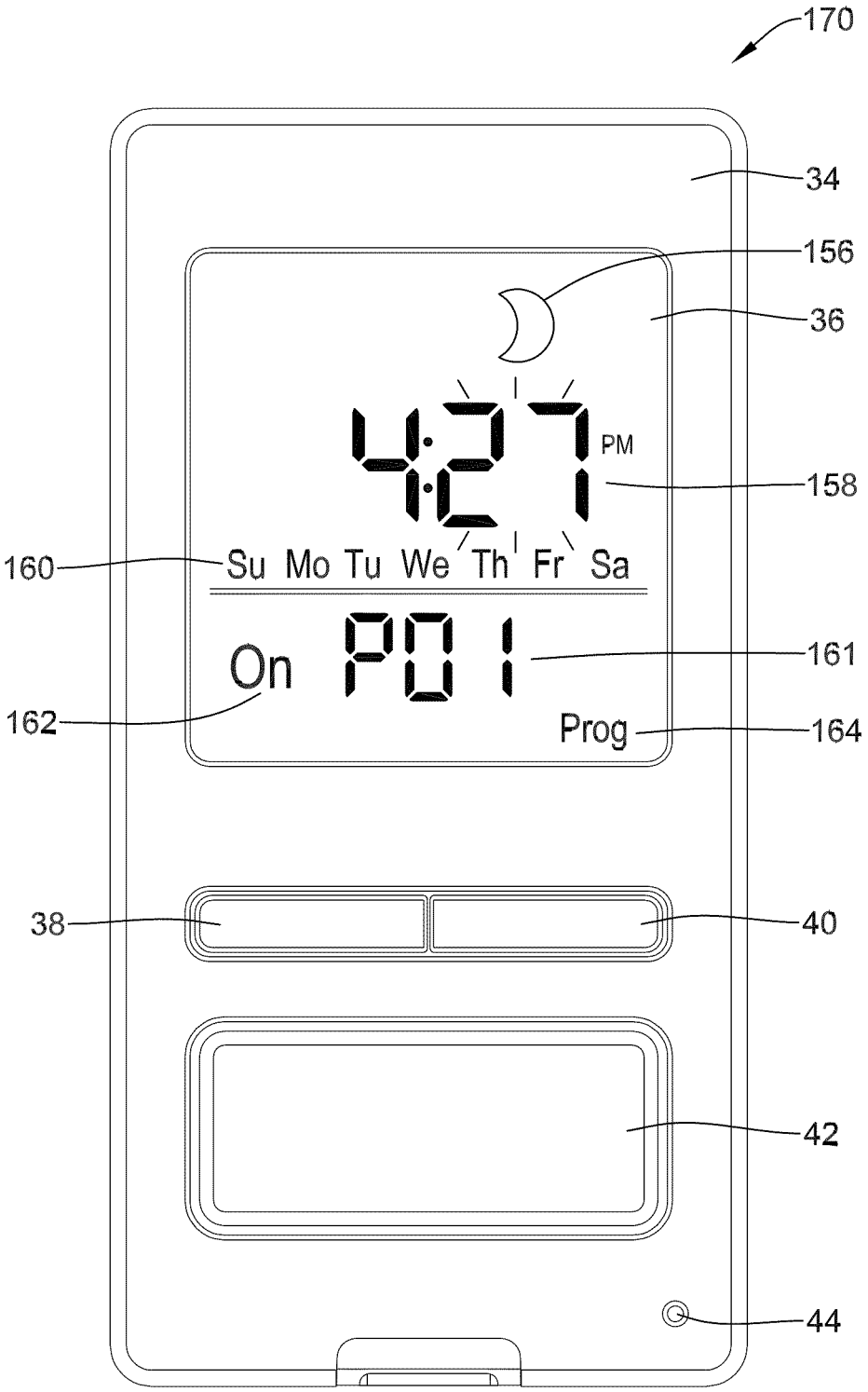

FIG. 7E shows a pictorial view of an illustrative screen 170 for further setting the program start time. As illustrated in screen 170, the minute field of the time display 158 may be highlighted, flashing, or otherwise indicated. A user may adjust the minute field to display a desired minute field using button 38 and/or button 40. In some embodiments, if the hour field of FIG. 7D was selected to be sunset or sunrise, the minute field of FIG. 7E may allow a user to select an offset value. In some cases, the offset may be an amount of time before or after sunset or sunrise for the program to start. In some instances, the offset may be entered according to time intervals, such as, for example, five minutes, ten minutes, fifteen minutes, twenty minutes, thirty minutes, as well as any other suitable timer interval, as desired. Also, in some cases, the offset may include an offset limit. For example, the offset limit may be thirty minutes, sixty minutes, seventy minutes, ninety minutes, or any other suitable offset limit, as desired. When the desired offset value or minute field value is shown on the display 36, the user may press button 42 to accept the setting.

Figure 8A:
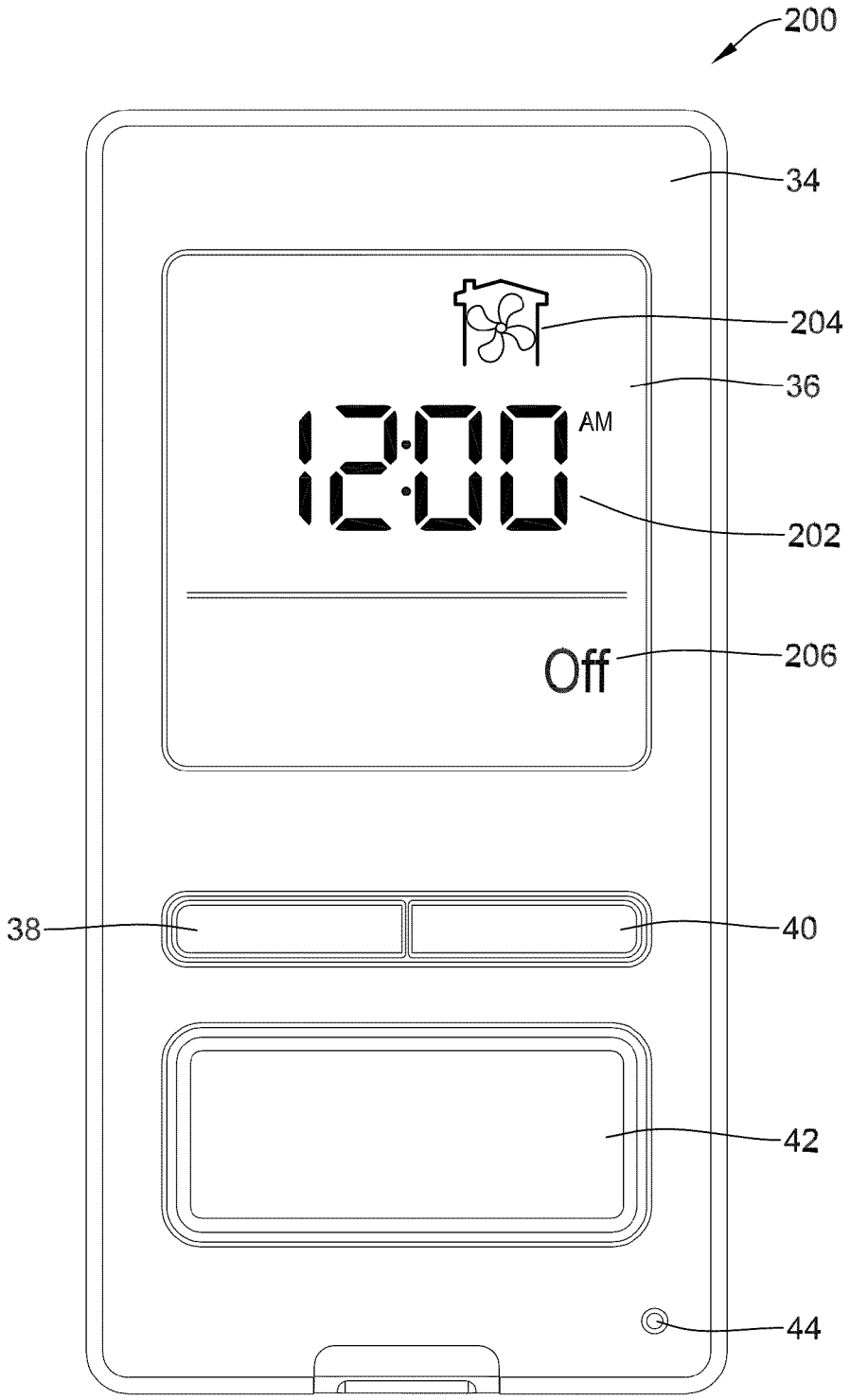
FIGS. 8A-13F are pictorial views showing some illustrative screens that can be displayed on the display of the electric timer of FIG. 2.

FIG. 8A shows a pictorial view of another illustrative home screen 200 that may be displayed on display 36. In some embodiments, home screen 200 may be displayed on display 36 when the load 18 that is switched between the "on" state and "off" state by the electric timer 30 is a fan, such as, for example, a bath fan. In this example, the electric timer 30 may also be referred to as a bath fan controller. The bath fan controller may be configured to switch power to the fan between the "on" state (sometimes between a number of different "on" states of different fan speeds) and the "off" state to provide ventilation (sometimes between the inside and outside of the building) to at least a portion of a building or other structure.

In the illustrative embodiment, home screen 200 may be displayed when the bath fan controller is in the operating mode. In some cases, home screen 200 may be configured to display information on the display 36 about the operational status of the bath fan controller and/or fan. For example, the information may include the current mode of operation of the bath fan controller, the current time 202, the current day of the week, the current program, the status of the fan, and/or other operational information, as desired. In the illustrative embodiment, the home screen 200 displays icon 204 indicating that the current mode of operation is automatic, the current time 202 is "12:00" A.M., and the status of the fan is off, as indicated by "Off" icon 206.

In the illustrative embodiment, a user may press various buttons 38, 40, and 42 of the user interface to access and/or modify various operational settings of the bath fan controller. For example, briefly pressing button 38 or button 40 may enter a countdown mode for temporary operation of the load (e.g. fan). Briefly pressing button 42 may turn the fan "on" and "off". Pressing button 42 for an extended period of time may access a setup mode of the bath fan controller. The setup mode may allow a user to modify and/or set one or more parameters or settings of the bath fan controller. For example, the extended period of time may be one seconds, two seconds, three seconds, four seconds, five seconds, ten seconds, or any other suitable time period, as desired.

Figure 8B:
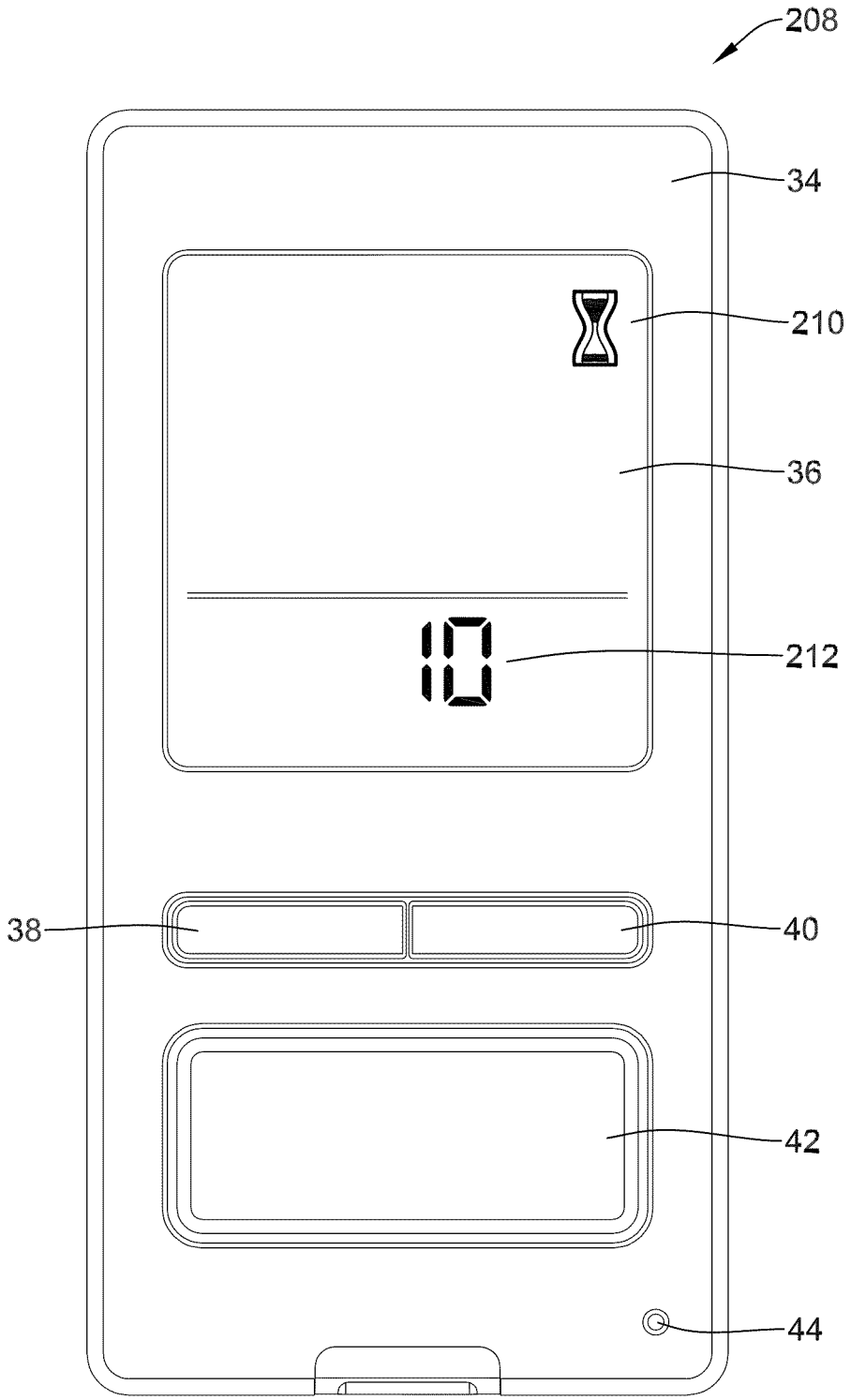
Figure 8C:
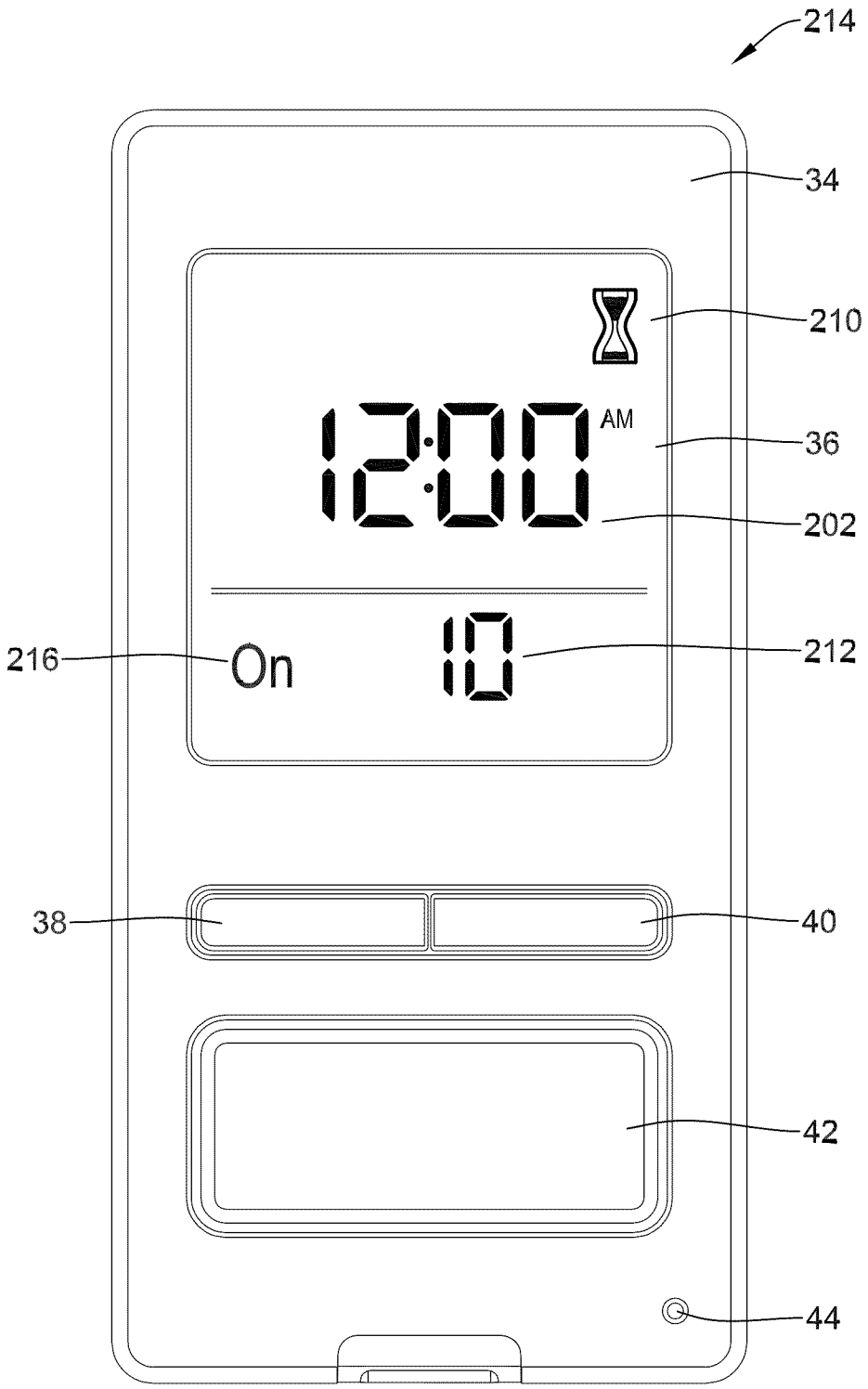

FIGS. 8B and 8C show pictorial views of illustrative screens that may be displayed on display 36 when the bath fan controller enters the countdown mode. In the illustrative embodiment, the countdown mode is entered by briefly pressing button 38 or button 40, which may activate the fan for a specified amount of time, referred to as a countdown time. FIG. 8B shows a pictorial view of screen 208 that may be displayed on display 36 when the countdown mode is entered. Screen 208 includes icon 212, shown as "10", for setting the countdown time (in minutes) for operation of the fan. Pressing button 38 may decrease the time shown in icon 212, while pressing button 40 may increase the time shown in icon 212. In some cases, the countdown time shown in icon 212 may be incremented in one minute increments, two minute increments, five minute increments, or any other suitable increment, as desired. In some cases, the countdown time may be any amount of time less than 60 minutes, but this is not required. For example, in one case, the countdown mode may be programmed to be any time between 10 minutes and 60 minutes. It is contemplated, however, that any suitable length countdown time may be used, as desired.

In the illustrative example, the default countdown time displayed when entering the countdown mode may be ten minutes, but this is merely illustrative. In other cases, the fan controller may store the previously set countdown time in memory 16, and display the previous countdown time as the new default time. However, it is contemplated that any desired default time may be initially displayed on screen 208, as desired. Screen 208 may also include icon 201, which is shown as an hourglass, to indicate that the countdown mode is entered. To accept the countdown time shown in icon 212, and in the illustrative embodiment, a user may press button 42.

Once the countdown time is accepted, the countdown mode may be activated and screen 214 may be displayed on display 36 as shown in FIG. 8C. Screen 214 displays icon 210 indicating that the mode of operation is countdown mode, the current time 202 is "12:00" A.M., the status of the fan is on, as indicated by "On" icon 216, and the countdown time (in minutes), as indicated by the "10" icon 212. As the countdown mode continues to operate, the countdown time displayed on screen 214 may be the countdown time remaining. In this case, icon 212 may change from "10" to "9" after one minute elapses, and then to "8" after another minute elapses, and so forth. In some embodiments, the countdown mode may be canceled during the countdown mode by pressing button 42. Once the countdown time expires, the bath fan controller exits the countdown mode and the home screen 200 (shown in FIG. 8A) is displayed on display 36 and the bath fan controller may return to the selected operational mode. In some embodiments, pressing button 42 when the countdown mode is activated may cancel the countdown mode and display home screen 200 on display 36. In some cases, once the countdown mode expires, the fan switches from "on" to "off", but this is not required such as when at the end of the countdown mode, an active schedule indicates that the fan should be in the "on" state.

FIGS. 9A-12E show pictorial views of illustrative screens that may be displayed on display 36 when the bath fan controller is in a setup mode. The setup mode may allow a user to modify one or more parameters or settings of the illustrative bath fan controller. In some cases, a visual confirmation may be provided to the user when a setting is accepted by the bath fan controller. In some cases, the visual confirmation may be a blink or series of blinks of the corresponding icon on the display or other portion of the display, as desired. As noted above, the setup mode may be entered by, for example, depressing one or more of buttons 38, 40, and 42 for an extended period of time.

Figure 9A:
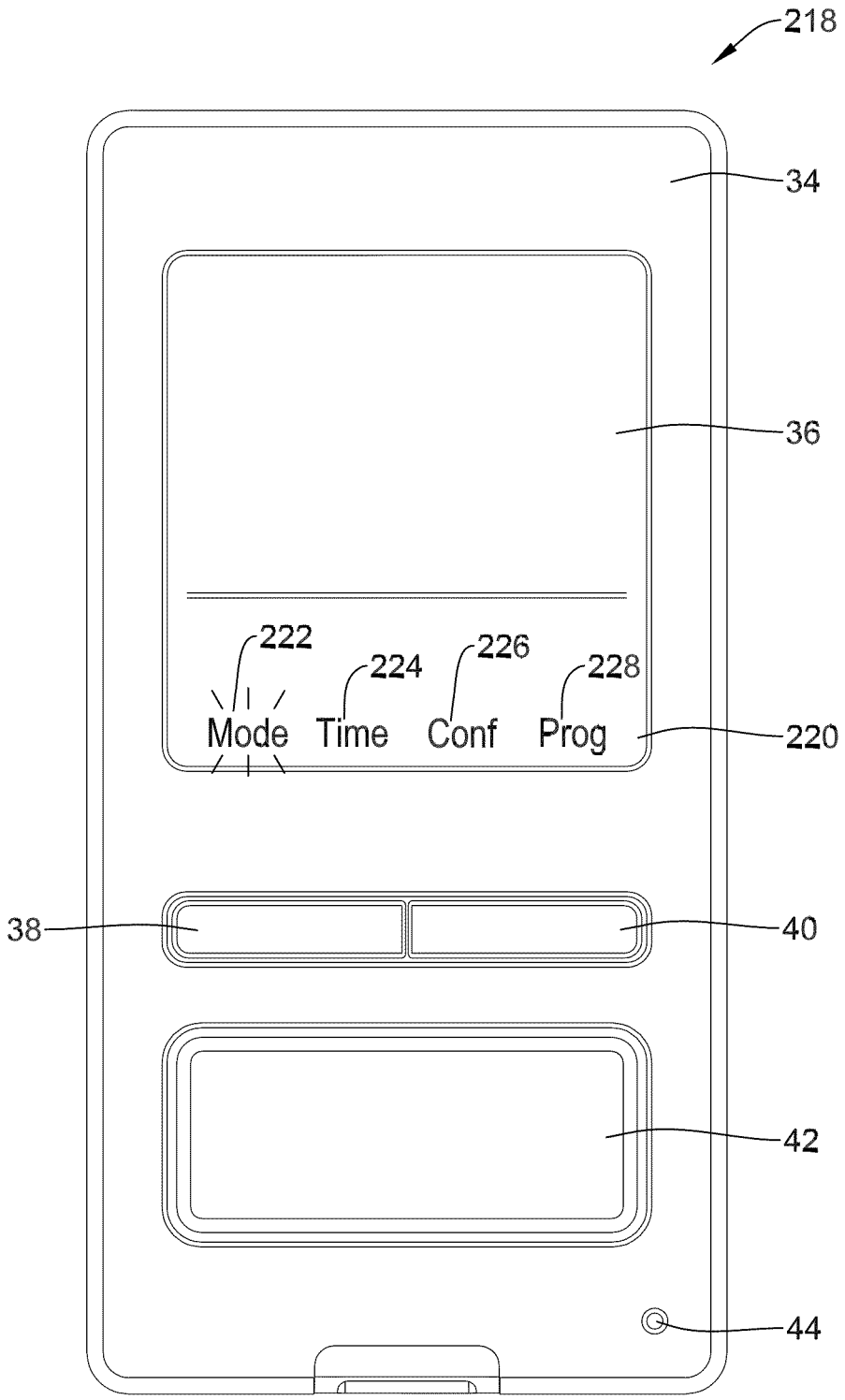

FIG. 9A shows a pictorial view of an illustrative screen 218 that may be displayed on the display 36 of the bath fan controller when the setup mode is entered. In the illustrative embodiment, screen 218 may be a setup menu screen, and may allow a user to access one or more sub-menus. For example, and in the illustrative embodiment, the one or more sub-menus may include a mode menu, a time menu, a configuration menu, and a program menu. These are only illustrative, and it is contemplated that any suitable sub-menus may be displayed, when desired. As shown, screen 218 includes a list of icons 220 that may be selected to access a corresponding sub-menu. For example, the icons 220 may include a "Mode" icon 222 for accessing a mode menu, a "Time" icon 224 for accessing a time menu, a "Conf" icon 226 for accessing a configuration menu, and a "Prog" icon 228 for accessing a program menu.

A user may toggle or scroll through the list of icons 220 by pressing button 38 and/or button 40. In one example, button 40 may be configured to move to the next icon and button 38 may be configured to move to the previous icon. When a desired icon 222, 224, 226, or 228 is selected, the user may press button 42 to accept the selection and move to the corresponding sub-menu. The selected icon 222, 224, 226, or 228 may be indicated as being selected by highlighting, flashing, color, or some other visual or aural indication, as desired. As illustrated, "Mode" icon 222 has been selected as indicated by the lines above and below the "Mode" 222 text, which in the Figure shown, indicates that the Mode text is flashing. Since the "Mode" icon 222 has been selected, pressing button 42 will accept this selection and display the mode menu screen 230 of FIG. 9B.

Figure 9B:
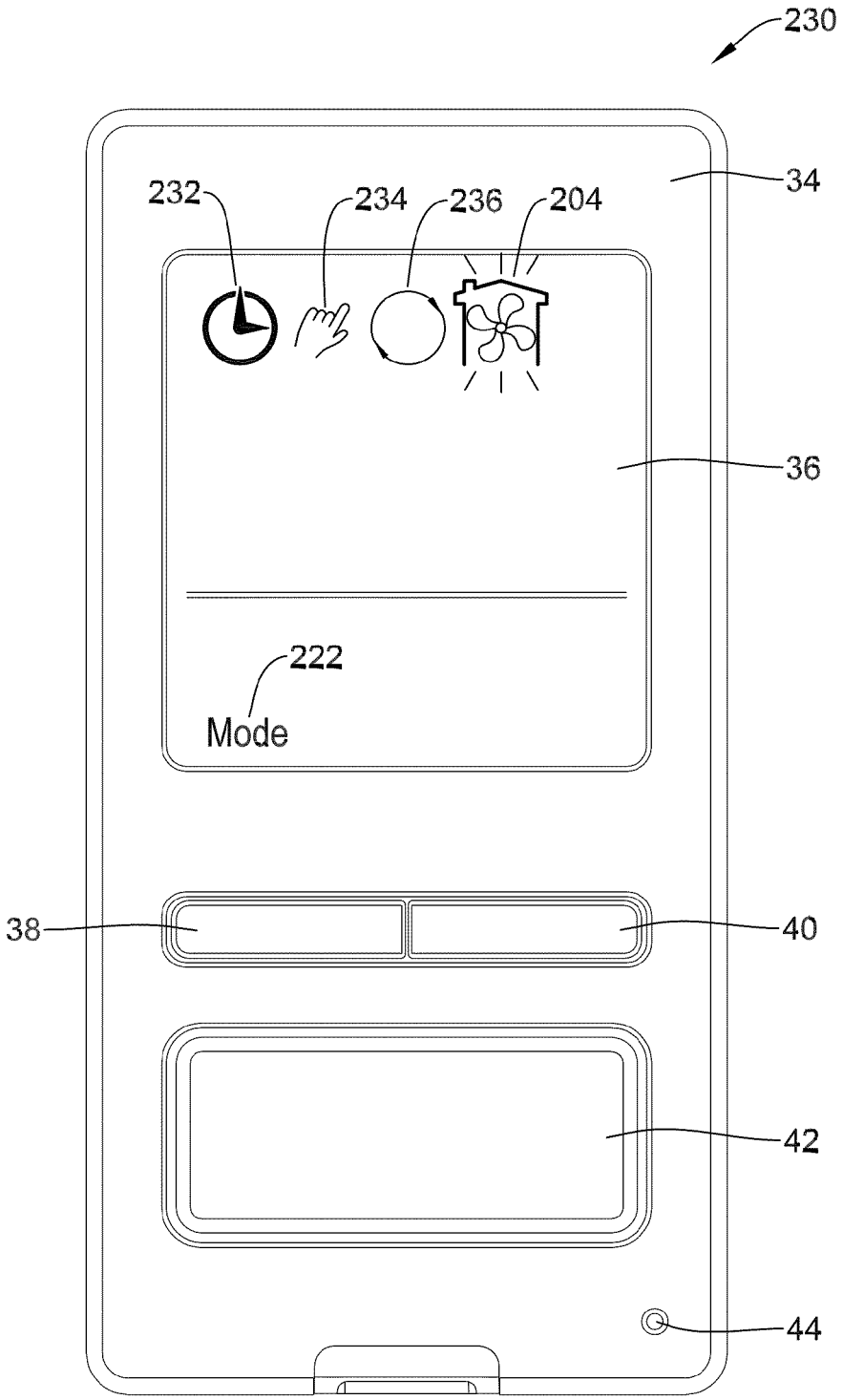
Figure 9C:
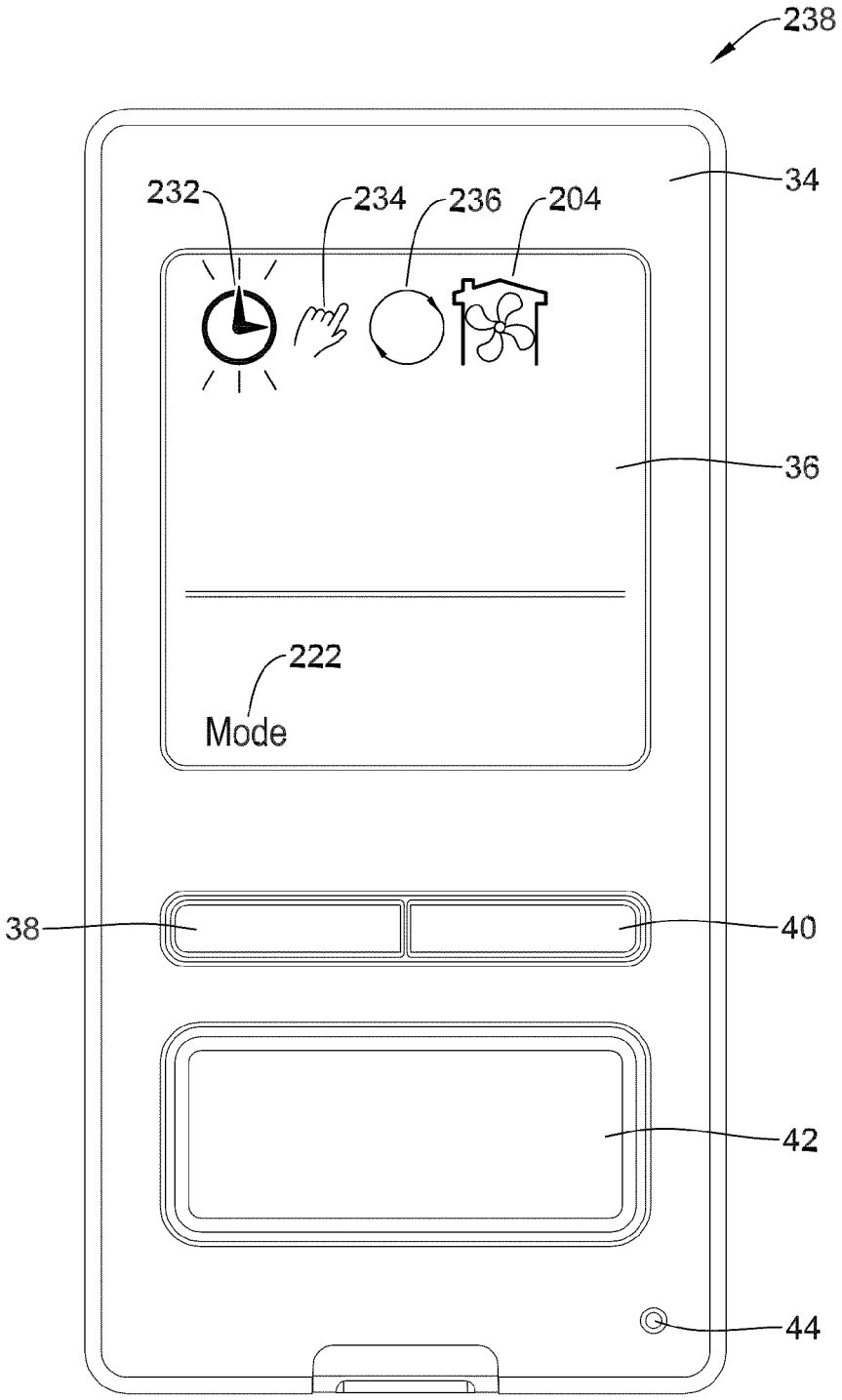
Figure 9D:
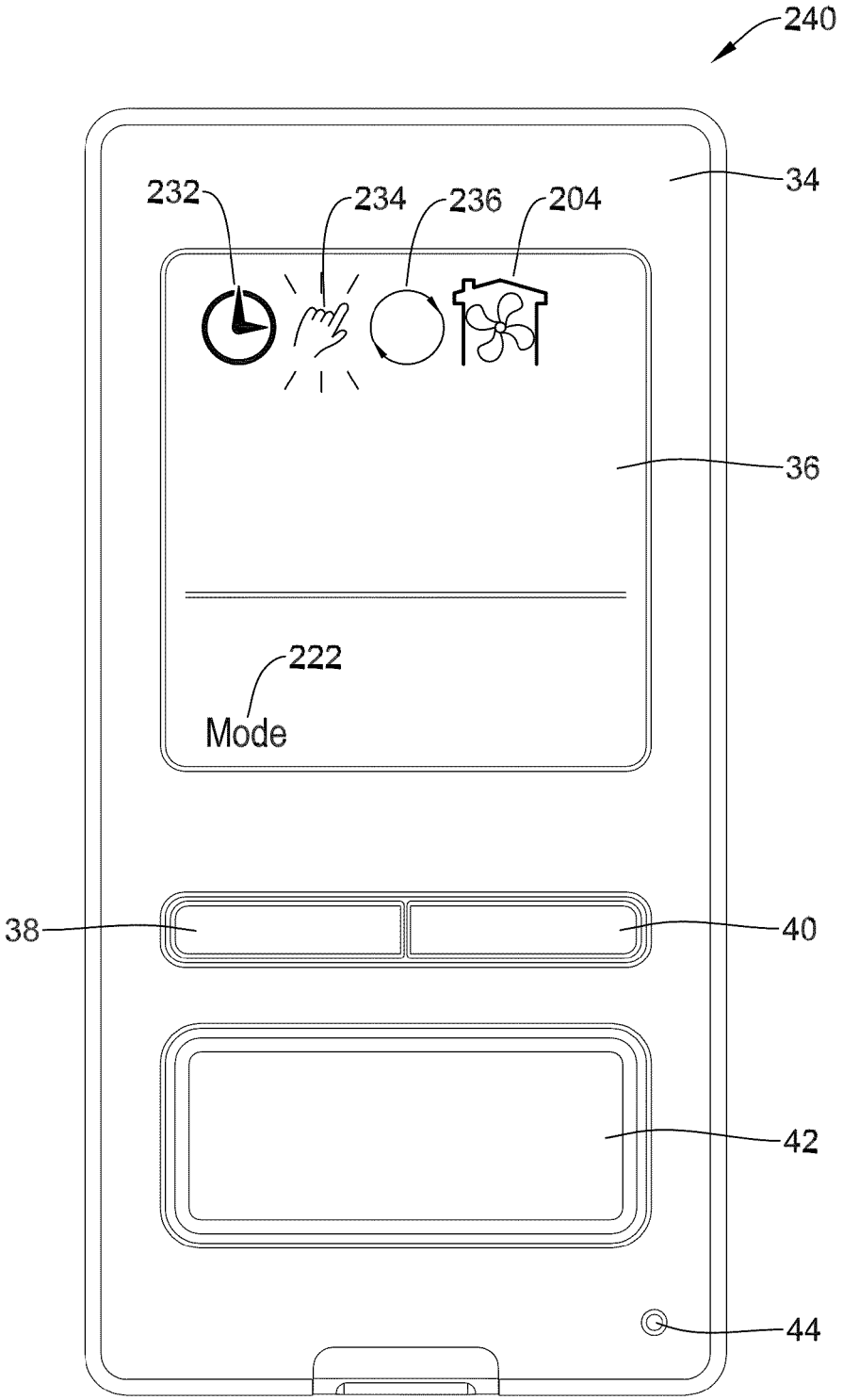
Figure 9E:
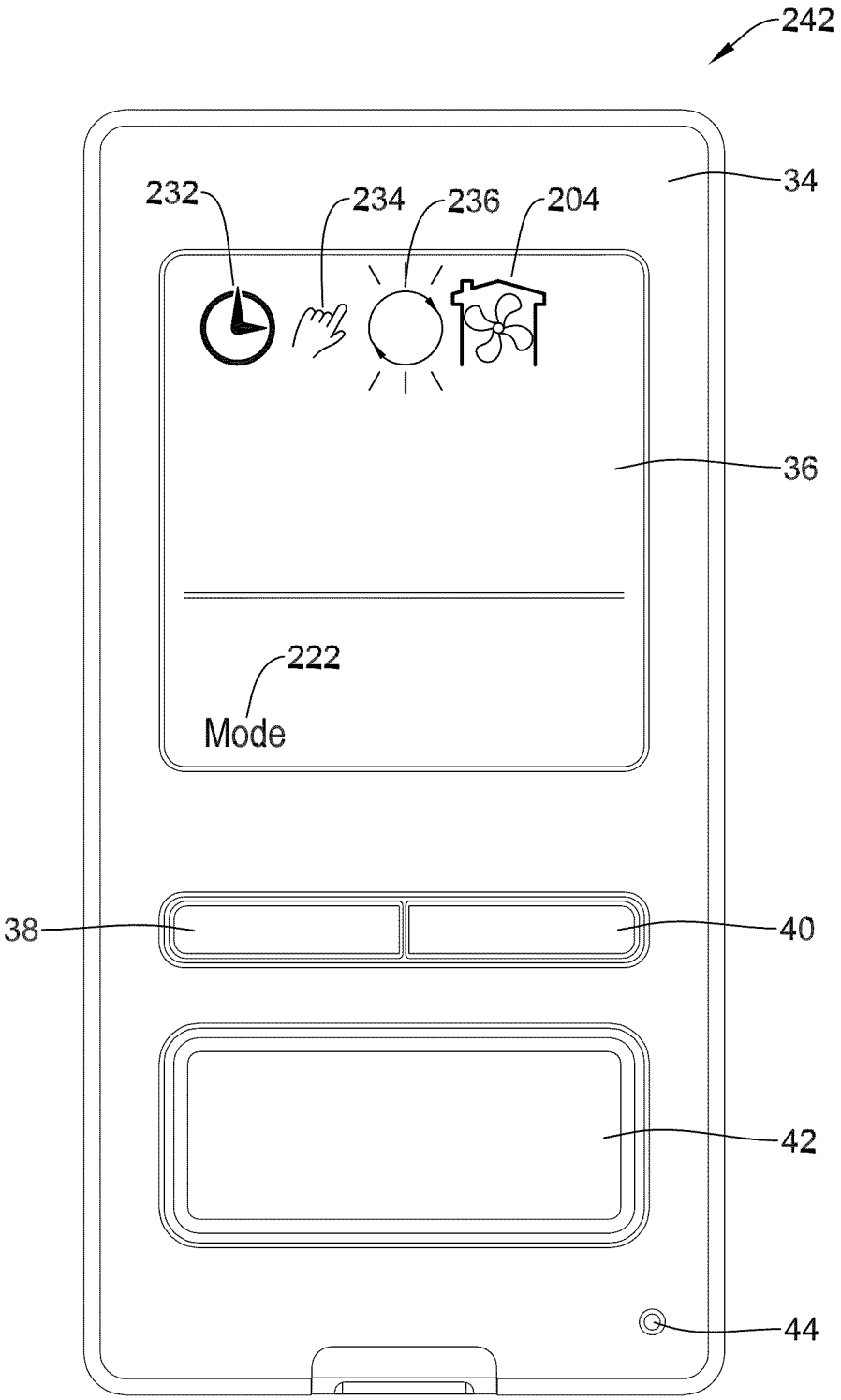

In FIG. 9B, the mode menu screen 230 may allow a user to select between an ASHRAE 62.6 program mode, a daily on/off program mode, a manual mode, and a customized cycle program mode. However, it is contemplated that other suitable modes of the bath fan controller may also be provided, as desired. As illustrated, icon 204 corresponds to the ASHRAE 62.6 program mode, icon 232 corresponds to the daily on/off program mode, icon 234 corresponds to the manual mode, and icon 236 corresponds to the customized cycle program mode. The "Mode" icon 222 may be displayed on display 36 indicating that screen 230 is part of the mode menu.

Manual mode may operate the fan controller as a manual switch. For example, the fan may be turned on and off by manually pressing a button of the user interface, such as, for example, button 42. Daily on/off program mode may turn the fan "on" and "off" once a day according to a programmed "on time" and a programmed "off time". Customized cycle program mode may cycle between a run period where the fan is on and an idle period where the fan is off For example, if the run period is set to 10 minutes and the idle period is set to 20 minutes, the total cycle time is 30 minutes. During each 30 minute cycle, the fan will turn on for 10 minutes and the fan will turn off for 20 minutes. In some cases, the run period and the idle period may each be set between 10 minutes and 120 minutes. However, it is contemplated that shorter or longer run and idle periods may be used, if desired. In some cases, the run and idle periods may be set in time increments, such as one minute increments, two minute increments, three minute increments, five minute increments, ten minute increments, or any other suitable increment of time, as desired. ASHRAE 62.2 program mode may control the relative amount of time the fan is in the "on" state and "off" state over 60 minute cycles. For example, the fan may be in the "on" state for 20 minutes and in the "off" state for 40 minutes. The amount of time that the fan is in each state over a given 60 minute cycle may be controlled by the fan controller based on one or more parameters (e.g. floor space parameter, number of bedrooms parameter, and fan capacity parameter) entered in the bath fan controller (see, for example, FIGS. 13A-C). In any of the daily on/off program mode, customized cycle program mode, or ASHRAE 62.2 program mode, pressing button 42 may temporarily override the activated program and turn the fan "on" or "off". In some cases, the activated program may be temporarily overridden until the next scheduled time that the fan is to switch between the "on" state and "off" state. Also, it is contemplated that in any of the daily on/off program mode, customized cycle program mode, or ASHRAE 62.2 program mode, the fan controller may switch between a number of different "on" states, each producing a different fan speed. For example, the fan controller may switch the fan from a high fan speed to a lower fan speed after a period of time, and then back to a higher fan speed, a lower fan speed, or the "off" state, depending on the circumstances and programming.

In FIG. 9B, the ASHRAE 62.6 program mode is indicated as being selected by icon 204 being highlighted, flashing, or other indication, as desired. To accept this operating mode, a user may press button 42. To scroll across the various operating modes indicated by icons 232, 234, 236, and 204, a user may press button 38 and/or 40. For example, pressing button 40 will indicate icon 232 as being selected, as shown in screen 238 of FIG. 9C. Pressing button 40 while screen 238 is shown will select icon 234, as shown in screen 240 of FIG. 9D. Pressing button 40 while screen 240 is shown will select icon 236, as shown in screen 242 of FIG. 9E. When the desired icon 232, 234, 236, and 204 is selected, the user may press button 42 to accept the setting. After the setting is accepted, the fan controller may return to display screen 218 of FIG. 9A.

Figure 10A:
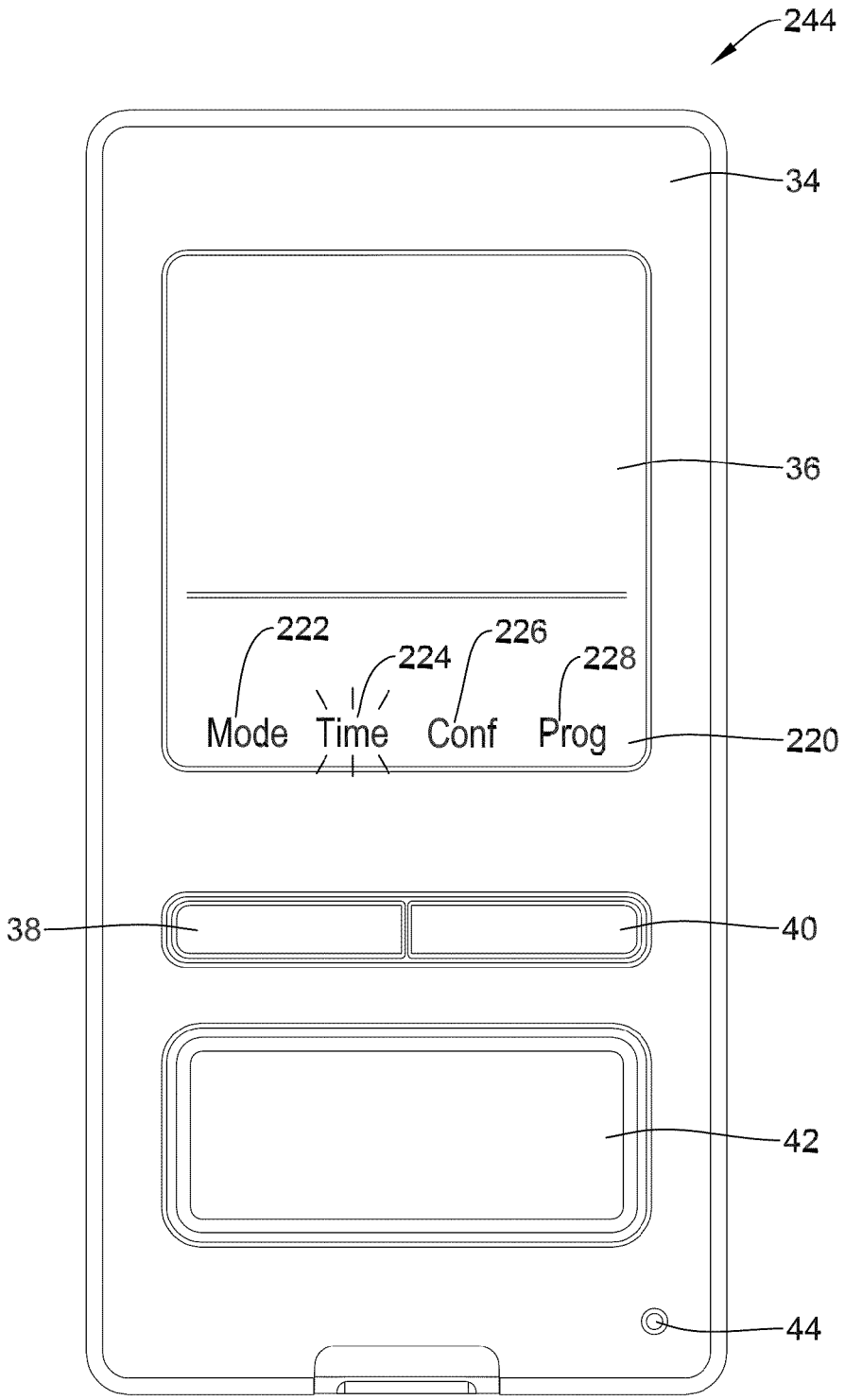

FIG. 10A shows a pictorial view of an illustrative screen 244 of the setup menu, similar to screen 218 of FIG. 9A, but with the "Time" icon 224 selected. As discussed previously, a desired icon 222, 224, 226, or 228 may be selected by pressing button 38 and/or button 40 to scroll across the list of icons 220. In the illustrative embodiment, a user may press button 42 to accept the setting and display the corresponding sub-menu of the icon. Icon 224 is selected in FIG. 10A, and when accepted by pressing button 42, a time menu may be displayed on display 36. An illustrative time menu may include each of the sub-menu screens 246, 252, 258, 260, 266, and 272 of FIGS. 10B-10G, respectively, "Time" icon 224 may be displayed on each of these sub-menus indicating that the bath fan controller is currently executing the time menu option.

Figure 10B:
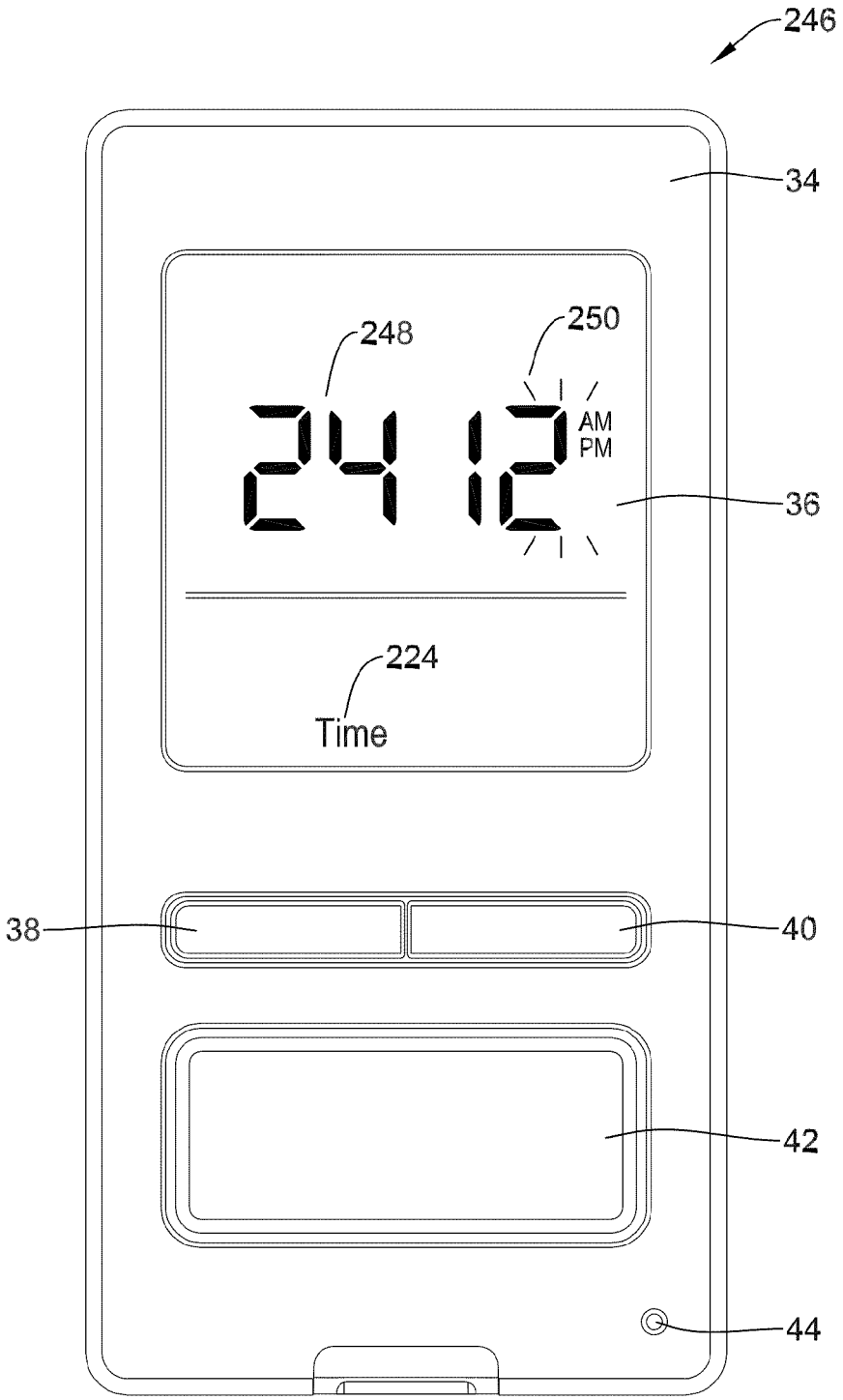
Figure 10C:
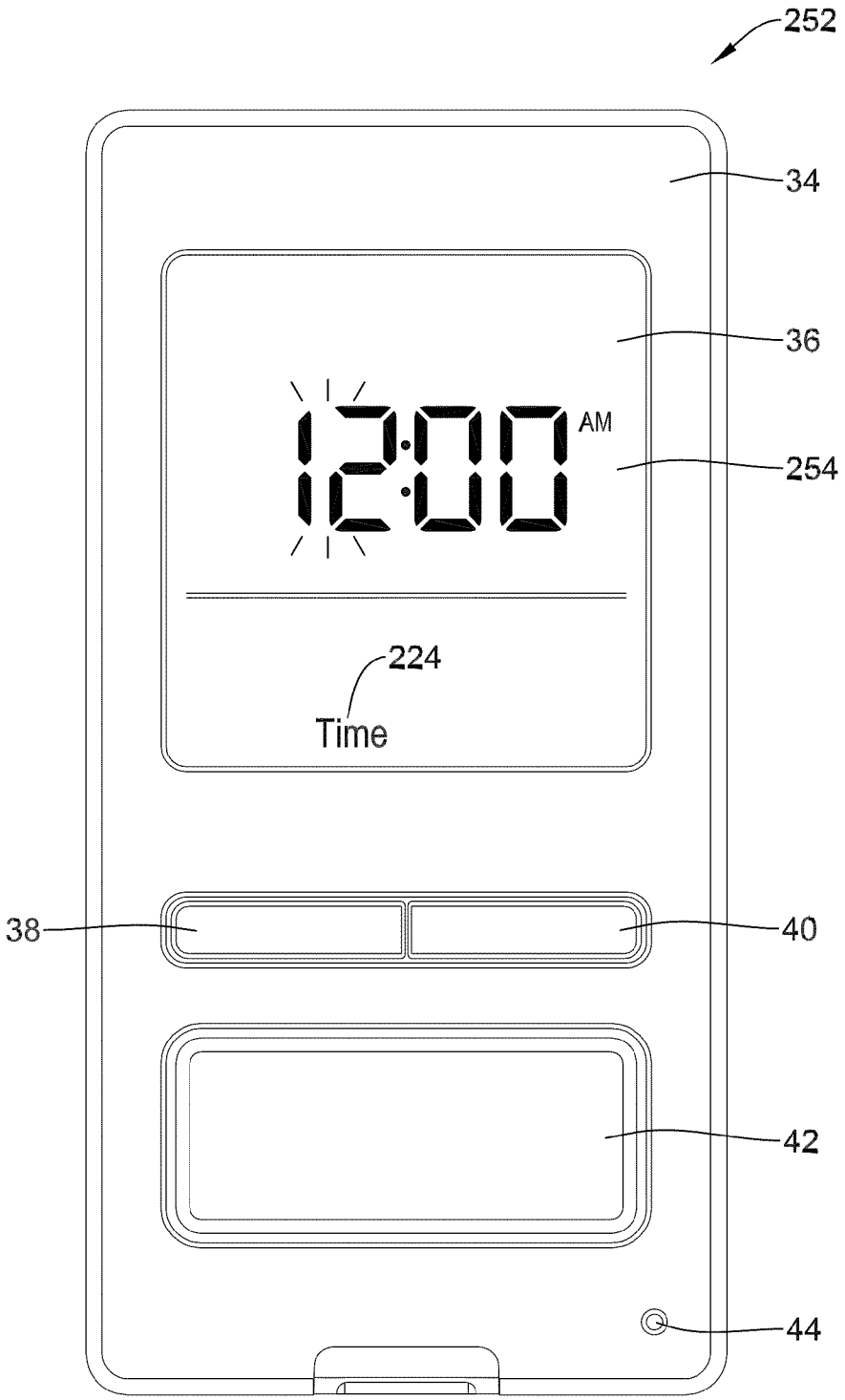
Figure 10D:
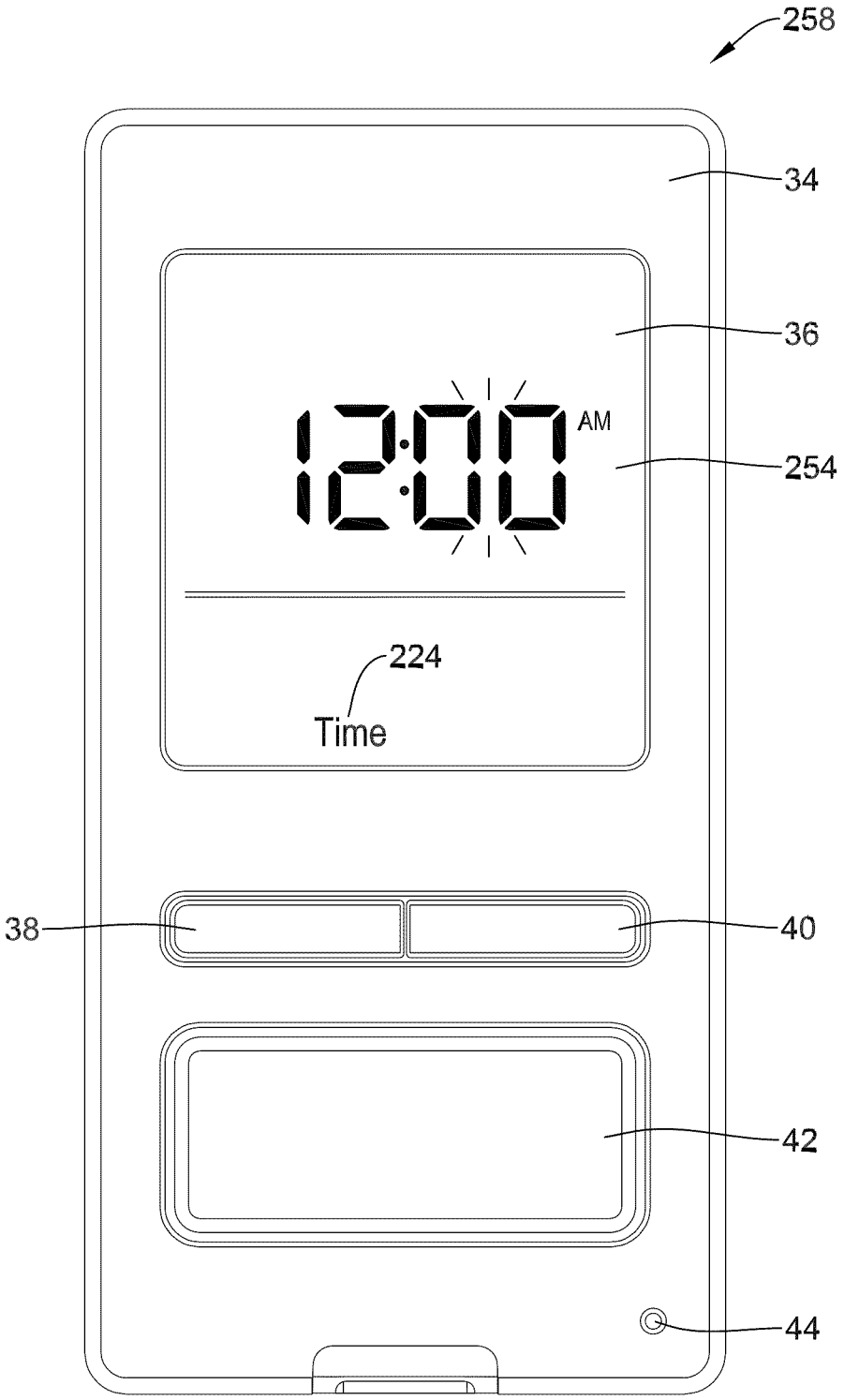

FIG. 10B-10D show pictorial views of illustrative screens 246, 252, and 258 for formatting and setting the time of the fan controller. More specifically, FIG. 10B shows a pictorial view of an illustrative screen 246 that may be displayed on display 34 for setting the format of the time display. Screen 246 may be configured to allow a user to set the format of the time to be displayed on display 36. As illustrated, screen 246 may display a "24" icon 248 and a "12" icon 250 on the display 36. The "24" icon 248 may correspond to a 24 hour time format, and the "12" icon 250 may correspond to a 12 hour time format. The user may be able to select the desire time format icon 248 or icon 250 by pressing button 38 and/or button 40. As illustrated, the "12" icon 250 corresponding to the 12 hour time format is indicated as selected by highlighting, blinking, or other indication, as desired. To accept the selected time format, a user may press button 42.

Once accepted, the fan controller may display the illustrative screen 252 shown in FIG. 10C. As illustrated in FIG. 10C, a current time indicator 254 may be displayed on at least a portion of display 36. In the illustrative screen 252, the hour field of the time indicator 254 may be highlighted, blinking, or otherwise indicated. The user may adjust the hour field using button 38 (e.g. adjust forward in time) and/or button 40 (e.g. adjust backward in time). In some cases, the user may increase the hour field of time indicator 254 by pressing button 40, and the user may decrease the hour field of the time indicator 254 by pressing button 38. However, it is contemplated that the hour field may be set using any suitable button or combination of buttons, as desired. Once the desired hour field of the time indicator 254 is displayed, the user may press button 42 to accept the setting. Once accepted, the fan controller may display the illustrative screen 258 shown in FIG. 10D.

In FIG. 10D, the minute field of the time indicator 254 may be highlighted, blinking, or otherwise indicated. The user may adjust the minute field using button 38 and/or button 40. In some cases, the user may increase the minute field of time indicator 254 by pressing button 40, and the user may decrease the minute field of the time indicator 254 by pressing button 38. However, it is contemplated that the minute field may be set using any suitable button or combination of buttons, as desired. Once the desired minute field of the time indicator 254 is displayed, the user may press button 42 to accept the setting. Once accepted, the fan controller may display the illustrative screen 260 shown in FIG. 10E.

Figure 10E:
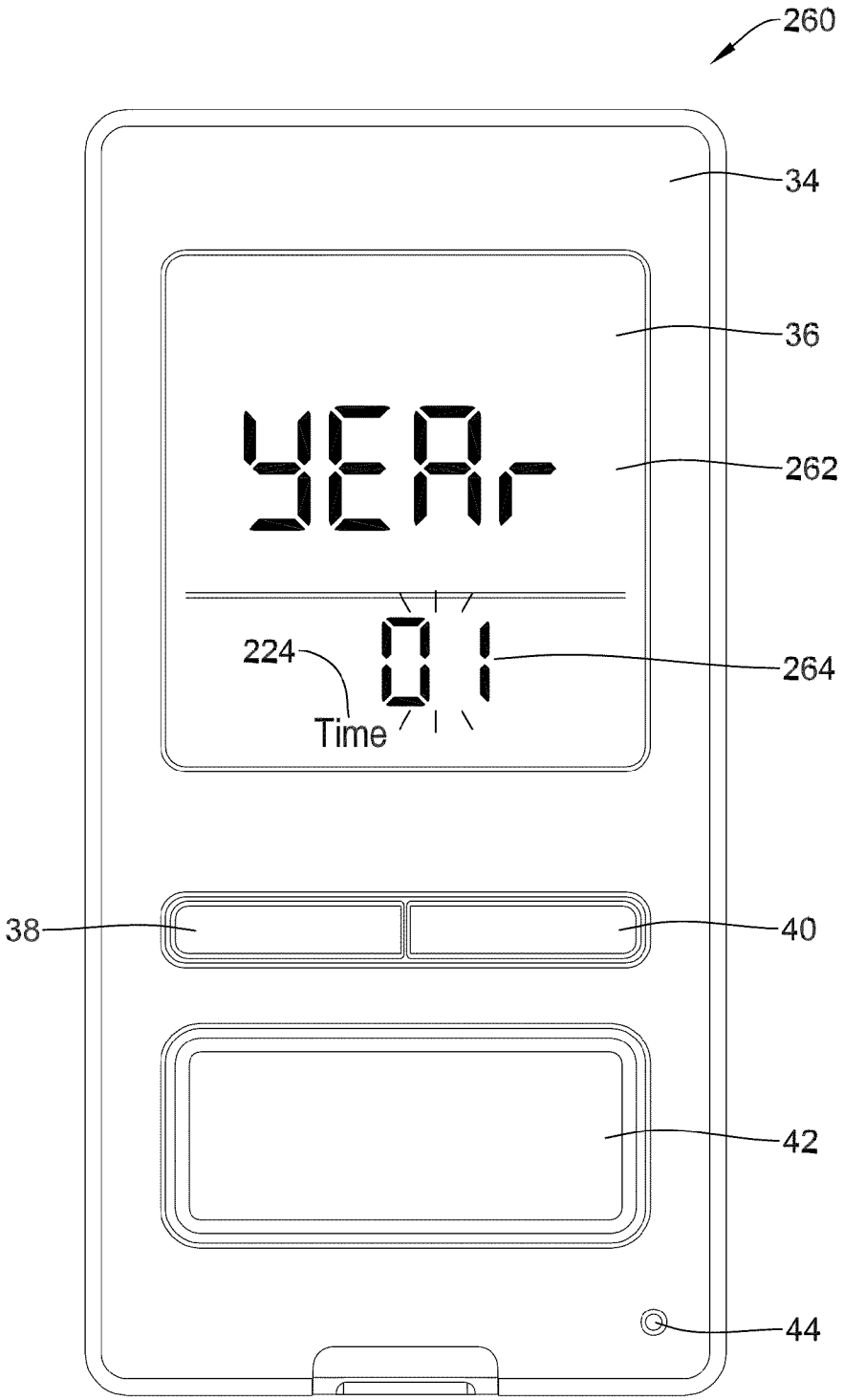
Figure 10F:
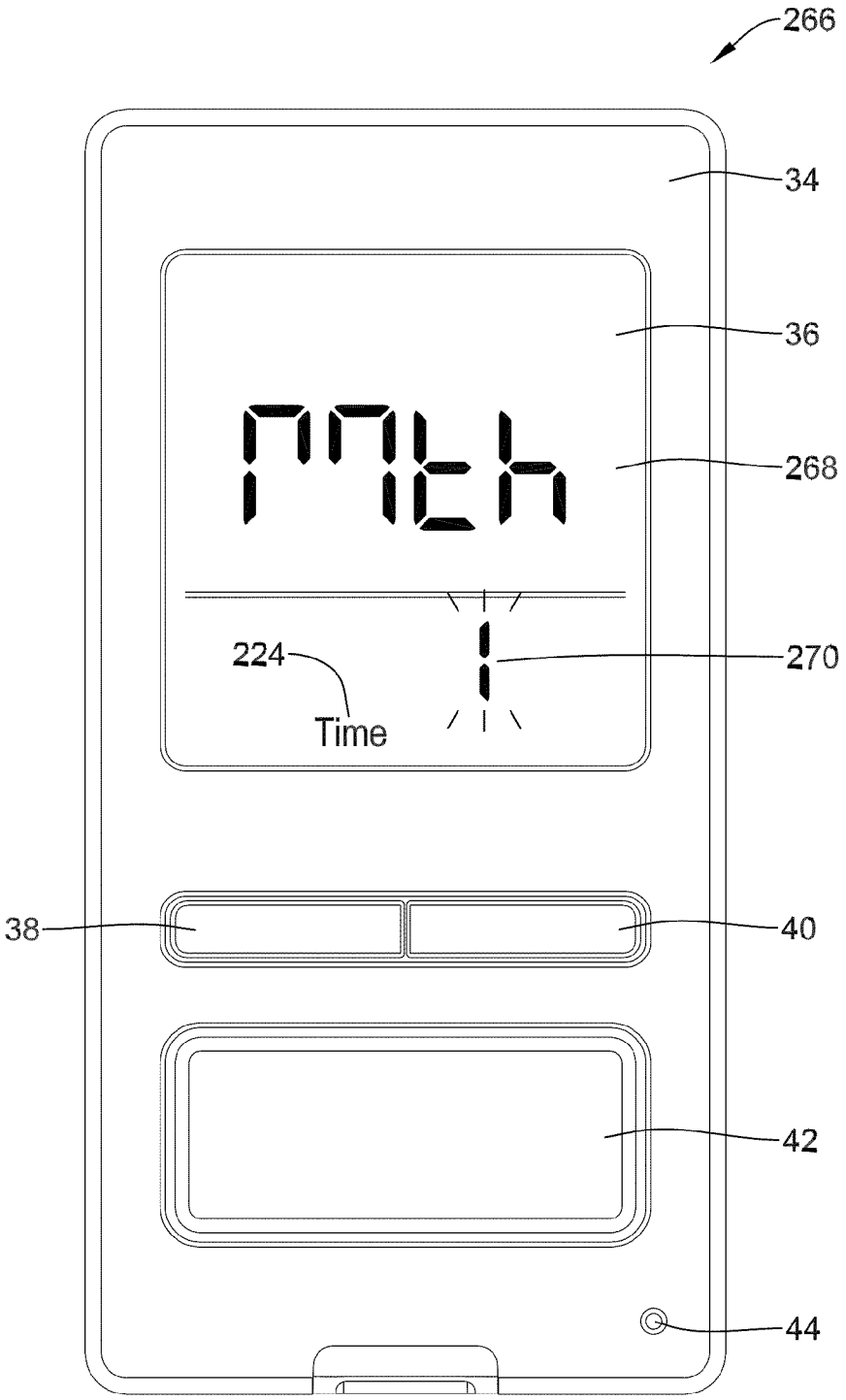
Figure 10G:
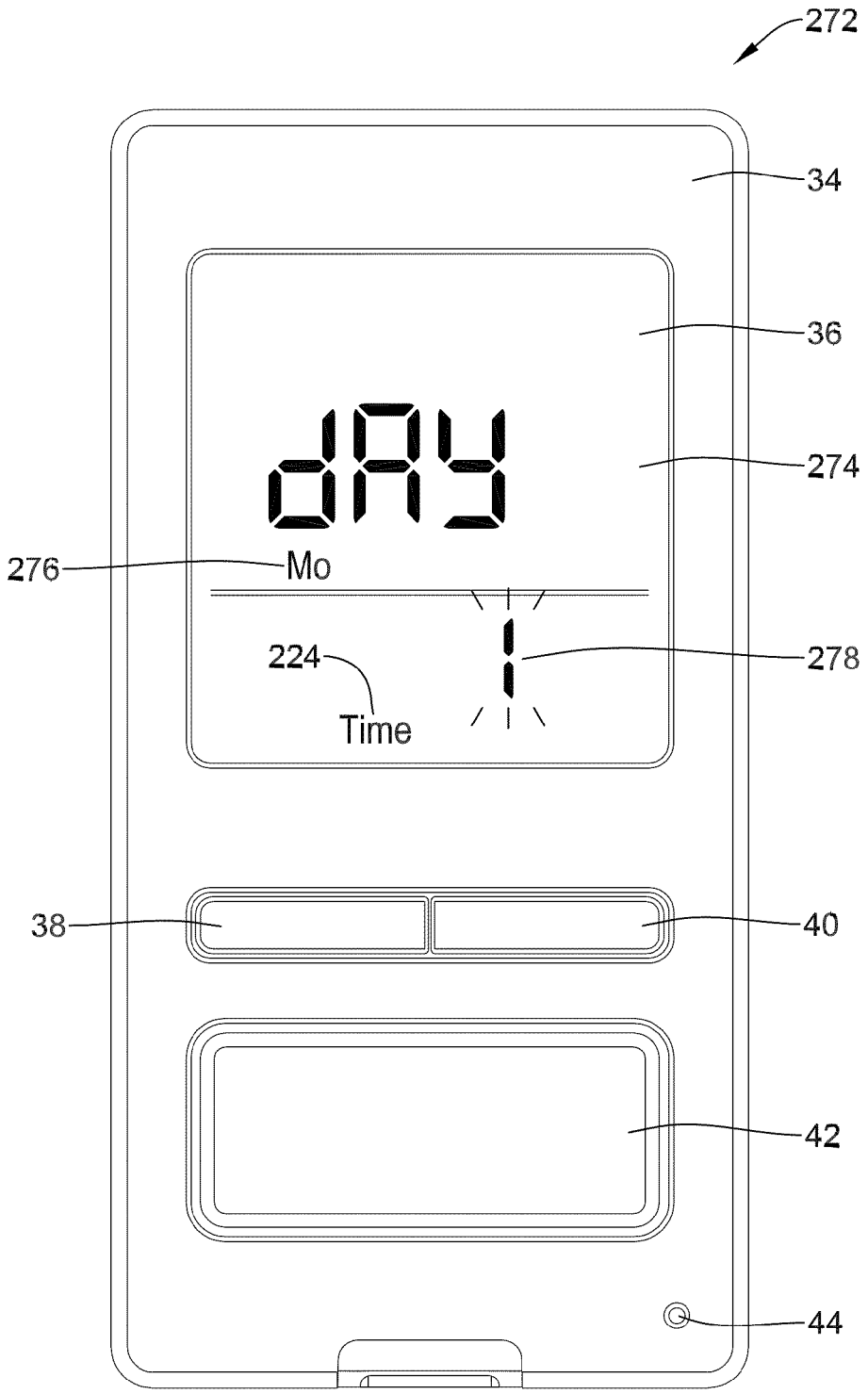

FIG. 10E-10G show pictorial views of illustrative screens 260, 266, and 272 that may be used to set the current date of the fan controller. More specifically, FIG. 10E shows a pictorial view of an illustrative screen 260 for setting the current year. As illustrated, screen 260 may display "year" 262 on the display 36 to indicate that the current year is to be set. Screen 260 may also include an icon 264 for displaying the year. As illustrated, icon 264 displays "01" and may be highlighted, flash, or otherwise indicated. In the illustrative embodiment, the year may be displayed as a two digit year. For example, "01" of icon 264 may correspond to year 2001. However, it is contemplated that a three digit or four digit year icon may be provided as desired. To set the current year, the user may press button 38 and/or button 40 until icon 264 displays the two digit number corresponding to the current year. When the desired year is displayed in icon 264, the user may press button 42 to accept the year.

Once accepted, and in the illustrative embodiment, the fan controller may display the illustrative screen 266 shown in FIG. 10F for setting the current month. As illustrated, screen 266 may display "Mth" 268 on the display 36 to indicate that the current month of the year is to be set. Screen 266 may also include an icon 270 for displaying the current month. In the illustrative embodiment, icon 270 may be set as any number from 1 to 12, each number corresponding to a month of the year. As illustrated, icon 270 displays "1" (e.g. January) and may be highlighted, flash, or otherwise indicated. To set the current month, the user may press button 38 and/or button 40 until icon 270 displays the number corresponding to the current month of the year. If the user presses button 38 and/or button 40 to increase the number of icon 270 corresponding to the month when "12" is displayed, then icon 270 may roll over and display "1" again. Similarly, if the user presses button 38 and/or button 40 to decrease the number of icon 270 corresponding to the month when "1" is displayed, then icon 270 may roll over and display "12". When the desired month is displayed in icon 270, the user may press button 42 to accept the setting.

Once accepted, and in the illustrative embodiment, the fan controller may display the illustrative screen 272 shown in FIG. 10G for setting the current day of the month. As illustrated, screen 272 may display "day" 274 indicating that the current day of the month is to be set. Screen 272 may also include an icon 278 for displaying the current day of the month. In the illustrative embodiment, icon 278 may be set as any number from 1 to 31, depending on the month that was set in screen 266 of FIG. 10F. As illustrated, icon 278 displays "1" and may be highlighted, flash, or otherwise indicated. To set the current day, the user may press button 38 and/or button 40 until icon 278 displays the current day of the month. In some cases, if the user presses button 38 and/or button 40 to increase the day past the last day of the month, then icon 278 may roll over and display "1" for the first day of the month. Similarly, if the user presses button 38 and/or button 40 to decrease the day of the month when icon 278 shows the first day of the month, icon 278 may display the last day of the month. When the desired day is displayed in icon 278, the user may press button 42 to accept the setting. In some embodiments, when the desired day is accepted, the time menu may be completed and screen 244 of FIG. 10A may be displayed on display 36.

In some embodiments, as illustrated on screen 272, the fan controller may include icon 276 indicating a day of the week corresponding to the selected date of the month. For illustrative purposes, icon 276 may appear as "Mo" indicating that the day of the week (e.g. Monday) corresponding to the day of the month shown by icon 278. In some cases, the controller of the fan controller may determine the day of the week to be displayed according to the date input by the user. In some cases, the controller may include an algorithm, a look-up table, or other mechanism for determining the day of the week, as desired. In some cases, the day of the week icon 64 may be displayed before the date is set (i.e. before button 42 is pressed) and may change when the user changes the selected day of the month.

Figure 11A:
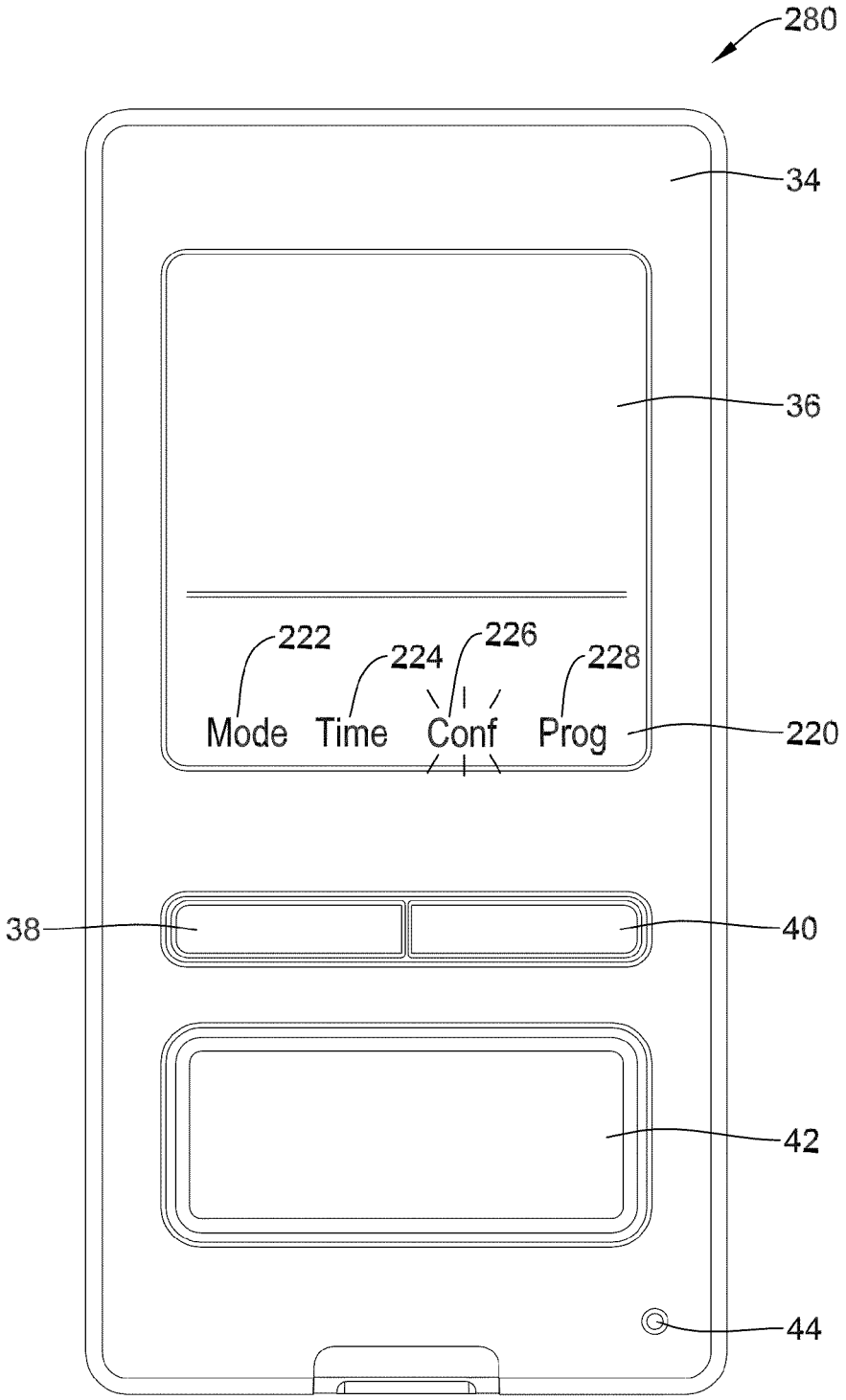

FIG. 11A shows a pictorial view of an illustrative screen 280 of the setup menu, similar to screen 118 of FIG. 9A and screen 244 of FIG. 10A. As illustrated, the "Conf" icon 226 corresponding to the configuration menu may be selected on screen 280. As discussed previously, a desired icon 222, 224, 226, or 228 may be selected by pressing button 38 and/or button 40 to scroll through the list of icons 220. A user may press button 42 to accept the setting and display the corresponding sub-menu. In the illustrative case, when icon 226 is selected and accepted, a configuration menu may be displayed on display 36. Illustrative configuration sub-menu screens 282 and 292 are shown are shown in FIG. 11B-11C, and each includes the "Conf" icon 226 to show the user where in the menu structure the user is currently operating.

Example configuration options may include backlight options, automatic daylight savings time changeover, as well as any other configuration options, as desired. In the illustrative embodiment, when the user presses button 42 from screen 280 of FIG. 11A, the display 36 may display screen 282 of FIG. 11B for adjusting the backlight. If button 42 is pressed again, then screen 292 of FIG. 11C may be displayed for adjusting the automatic daylight savings time changeover.

Figure 11B:
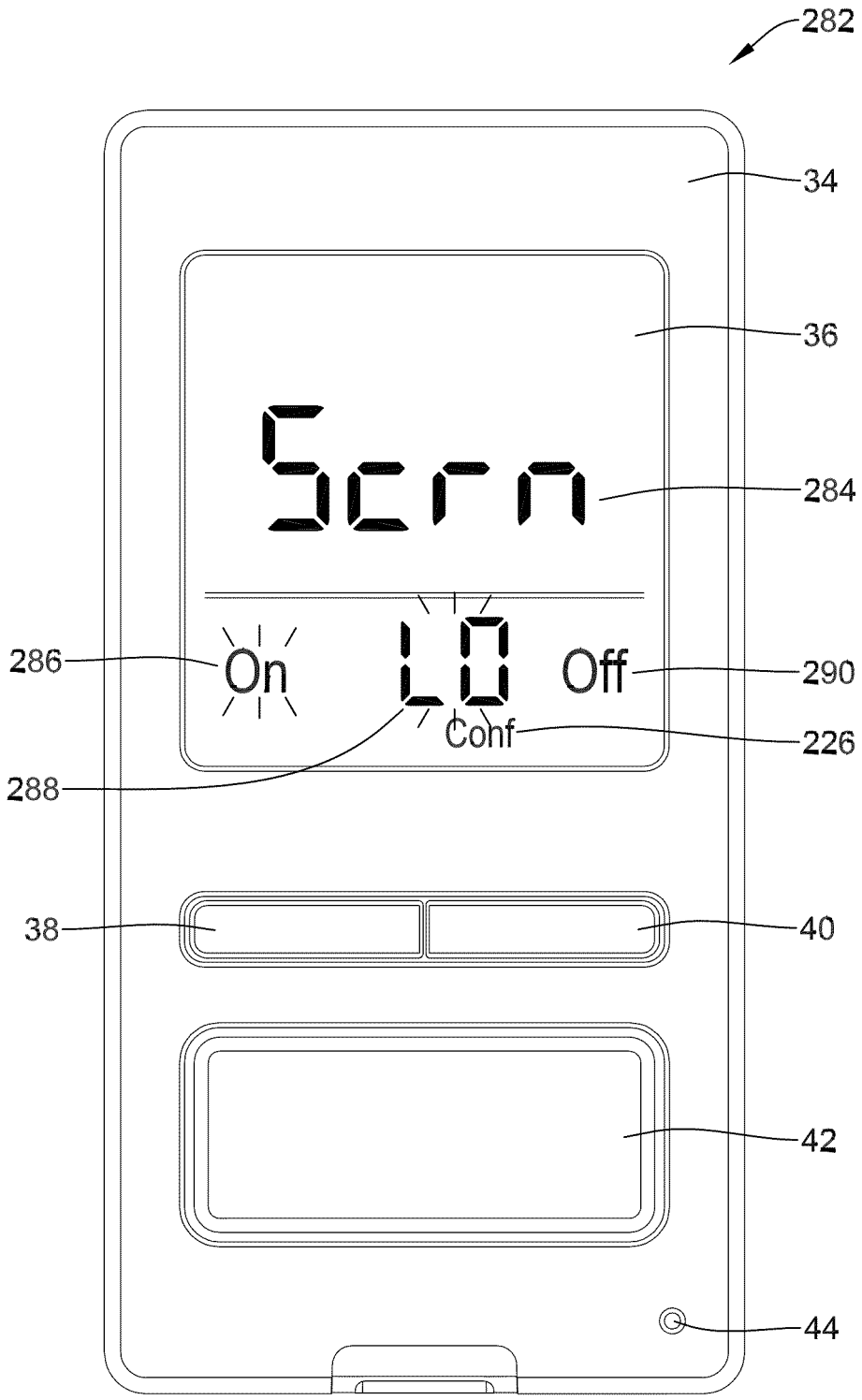
Figure 11C:
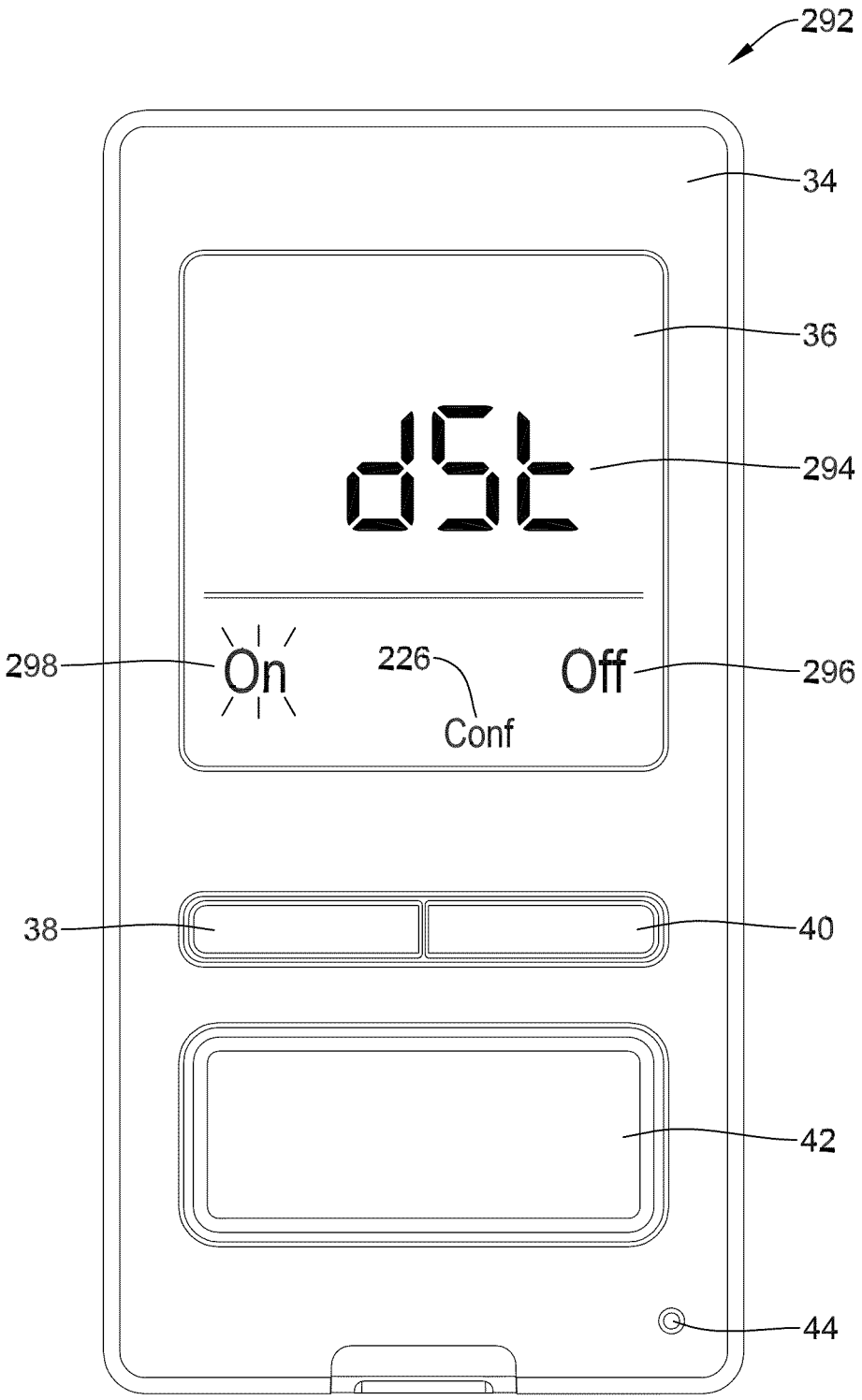

More specifically, FIG. 11B shows a pictorial view of an illustrative screen 282 for setting and/or adjusting the backlight operation of the display 36. In some embodiments, fan controller may include a backlight to illuminate at least a portion of display 36. In some cases, the backlight may be configured to illuminate display 36 when the user presses one of buttons 38, 40, or 42. In one example, the backlight may be configured to illuminate the display 36 for a period of time, such as, for example, one second, two seconds, three seconds, four seconds, five seconds, eight seconds, ten seconds, or any other suitable period of time, as desired. In this case, the period of time may be restarted each time the user touches one of buttons 38, 40, and 42. Additionally, the illustrative fan controller may include one or more backlight operation settings, such as, for example, the brightness, the length of time to illuminate the display 36 after a touch, and/or any other suitable backlight setting, as desired. Example brightness settings may include a high intensity setting, a low intensity setting, and an off setting. Furthermore, it is contemplated that a number of other intensity settings may be used, as desired. In some cases, the backlight may be a white backlight, a blue backlight, an orange backlight, a gray backlight, a red backlight, a yellow backlight, or any other color backlight, as desired.

As illustrated, display 36 may include "Scrn" icon 284 indicating that the fan controller is ready to have the backlight setting(s) set or adjusted. Screen 282 may include an "On" icon 286 indicating that the backlight is on, an "Off" icon 290 indicating that the backlight is off, and an intensity icon 288 indicating the intensity setting of the backlight. As illustrated, the intensity setting may be set to low, as indicated by the "LO" icon 288 displayed. If a high intensity is set, icon 288 may show "HI". In some cases, the current setting may be indicated by flashing, being highlighted, or otherwise indicated. As illustrated, the backlight setting is set to "on" with low intensity.

The user may adjust the backlight operation of the display 36 by pressing button 38 and/or button 40. In some cases, pressing buttons 38 and/or 40 may cycle through the number of backlight settings. For example, pressing button 40 may change the setting to on with high intensity, then, if pressed again, the setting may change to off, and so forth. Pressing button 38 may cycle through the settings in reverse order. However, it is contemplated that the settings may be cycled through in any order or by any button, as desired. To accept the setting, the user may simply press button 42.

Once accepted, and in the illustrative embodiment, the fan controller may display the illustrative screen 292 shown in FIG. 11C for setting and/or adjusting the automatic daylight savings time setting of the fan controller. In some embodiments, the daylight savings time setting may automatically change the time of the fan controller according to daylight savings time. For example, on the appropriate date in the spring, the daylight savings time setting may cause the controller 12 to adjust the time (i.e. move one hour ahead) for daylight savings time for the summer and, on the appropriate date in the fall, the daylight savings time setting may cause the controller 12 to adjust the time (i.e. move one hour back) for normal time for the winter. In one example, the daylight savings time setting may cause the controller 12 to change the time to daylight savings time at 2:00 A.M. on the second Sunday in March, and change the time back to normal time at 2:00 A.M. on the first Sunday of November.

As illustrated, screen 292 may include a "dSt" icon 294 on display 36 indicating that the fan controller is ready to program the daylight savings time setting of the fan controller. Screen 292 may also include an "On" icon 298 and an "Off" icon 296 to indicate if the daylight savings time setting is "on" (e.g. active) or "off" (e.g. inactive). As illustrated, the "On" icon 298 may be highlighted, flash, or otherwise indicated when selected. A user may toggle between the "On" icon 298 and the "Off" icon 296 by pressing button 38 and/or button 40. To accept the setting, the user may simply press button 42. In some cases, the "dSt" icon 294 may be replaced with a "dLS" icon, if desired. Furthermore, it is contemplated that any of the icons disclosed herein may be replaced with other suitable icons, as desired.

Figure 12A:
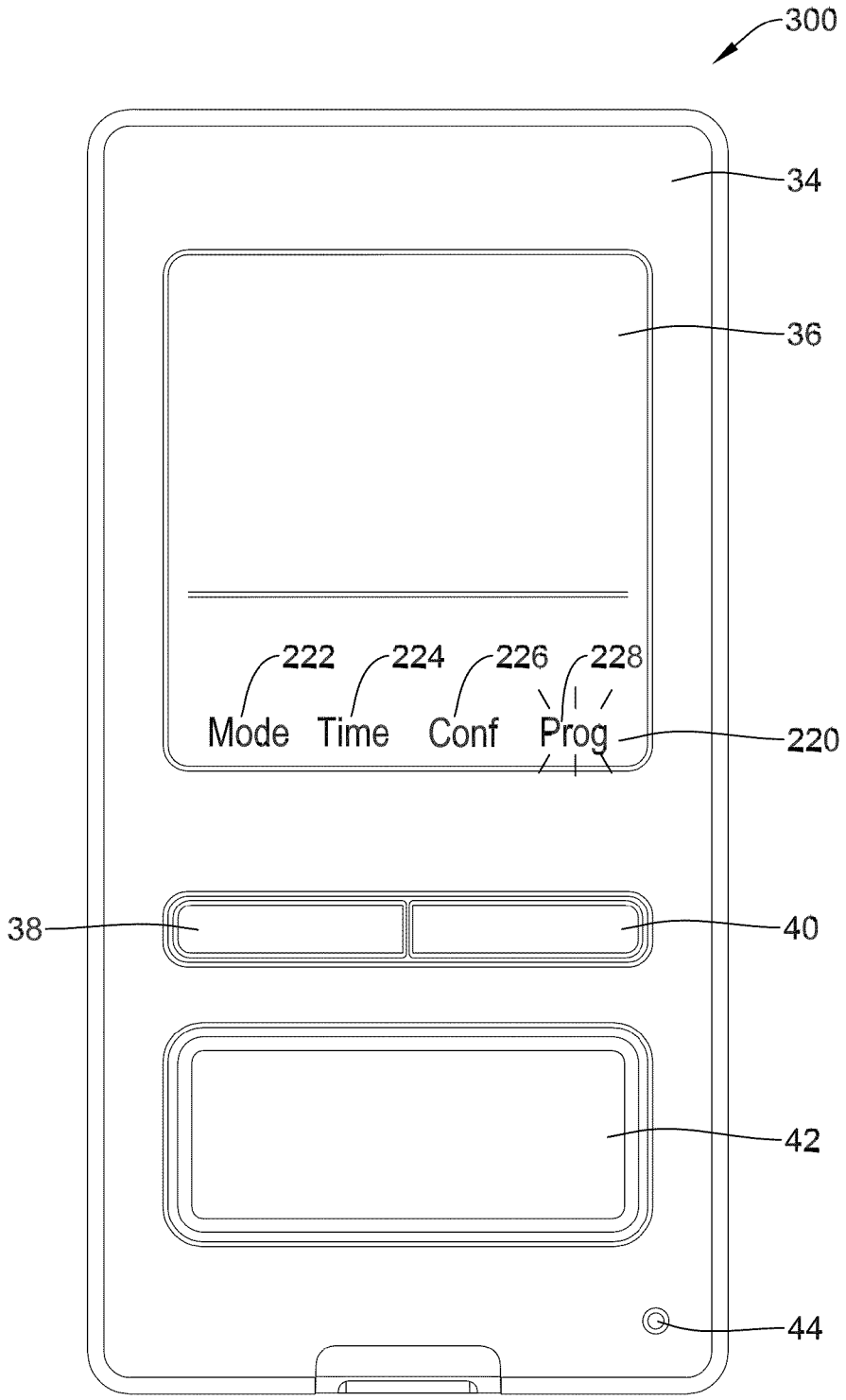

FIG. 12A shows a pictorial view of an illustrative screen 300 of the setup menu, similar to screen 218 of FIG. 9A, screen 244 of FIG. 10A, and screen 280 of FIG. 11A. As illustrated, the "Prog" icon 228 corresponding to the program menu may be selected on screen 300. As discussed previously, a desired icon 222, 224, 226, or 228 may be selected by pressing button 38 and/or button 40 to scroll through the list of icons 220. A user may press button 42 to accept the setting and display the corresponding sub-menu. In the illustrative embodiment, when icon 228 is selected and accepted, a program menu may be displayed on display 36. Example program sub-menus may include screens 302, 308, 314, and 320 of FIGS. 12B-12E, respectively. In each of the sub-menu screens 302, 308, 314, and 320, "Prog" icon 228 may be displayed indicating that the fan controller is in the "Prog" menu. In some embodiments, screen 300 shown in FIG. 12A may be displayed on display 36 only if the fan controller is operating in the daily on/off program mode or the customized cycle program mode.

In the illustrative embodiment of FIG. 12A, the "Prog" icon 228 is selected. When the user presses button 42 from screen 300, the display 36 may display screen 302 of FIG. 12B if the fan controller is in the daily on/off program mode, or the display 36 may display screen 308 of FIG. 12D if the bath fan controller is in the customized cycle program mode. In sub-menu screens 302 and 308, icon 232 may be displayed indicating that the fan controller is operating in the daily on/off program mode. In sub-menu screens 314 and 320, icon 236 may be displaying indicating that the fan controller is operating in the customized cycle program mode.

Figure 12B:
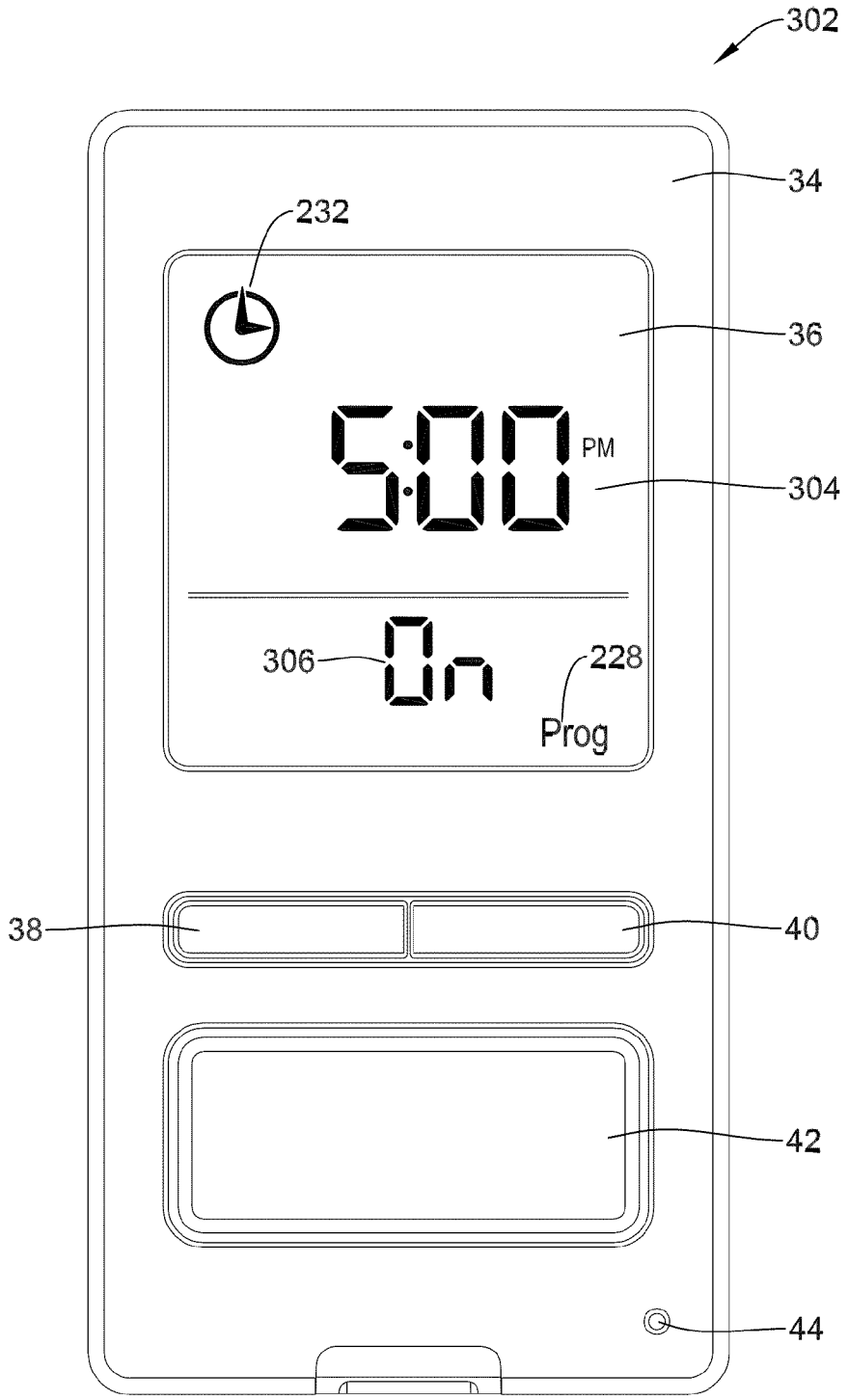

As illustrated, screen 302 shown in FIG. 12B may include an "On" icon 306 on display 36 indicating that the fan controller is ready to program the on time for the daily on/off program mode of the fan controller. Screen 302 may also include a set time indicator 304 on at least a portion of display 36. In the illustrative screen 302, the set time indicator 304 may include an hour field and a minute field. The user may adjust the hour field and/or minute field of the set time indicator by using button 38 (e.g. adjust forward in time) and/or button 40 (e.g. adjust backward in time). In some cases, the user may increase the set time indicator 304 by pressing button 40, and the user may decrease the set time indicator 304 by pressing button 38. Once the desired on time is displayed on the set time indicator 304, the user may press button 42 to accept the setting. Once accepted, the fan controller may display the illustrative screen 308 shown in FIG. 12C.

Figure 12C:
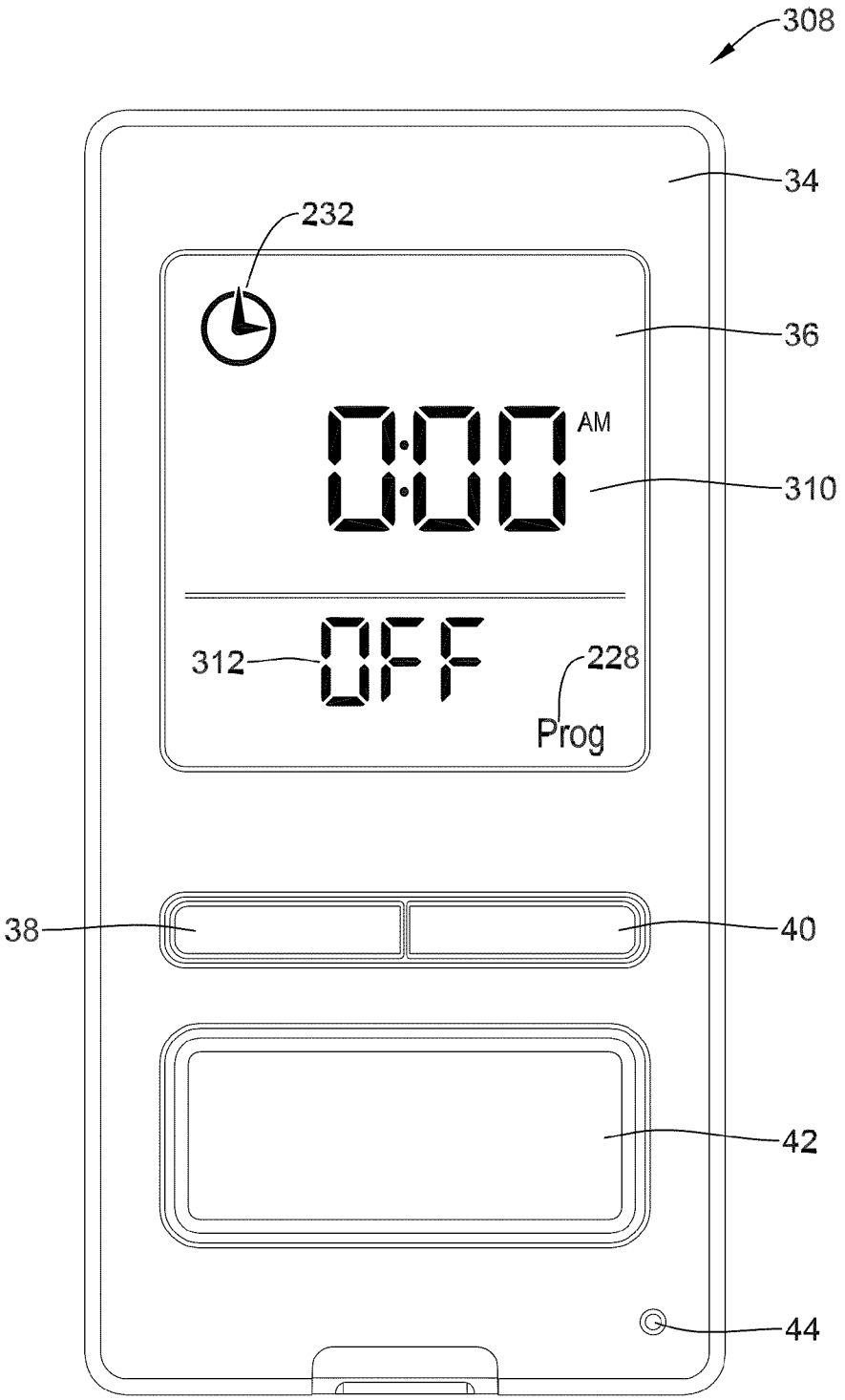

As illustrated, screen 308 shown in FIG. 12C may include an "Off" icon 312 on display 36 indicating that the fan controller is ready to program the off time for the daily on/off program mode of the fan controller. Screen 308 may also include a set time indicator 310 on at least a portion of display 36. In the illustrative screen 308, the set time indicator 310 may include an hour field and a minute field. The user may adjust the hour field and/or minute field of the set time indicator by using button 38 (e.g. adjust forward in time) and/or button 40 (e.g. adjust backward in time). In some cases, the user may increase the set time indicator 310 by pressing button 40, and the user may decrease the set time indicator 310 by pressing button 38. Once the desired off time is displayed on the set time indicator 310, the user may press button 42 to accept the setting.

Figure 12D:
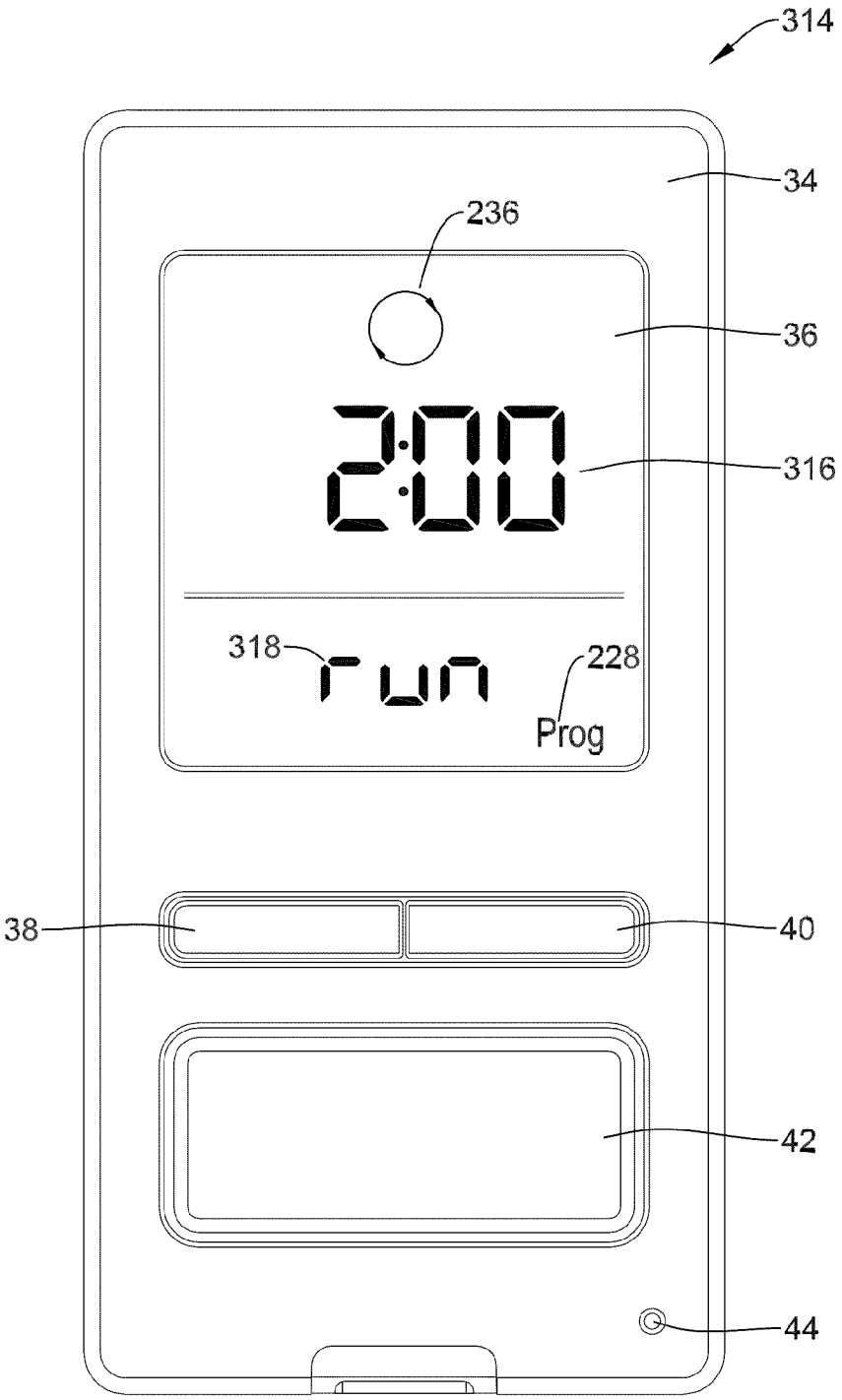

As illustrated, screen 314 shown in FIG. 12D may include a "run" icon 318 on display 36 indicating that the fan controller is ready to program the run time for the customized cycle program mode of the fan controller. Screen 314 may also include a run time indicator 316 on at least a portion of display 36. In the illustrative screen 314, the run time indicator 316 may include an hour field and a minute field. The user may adjust the hour field and/or minute field of the run time indicator 316 by using button 38 (e.g. adjust forward in time) and/or button 40 (e.g. adjust backward in time). In some cases, the user may increase the run time indicator 316 by pressing button 40, and the user may decrease the run time indicator 316 by pressing button 38. Once the desired run time is displayed on the run time indicator 316, the user may press button 42 to accept the setting. Once accepted, the fan controller may display the illustrative screen 320 shown in FIG. 12E.

Figure 12E:
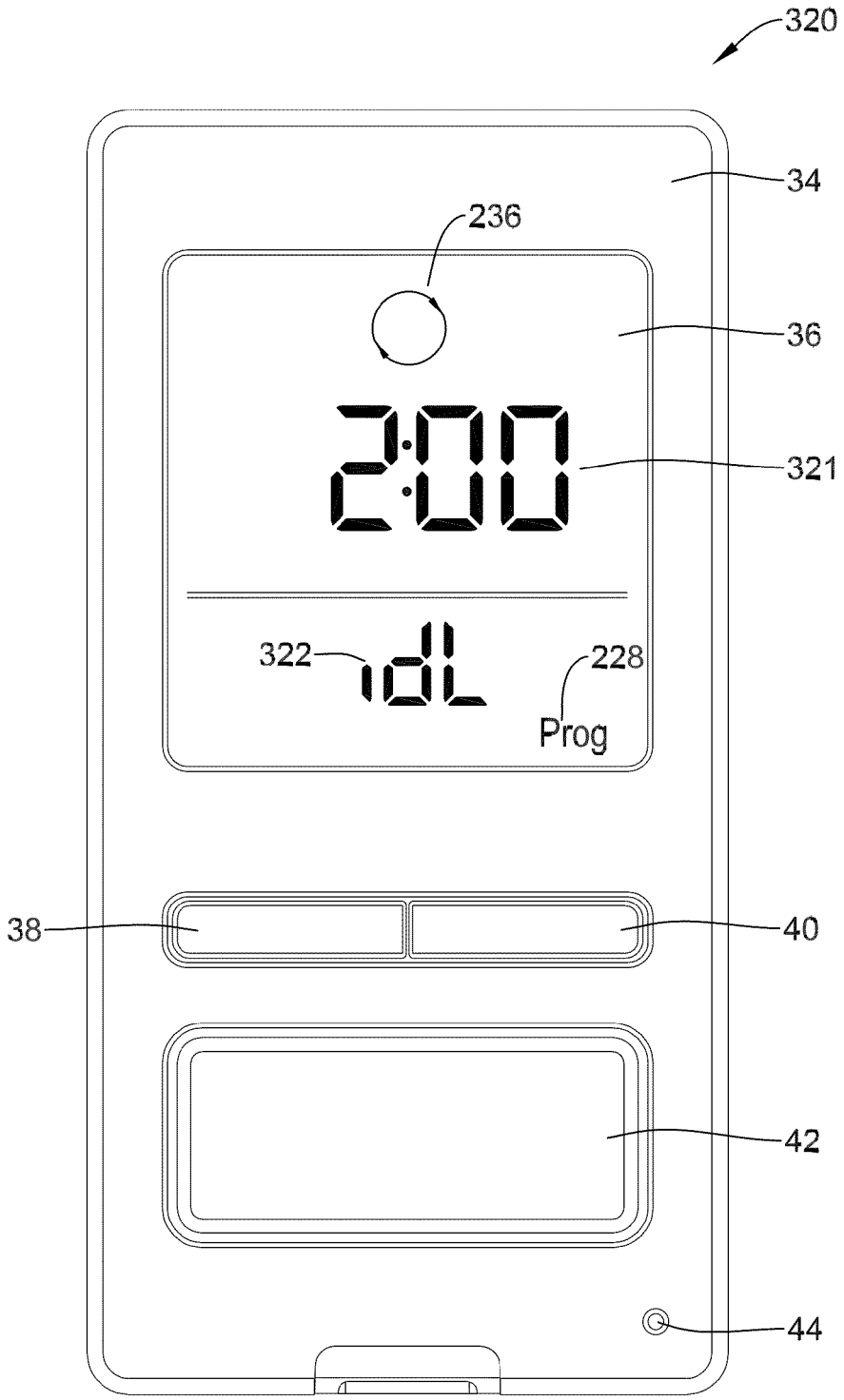

As illustrated, screen 320 shown in FIG. 12E may include an "idL" icon 322 on display 36 indicating that the fan controller is ready to program the idle time for the customized cycle program mode of the fan controller. Screen 320 may also include an idle time indicator 321 on at least a portion of display 36. In the illustrative screen 320, the idle time indicator 321 may include an hour field and a minute field. The user may adjust the hour field and/or minute field of the idle time indicator 321 by using button 38 (e.g. adjust forward in time) and/or button 40 (e.g. adjust backward in time). In some cases, the user may increase the idle time indicator 321 by pressing button 40, and the user may decrease the idle time indicator 321 by pressing button 38. Once the desired idle time is displayed on the idle time indicator 321, the user may press button 42 to accept the setting.

FIGS. 13A-13F show pictorial views of illustrative screens 324, 330, 336, 342, 348, and 354 that may be displayed on display 36 to set and/or modify one or more parameters, such as one or more ASHRAE parameters of a fan controller. For example, the ASHRAE parameter mode may allow a user to set and/or modify the units displayed (standard/metric), the number of bedrooms in the installation, the floor size, the fan capacity, and/or whether the installation passes or fails an ASHRAE 62.2 test. In some embodiments, the ASHRAE parameter mode may be entered at first power-up or at any time during the operation of the fan controller by pressing one or more of buttons 38, 40, and 42. In one embodiment, the ASHRAE parameter mode may be entered when the bath fan controller is initially powered up. In some cases, if the one or more parameters of the ASHRAE parameter mode are set or programmed, subsequent power-ups of the fan controller may not automatically enter the ASHRAE parameter mode. If, however, the one or more parameters of the ASHRAE parameter mode have not been set, subsequent power-ups of the fan controller may automatically enter the ASHRAE parameter mode and display screen 324. While the fan controller is operating, depressing one or more of buttons 38, 40, and 42 in a predetermined manner may enter the ASHRAE parameter mode. In one example, depressing buttons 40 and 42 when the bath fan controller is in the setup mode may enter the ASHRAE parameter mode. In another example, depressing buttons 38 and 42 when the fan controller is in the setup mode may enter the ASHRAE parameter mode. However, it is contemplated that the ASHRAE parameter mode may be entered by depressing any one or combination of buttons 38, 40, and 42, as desired.

Once the ASHRAE parameter mode is entered, screens 324, 330, 336, 342, 348, and 354 may be displayed on display 36. In some embodiments, if at least one of buttons 38, 40, and/or 42 is not pressed within a predetermined period of time after entering the ASHRAE parameter mode, such as 30 second, 60 seconds, t 2 minutes, or any other time, the bath fan controller may exit the ASHRAE parameter mode and return to the home screen.

Figure 13A:
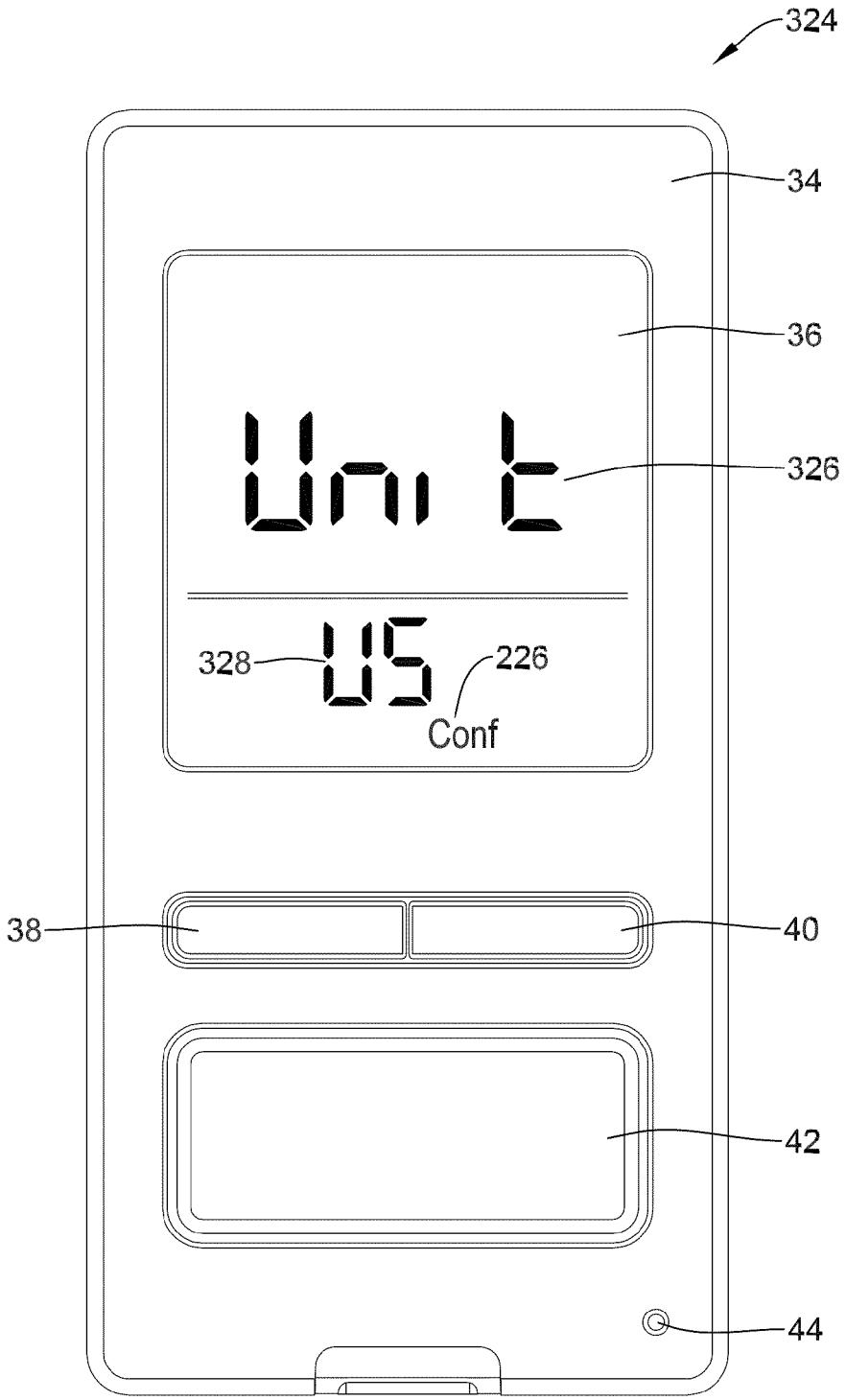
Figure 13B:
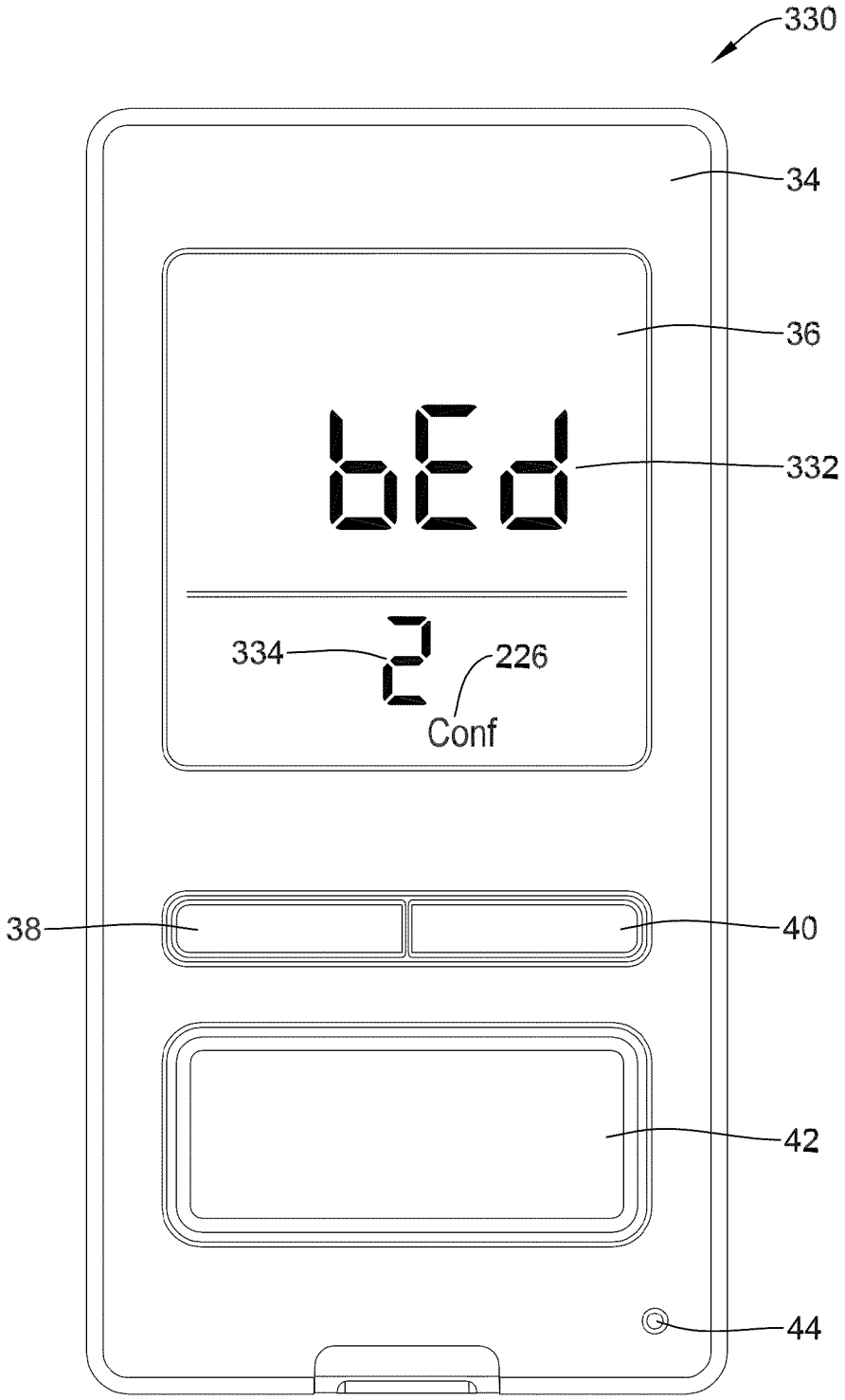

As illustrated in FIG. 13A, screen 324 may include a "Unit" icon 326 on display 36, indicating that the fan controller is ready to program the units of the fan controller. Screen 326 may also include a "US" icon 328 to indicate that U.S. standard units are selected. A user may change the units from U.S. standard units to metric units by pressing button 38 and/or button 40. If metric units are selected, an appropriate icon, such as for example, "Mtr" or "Met" may be displayed on display 36. To accept the setting, the user may simply press button 42. Once accepted, the fan controller may sequence to the illustrative screen 330 shown in FIG. 13B.

As illustrated, screen 330 may include a "bEd" icon 332 on display 36, indicating that the fan controller is ready to set the number of bedrooms in the installation. Screen 326 may also include an icon 334 for displaying the number of bedrooms. As illustrated, icon 334 displays "2", indicating that the current installation has two bedrooms. To set the number of bedrooms, the user may press button 38 and/or button 40 until icon 334 displays the desired number of bedrooms. In some cases, the user may press button 38 to increase the number of icon 334 corresponding to the number of bedrooms and the user presses button 40 to decrease the number of icon 334 corresponding to the number of bedrooms. When the desired number of bedrooms is displayed in icon 334, the user may press button 42 to accept the setting.

Figure 13C:
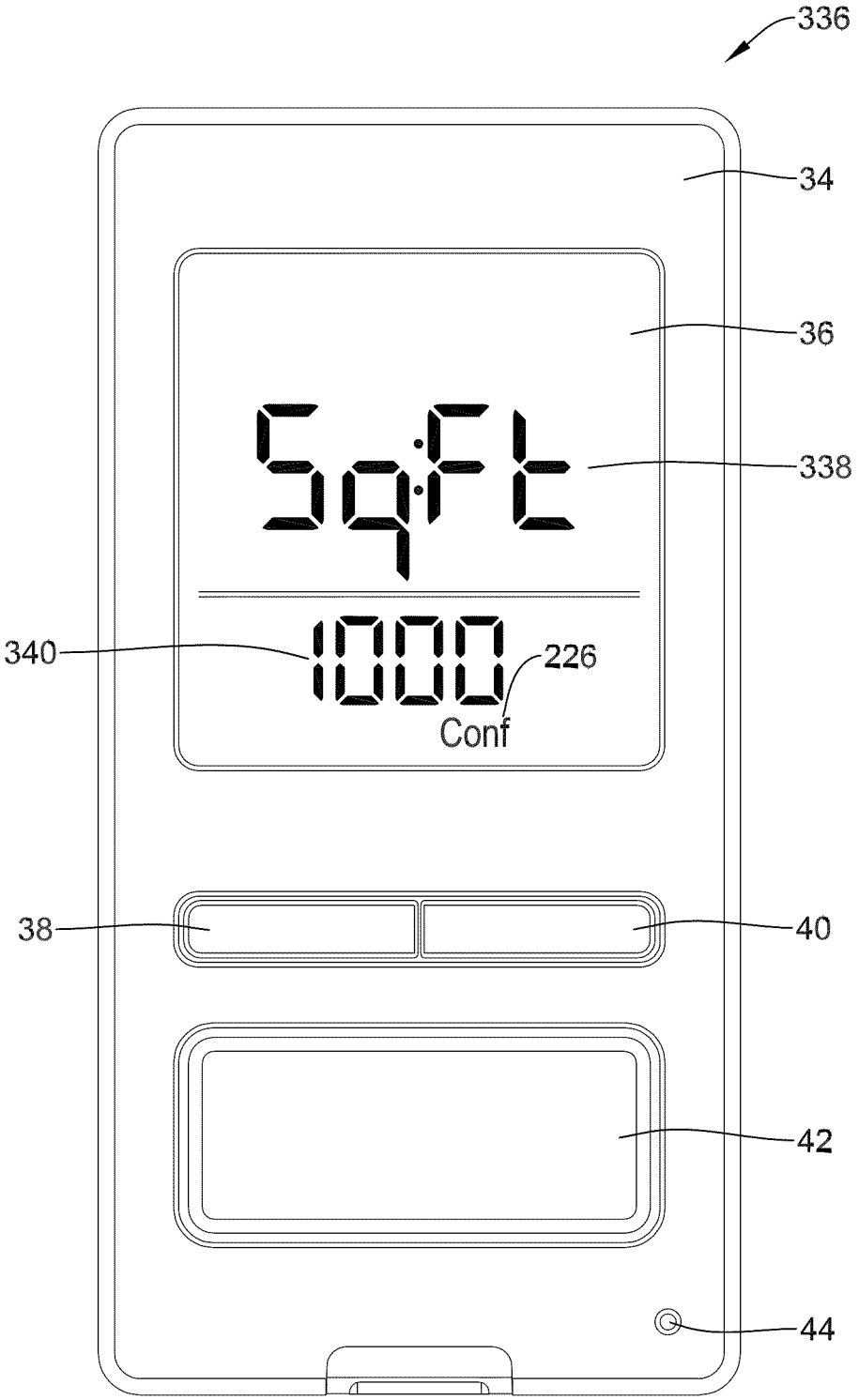

Once the number of bedrooms is accepted, and in the illustrative embodiment, the fan controller may display the illustrative screen 336 shown in FIG. 13C for setting and/or programming the floor size of the installation. As illustrated, screen 336 may include a "Sq:Ft" icon 338 on display 36, indicating that the fan controller is ready to set or program the number of square feet serviced by the fan controller (e.g. square feet of the installation). Screen 336 may also include an icon 340 for displaying the square footage. As illustrated, icon 340 displays "1000" indicating that the fan controller is servicing one thousand square feet. To adjust the square footage, the user may press button 38 and/or button 40 until icon 340 displays the desired square footage of the installation. In some cases, the user may press button 38 to increase the number of icon 340 and the user presses button 40 to decrease the number of icon 340. When the desired square footage is displayed in icon 340, the user may press button 42 to accept the setting. In some embodiments, square footage may be used when U.S. or standard units are selected for the bath fan controller. If however, metric units are selected, the bath fan controller may display square meters.

Figure 13D:
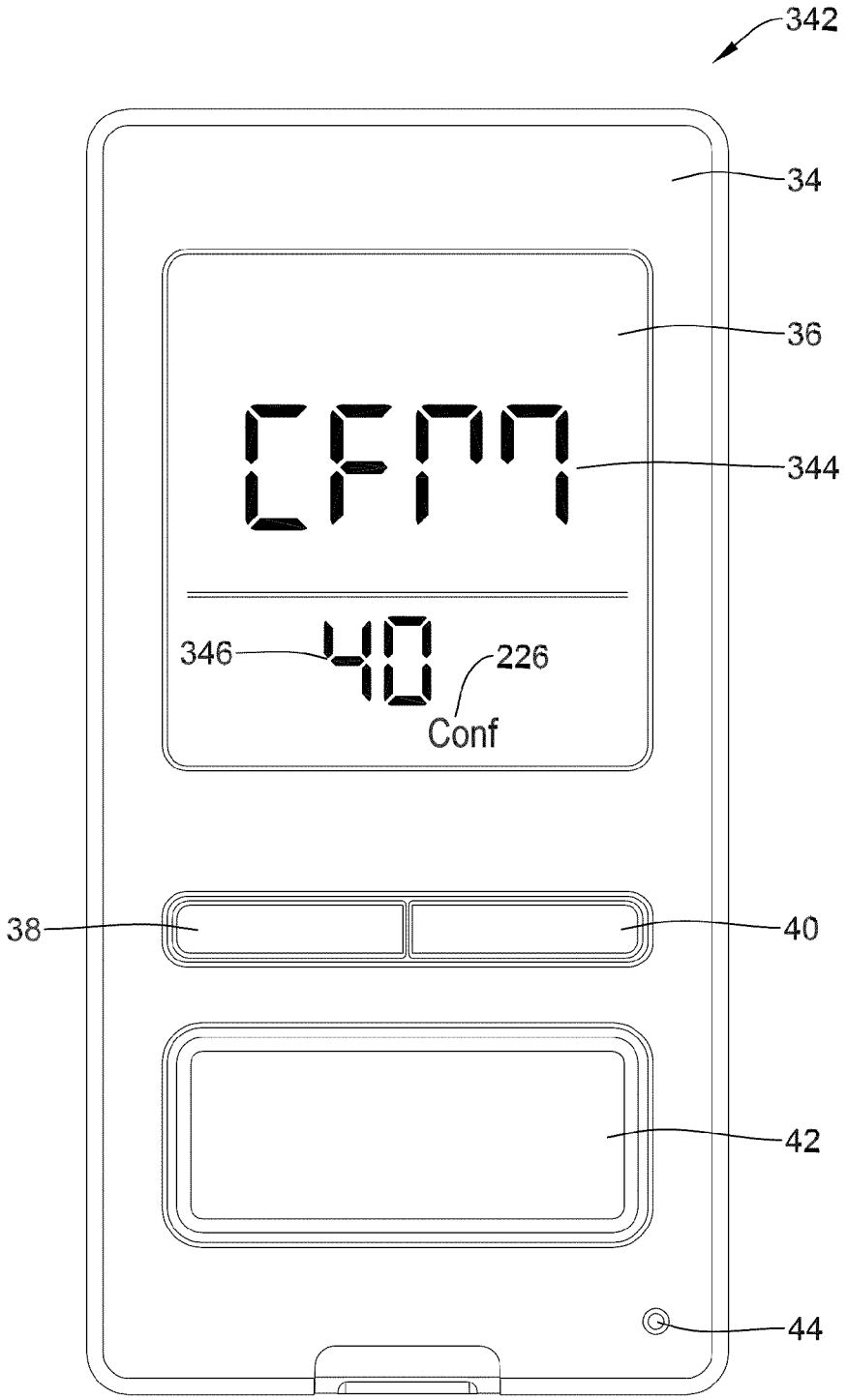
Figure 13E:
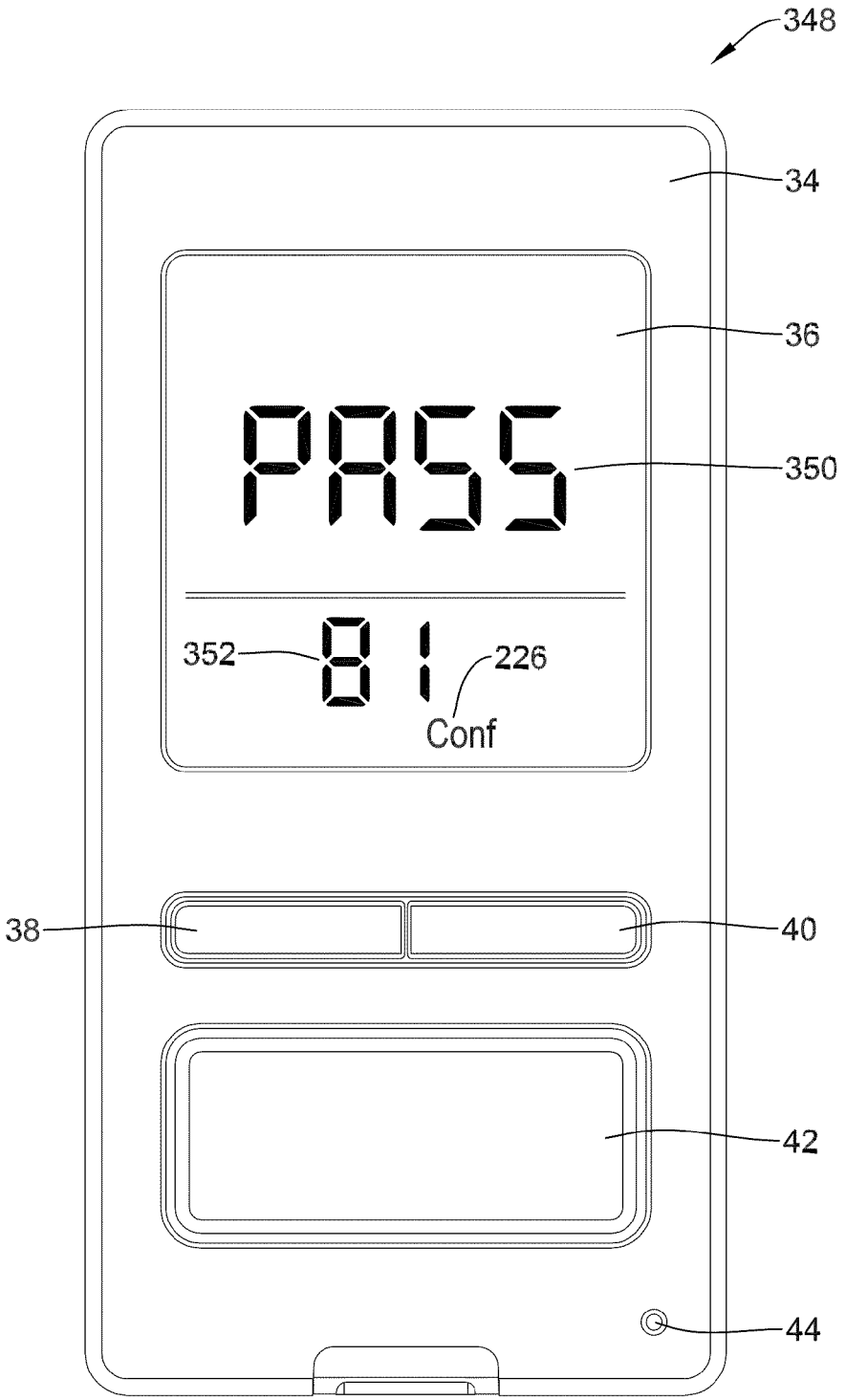
Figure 13F:
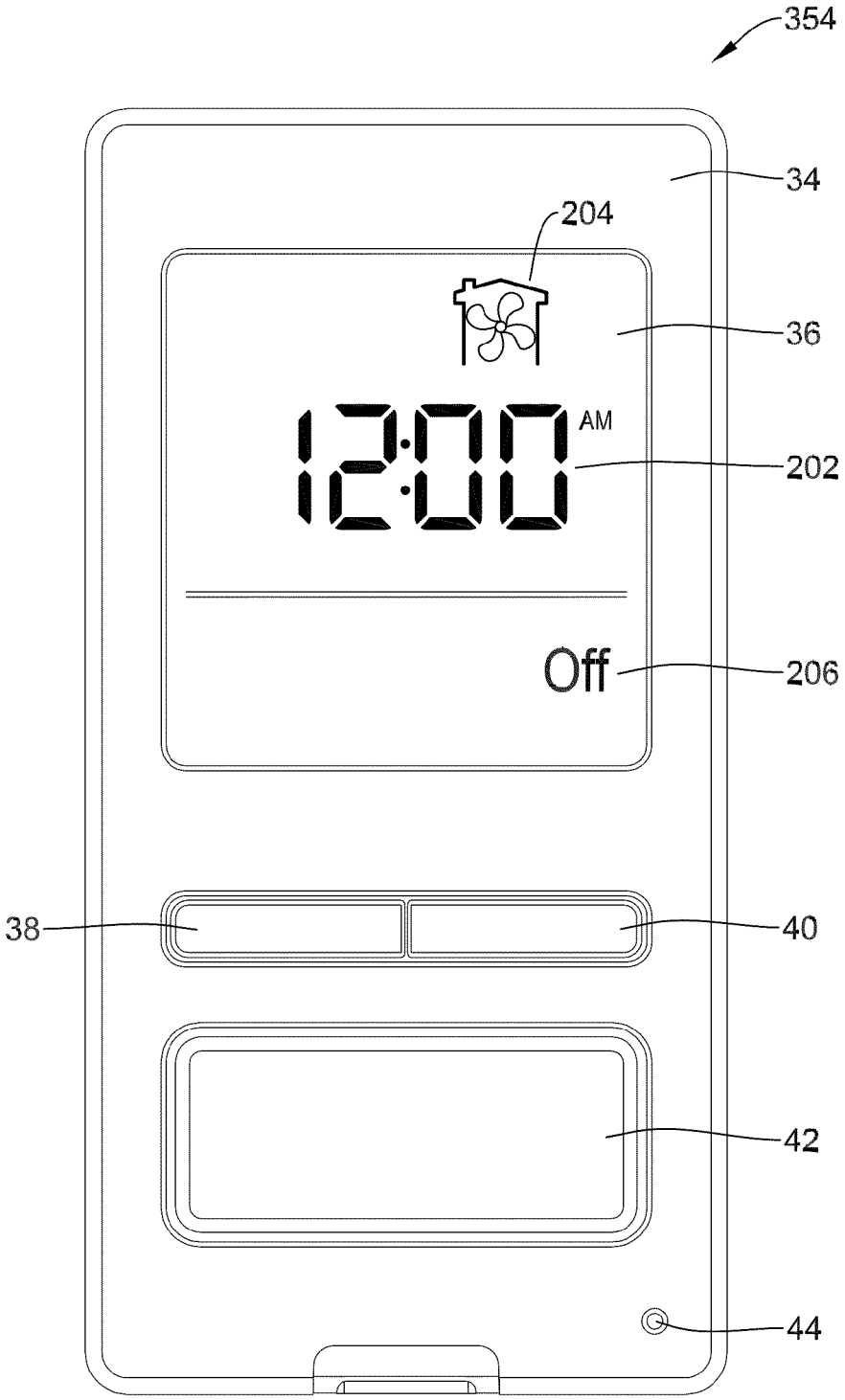

Once the floor size is accepted, the fan controller may display the illustrative screen 342 shown in FIG. 13D for setting and/or programming the fan flow capacity of the fan that is connected to the fan controller. As illustrated, screen 342 may include a "CFM" icon 344 on display 36, indicating that the fan controller is ready to set or program the fan flow capacity. Screen 342 may also include an icon 346 for displaying the fan flow capacity. As illustrated, icon 346 displays "40", indicating that the fan flow capacity is set at forty cubic feet per minute (cfm). To adjust the fan flow capacity, the user may press button 38 and/or button 40 until icon 346 displays the desired fan flow capacity parameter. When the desired fan flow capacity parameter is displayed in icon 346, the user may press button 42 to accept the setting. In some embodiments, fan flow capacity parameter may be displayed in cubic feet per minute when the fan controller is set to U.S. or standard units. The fan flow capacity parameter may be displayed as liters per second (lps) when the fan controller is set to metric units. However, it is contemplated that any suitable unit of measure may be used to indicate the current fan capacity as desired.

As illustrated, screen 348 may include an icon 350 on display 36 indicating whether the fan controller passes or fails the ASHRAE 62.2 standard. Screen 348 may also include icon 352 indicating the percentage of time the fan will run based on the ASHRAE settings. If icon 352 displays a value greater than 100, which indicates that the fan would have to run greater than 100 percent of the time, icon 350 will display "FAIL". As illustrated, the bath fan controller displays "PASS" in icon 350 indicating that the fan controller meets the ASHRAE 62.2 standards, and "81" in icon 352 indicating that the fan will operate 81 percent of the time based on the programmed ASHRAE parameters. The user may press button 42 to exit the ASHRAE 62.2 test. After the ASHRAE 62.2 test, the fan controller may display home screen 200 if the installation mode was entered at first power-up, or the fan controller may display setup menu screens 218, 244, 280, or 300 of FIGS. 9A, 10A, 11A, and 12A, respectively, on display 36.

In some embodiments, electric timer 30 may be configured and/or programmed to switch power between the "on" state and the "off" state for multiple loads. For example, the electric timer may be programmed to switch power to a light between the "on" state and the "off" state, as described above, and, at the same time, be programmed to switch power to a fan between the "on" state (sometimes between a number of different "on" states of different fan speeds) and the "off" state, as described above. In some embodiments, the electric timer 30 may be programmed to switch between a "lighting" mode for controlling the power to the light and a "ventilation" mode for controlling the power to the fan. In some cases, the electric timer 30 may switch between the "lighting" mode and the "ventilation" mode by pressing one or more of buttons 38, 40, and 42 or by pressing a sequence of one or more buttons 38, 40, and 42. In one example, the electric timer 30 may have a default mode of, for example, the "lighting" mode. When in the "lighting" mode, a user may be able to control the lighting, as discussed above. When a user presses one or more of buttons 38, 40, and 42, the electric timer 30 may switch to "ventilation" mode. In the "ventilation" mode, a user may be able to control the ventilation, as discussed above. In some cases, if the electric timer 30 does not detect user interaction with the one or more buttons 38, 40, and 42 after a period of timer, such as one minute, two minutes, three minutes, four minutes, five minutes, or any other suitable length of time, the electric time 30 may return to the default mode. In other embodiments, electric timer 30 may have dedicated buttons for operating the different loads (e.g. fan, lights, etc.). For example, button 42 may be configured to switch the light between the "on" state and the "off" state and one or more of buttons 38 and 40 may be configured to switch the fan between the "on" state and the "off" state. However, it is contemplated that other buttons may be used, this is just one example.

Furthermore, it is contemplated that the electric timer 30 may be configured and/or programmed to control one or more loads in any suitable manner. Further, it is to be understood that the foregoing disclosure is merely illustrative and it is contemplated that features of the various embodiments and Figures may be mixed and matched, as desired.

Having thus described the preferred embodiments of the present invention, those of skill in the art will readily appreciate that yet other embodiments may be made and used within the scope of the claims hereto attached. Numerous advantages of the invention covered by this document have been set forth in the foregoing description. It will be understood, however, that this disclosure is, in many respect, only illustrative. Changes may be made in details, particularly in matters of shape, size, and arrangement of parts without exceeding the scope of the invention. The invention's scope is, of course, defined in the language in which the appended claims are expressed.

What is claimed is:

1. A wall mountable electric timer for switching power to a fan between an "on" state and an "off" state, the wall mountable electric timer comprising:

a housing having a front, a back, and side walls extending between the front and the back, the housing configured to be mountable to a wall with the back situated toward the wall and the front facing away from the wall;

at least one memory for storing a time-based programmable fan schedule and one or more parameters;

a controller coupled to the at least one memory for controlling the switching of power to the fan between an "on" state and an "off" state in accordance with the time-based programmable fan schedule;

a user interface situated on the front of the housing and coupled to the controller, the user interface including a display, a first button and a second button; and the controller is programmed such that a user can program the time-based programmable fan schedule and the one or more parameters by interacting with the first button and the second button, the controller is programmed to display one or more screens for setting the time-based programmable fan schedule and the one or more parameters by interacting with the first button and/or second button.

2. The wall mountable electric timer of claim 1, wherein the controller displays a home screen of the electric timer if the controller does not detect the depression of the first button or the second button for a period of time after one or more screens for setting the one or more parameters are initially displayed in response to the controller being initially powered up.

3. The wall mountable electric timer of claim 2, wherein the period of time is at least 60 seconds.

4. The wall mountable electric timer of claim 1, wherein, if the one or more parameters are not set after one or more screens for setting the one or more parameters are initially displayed in response to the controller being initially powered up, the controller is programmed to display the one or more screens for setting the one or more parameters when the controller is subsequently powered up and, if the one or more parameters are set, the controller is programmed to not display the one or more screens for setting the one or more parameters when the controller is subsequently powered up.

5. The wall mountable electric timer of claim 1, wherein the one or more parameters include a floor space parameter, a number of bedrooms parameter, and a fan capacity parameter.

6. The wall mountable electric timer of claim 1, wherein the controller is programmed to display time and/or date information on the display of the user interface.

7. The wall mountable electric timer of claim 1, wherein the controller has an operating mode and a setup mode.

8. The wall mountable electric timer of claim 7, wherein in the operating mode, depressing the first button causes the controller to switch power to the fan between the "on" state and the "off" state.

9. The wall mountable electric timer of claim 8, wherein in the operating mode, the current time and an icon corresponding to the operating mode are displayed on the display.

10. The wall mountable electric timer of claim 7, wherein in the operating mode, depressing the first button for an extended period of time causes the controller to enter the setup mode.

11. The wall mountable electric timer of claim 10, wherein one or more screens for setting the one or more parameters are displayed after first depressing the first button and second button when in the setup mode.

12. The wall mountable electric timer of claim 1, wherein the one or more screens include a screen that indicates if the wall mountable electric timer meets the ASHRAE 62.2 standard.

13. The wall mountable electric timer of claim 1, wherein the wall mountable electric timer switches power to a light between an "on" state and an "off" state.

14. A fan controller for switching power to a fan between an "on" state and an "off" state, the fan controller comprising:

a housing having a front, a back and side walls extending between the front and the back, the housing configured to be mountable to a wall with the back situated toward the wall and the front facing away from the wall;

a controller for controlling the switching of power to the fan between an "on" state and an "off" state in accordance with a programmable fan schedule;

a user interface situated on the front of the housing and coupled to the controller, the user interface including a display, a first button, a second button, and a third button; and the controller having an operating mode and a setup mode, wherein in the operating mode, depressing the first button causes the controller to switch power to the fan between the "on" state and the "off" state, and depressing the second button initiates a countdown mode that causes the controller to switch power to the fan to the "on" state for a programmable period of time and then switching the fan to the "off" state.

15. The fan controller of claim 14, wherein depressing the third button initiates a countdown mode that causes the controller to switch power to the fan to the "on" state for a programmable period of time.

16. The fan controller of claim 14, wherein once the countdown mode is initiated, the second button and/or the third button can be used to adjust the programmable period of time of the countdown mode.

17. The fan controller of claim 16, wherein once the countdown mode is initiated, depressing the first button accepts the programmable period of time and activates the countdown mode.

18. The fan controller of claim 17, wherein once the countdown mode is activated, depressing the first button cancels the countdown mode.

19. The fan controller of claim 14, wherein depressing the first button causes the controller to switch power to the fan between the "on" state and "off" state, wherein the fan remains in the "on" state or the "off" state until a next scheduled switch between the "on" state and "off" state according to the programmable fan schedule.

20. A bath fan controller for switching power to a bath fan between an "on" state and an "off" state, the bath fan controller comprising:

a housing having a front, a back, and side walls extending between the front and the back, the housing configured to be mountable to a wall with the back situated toward the wall and the front facing away from the wall;

at least one memory for storing two or more programmable fan schedules and one or more parameters;

a controller coupled to the at least one memory for controlling the switching of power to the fan between an "on" state and an "off" state in accordance with one of the two or more programmable fan schedules, a first programmable fan schedule including a cycled "on" state and "off" state, a second programmable fan schedule including a daily switch "on" time and a daily switch "off" time;

a user interface situated on the front of the housing and coupled to the controller, the user interface including a display, a first button, a second button, and a third button; and the controller is programmed such that a user can set and/or modify one or more of the programmable fan schedules and the one or more parameters by interacting with the first button, the second button, and/or the third button.

21. The bath fan controller of claim 20, wherein the two or more programmable fan schedules includes a third programmable fan schedule, the third programmable fan schedule cycling the fan between the "on" state and the "off" state, the time the fan is in the "on" state and/or in the "off" state depending on a number of bedrooms parameter, a floor size parameter, and a fan flow capacity parameter.

22. A bathroom fan controller for switching power to a bathroom fan between an "on" state and an "off" state, the bathroom fan controller comprising:

a housing having a front, a back, and side walls extending between the front and the back, the housing configured to be mountable to a wall with the back situated toward the wall and the front facing away from the wall; and a controller, the controller for cycling the fan between the "on" state and the "off" state, wherein the time the fan is in the "on" state and/or in the "off" state being controlled by the controller based on one or more of a number of bedrooms parameter, a floor size parameter, and a fan flow capacity parameter.

* * * * *